US009689307B2

(12) United States Patent
Tour et al.

(10) Patent No.: US 9,689,307 B2
(45) Date of Patent: Jun. 27, 2017

(54) CROSSOVER VALVE IN DOUBLE PISTON CYCLE ENGINE

(71) Applicant: Tour Engine, Inc., San Diego, CA (US)

(72) Inventors: Hugo Benjamin Tour, San Diego, CA (US); Oded Tour, San Diego, CA (US); Gilad Tour, San Diego, CA (US)

(73) Assignee: Tour Engine, Inc., San Diego, CA (US)

( * ) Notice: Subject to any disclaimer, the term of this patent is extended or adjusted under 35 U.S.C. 154(b) by 54 days.

(21) Appl. No.: 14/817,142

(22) Filed: Aug. 3, 2015

(65) Prior Publication Data

US 2016/0305311 A1 Oct. 20, 2016

Related U.S. Application Data

(63) Continuation of application No. 14/362,101, filed as application No. PCT/US2012/067477 on Nov. 30, 2012, now Pat. No. 9,097,178.

(Continued)

(51) Int. Cl.
*F02B 33/22* (2006.01)
*F02B 33/30* (2006.01)

(Continued)

(52) U.S. Cl.
CPC ..... *F02B 33/30* (2013.01); *F02B 33/18* (2013.01); *F02B 33/22* (2013.01); *F02B 19/02* (2013.01);

(Continued)

(58) Field of Classification Search
CPC ..... F02B 33/30; F02B 33/18; F02B 33/22; F02B 19/02; F02B 2710/036; F02B 19/18

(Continued)

(56) References Cited

U.S. PATENT DOCUMENTS 1,076,846 A 10/1913 Slick
1,372,216 A 3/1921 Casaday (Continued)

FOREIGN PATENT DOCUMENTS

CN 1160435 9/1997
CN 101253316 8/2008

(Continued)

OTHER PUBLICATIONS

Supplementary European Search Report for EP 12854161.2, issued Feb. 2, 2016, 7 pages.

(Continued)

*Primary Examiner* — Hung Q Nguyen
(74) *Attorney, Agent, or Firm* — Morrison & Foerster LLP

(57) ABSTRACT

An internal combustion engine, including a combustion chamber with a first aperture; a compression chamber with a second aperture; and a crossover valve comprising an internal chamber, first and second valve seats, a valve head, and first and second valve faces on the valve head, wherein the first aperture allows fluid communication between the combustion chamber and the internal chamber, the second aperture allows fluid communication between the compression chamber and the internal chamber, the first valve face couples to the first valve seat to occlude the first aperture, and the second valve face couples to the second valve seat to occlude the second aperture.

23 Claims, 49 Drawing Sheets

Related U.S. Application Data

(60) Provisional application No. 61/714,039, filed on Oct. 15, 2012, provisional application No. 61/565,286, filed on Nov. 30, 2011.

(51) Int. Cl.
*F02B 33/18* (2006.01)
*F02B 19/18* (2006.01)
*F02B 19/02* (2006.01)

(52) U.S. Cl.
CPC ..... *F02B 19/18* (2013.01); *F02B 2710/036* (2013.01)

(58) Field of Classification Search
USPC ..... 123/52.1–59.7, 60.1, 61 R–63, 67–68, 123/69 R–72, 662–663, 27 R
See application file for complete search history.

(56) References Cited

U.S. PATENT DOCUMENTS

| | | | | |
|---|---|---|---|---|
| 1,904,070 | A | 4/1933 | Morgan | |
| 2,182,430 | A | 12/1939 | Gersman | |
| 2,594,845 | A | 4/1952 | Baumann | |
| 3,623,463 | A | 11/1971 | De Vries | |
| 3,675,630 | A | 7/1972 | Stratton | |
| 3,826,086 | A | 7/1974 | Milisavljevic | |
| 3,880,126 | A | 4/1975 | Thurston et al. | |
| 3,959,974 | A | 6/1976 | Thomas | |
| 4,133,172 | A * | 1/1979 | Cataldo | F02G 1/02 123/294 |
| 4,170,970 | A | 10/1979 | McCandless | |
| 4,307,687 | A | 12/1981 | Holstein | |
| 4,458,635 | A | 7/1984 | Beasley | |
| 4,739,615 | A | 4/1988 | Staheli | |
| 5,546,897 | A | 8/1996 | Brackett | |
| 5,623,894 | A | 4/1997 | Clarke | |
| 5,713,314 | A | 2/1998 | Beare | |
| 6,199,369 | B1 | 3/2001 | Meyer | |
| 6,880,501 | B2 | 4/2005 | Suh et al. | |
| 7,273,023 | B2 | 9/2007 | Tour et al. | |
| 7,383,797 | B2 | 6/2008 | Tour | |
| 7,458,350 | B2 | 12/2008 | Diggs | |
| 7,516,723 | B2 | 4/2009 | Tour | |
| 8,051,811 | B2 | 11/2011 | Phillips | |
| 8,272,357 | B2 | 9/2012 | Lou | |
| 8,505,504 | B2 * | 8/2013 | Green | F01L 7/026 123/51 B |
| 2003/0015171 | A1 | 1/2003 | Scuderi | |
| 2008/0034755 | A1 | 2/2008 | Tour et al. | |
| 2009/0044778 | A1 | 2/2009 | Scuderi et al. | |
| 2010/0186689 | A1 | 7/2010 | Tour et al. | |
| 2010/0236534 | A1 | 9/2010 | Scuderi et al. | |
| 2010/0269806 | A1 | 10/2010 | Kreuter | |
| 2011/0265760 | A1 * | 11/2011 | Park | F02B 75/228 123/403 |
| 2012/0031383 | A1 * | 2/2012 | Stockhausen | F02B 33/20 123/70 R |
| 2012/0073552 | A1 * | 3/2012 | Phillips | F02B 33/22 123/70 R |

FOREIGN PATENT DOCUMENTS

| | | |
|---|---|---|
| DE | 428 159 | 11/1926 |
| GB | 2 413 361 | 10/2005 |
| WO | WO-96/21804 | 7/1996 |
| WO | WO-99/47804 | 9/1999 |
| WO | WO-2006/113635 | 10/2006 |

OTHER PUBLICATIONS

International Preliminary Report on Patentability and Written Opinion for PCT/US2012/067477, 7 pages.
International Search Report for PCT/US2012/067477, mailed Feb. 15, 2013, 2 pages.

* cited by examiner

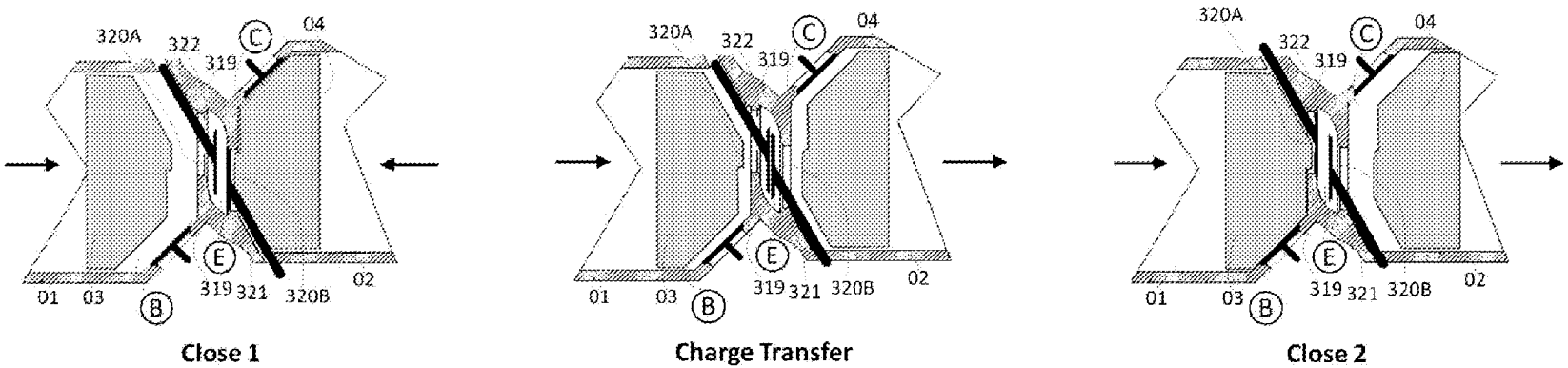
FIG.20A
FIG.20B
FIG.20C
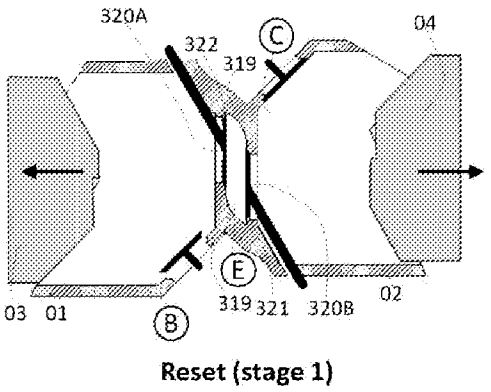
FIG.20D
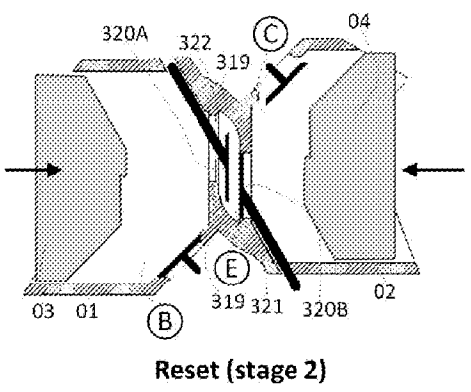
FIG.20E 720
724
B
C
TDC
722

712
720
725
C
721
B 726
723
720
724
B
C
704

CROSSOVER VALVE IN DOUBLE PISTON CYCLE ENGINE

CROSS REFERENCE TO RELATED APPLICATIONS

This application is a continuation of U.S. Ser. No. 14/362,101 filed Nov. 30, 2012 Int'l., which is a U.S. National Stage of PCT/US2012/067477 which claims the benefit of U.S. Provisional Application No. 61/565,286, filed Nov. 30, 2011, and U.S. Provisional Application No. 61/714,039, filed Oct. 15, 2012, the disclosures of which are herein incorporated by reference in their entireties.

BACKGROUND OF THE INVENTION

Field of the Invention

The present invention relates generally to split-cycle internal combustion engines also known as split-cycle engines and, more specifically, to a Double Piston Cycle Engine (DPCE) that is more efficient than conventional combustion engines.

Description of the Related Art

Conventional internal combustion engines include one or more cylinders. Each cylinder includes a single piston that performs four strokes, commonly referred to as the intake, compression, combustion/power/expansion, and exhaust strokes. Together, these four strokes form a complete cycle of a conventional internal combustion engine. However, a single cylinder cannot be optimized both as a compressor (requires cold environment for optimal efficiency performance) and a combustor (requires hot environment and optimal expansion of the working fluid for optimal efficiency performance) at the same time and space.

Conventional internal combustion engines have low fuel efficiency—more than one half of the potential thermal energy created by conventional engines is estimated to dissipate through the engine structure and exhaust outlet, without adding any useful mechanical work. A major cause of thermal waste in conventional internal combustion engines is the essential cooling system (e.g., radiator), which alone dissipates heat at a greater rate and quantity than the total heat actually transformed into useful work. Furthermore, conventional internal combustion engines are able to increase efficiencies only to a low degree by employing low heat rejection methods in the cylinders and pistons.

Further inefficiency results from high-temperature in the cylinder during the intake and compression strokes. This high temperature reduces engine volumetric efficiency, makes the piston work harder and, hence, reduces efficiency during these strokes.

Theoretically, a larger expansion ratio than compression ratio will greatly increase engine efficiency in an internal combustion engine. In conventional internal combustion engines, the expansion ratio is largely dependent on the compression ratio. Moreover, conventional means to make the engine expansion ratio larger than the compression ratio (Miller and Atkinson cycles, for example) are less efficient than the increase in efficiency, which is possible if all four strokes would have not been executed in a single cylinder.

Another problem with conventional internal combustion engines is an incomplete chemical combustion process, which reduces efficiency and causes harmful exhaust emissions.

To address these problems, others have previously disclosed dual-piston combustion engine configurations. For example, U.S. Pat. No. 1,372,216 to Casaday discloses a dual piston combustion engine in which cylinders and pistons are arranged in respective pairs. The piston of the firing cylinder moves in advance of the piston of the compression cylinder. U.S. Pat. No. 3,880,126 to Thurston et al. discloses a two-stroke cycle split-cylinder internal combustion engine. The piston of the induction cylinder moves somewhat less than one-half stroke in advance of the piston of the power cylinder. The induction cylinder compresses a charge, and transfers the charge to the power cylinder where it is mixed with a residual charge of burned products from the previous cycle, and further compressed before igniting. U.S. Pat. Application No. 2003/0015171 A1 to Scuderi discloses a four-stroke cycle internal combustion engine. A power piston within a first cylinder is connected to a crankshaft and performs power and exhaust strokes of the four-stroke cycle. A compression piston within a second cylinder is also connected to the crankshaft and performs the intake and compression strokes of the same four-stroke cycle during the same rotation of the crankshaft. The power piston of the first cylinder moves in advance of the compression piston of the second cylinder. U.S. Pat. No. 6,880,501 to Suh et al. discloses an internal combustion engine that has a pair of cylinders, each cylinder containing a piston connected to a crankshaft. One cylinder is adapted for intake and compression strokes. The other cylinder is adapted for power and exhaust strokes. U.S. Pat. No. 5,546,897 to Brackett discloses a multi-cylinder reciprocating piston internal combustion engine that can perform a two, four, or diesel engine power cycle.

However, these references fail to disclose how to differentiate cylinder temperatures to effectively isolate the firing (power) cylinders from the compression cylinders and from the surrounding environment. In addition, these references fail to disclose how to minimize mutual temperature influence between the cylinders and the surrounding environment. Further, these references fail to disclose engine improvements that enhance conventional internal combustion engine efficiency and performance by raising the power cylinder temperature and lowering the compression cylinder temperature. Specifically, increasing power cylinder temperature allows for increased kinetic work extraction, while minimizing compression cylinder temperature allows for reduced energy investment. In addition, the separate cylinders disclosed in these references are all connected by a transfer valve or intermediate passageway (connecting tube) of some sort that yields substantial volume of "dead space" between cylinders.

U.S. Pat. No. 5,623,894 to Clarke discloses a dual compression and dual expansion internal combustion engine. An internal housing, containing two pistons, moves within an external housing thus forming separate chambers for compression and expansion. However, Clarke contains a single chamber that executes all of the engine strokes. As noted above, a single chamber prevents isolation and/or improved temperature differentiation of cylinders such as those disclosed in embodiments of the present invention.

U.S. Pat. No. 3,959,974 to Thomas discloses an internal combustion engine including a combustion cylinder constructed, in part, of material capable of withstanding high temperatures and a power piston having a ringless section, also capable of withstanding high temperatures, connected to a ringed section, which maintains a relatively low temperature. However, elevated temperatures in the entire Thomas engine reside not only throughout the combustion and exhaust strokes, but also during part of the compression stroke.

SUMMARY OF THE INVENTION

In view of the foregoing disadvantages inherent in the known types of internal combustion engine now present in the prior art, embodiments of the present invention include a DPCE combustion engine utilizing temperature differentiated cylinders that converts fuel into energy or work in a more efficient manner than conventional internal combustion engines. Some embodiments of the present invention utilize novel valves for facilitating efficient and reliable transfer of working fluid from a DPCE's compression chamber to combustion chamber.

In an exemplary embodiment of the present invention, a DPCE engine includes a first cylinder coupled to a second cylinder, a first piston positioned within the first cylinder and configured to perform intake and compression strokes but not exhaust strokes, and a second piston positioned within the second cylinder and configured to perform power and exhaust strokes but not intake strokes. Alternatively, the first and second cylinders can be considered as two separate chambers, that could be directly coupled by the opening of a crossover valve, wherein the first piston resides in the first chamber and the second piston resides in the second chamber.

In a further exemplary embodiment, a DPCE engine further includes an intake valve coupled to the first cylinder, an exhaust valve coupled to the second cylinder and a crossover valve that couples an internal chamber of the first cylinder to an internal chamber of the second cylinder.

In a further exemplary embodiment, the engine includes two piston connecting rods, a compression crankshaft, a power crankshaft and two crankshaft connecting rods. The connecting rods connect respective pistons to their respective crankshafts. The compression crankshaft converts rotational motion into reciprocating motion of the first piston. The power crankshaft converts second piston reciprocating motion into engine rotational output motion. The compression crankshaft relative angle with regard to the power crankshaft relative angle differ from each other by implementing a phase angle delay (phase-lag) such that the piston of the power cylinder moves in advance of the piston of the compression cylinder. The crankshaft connecting rods transfer the power crankshaft rotation into compression crankshaft rotation. Alternatively, the two pistons and two cylinders could be designed in line with each other (parallel) where a single crankshaft would be connected to the two pistons. The single crankshaft converts rotational motion into reciprocating motion of both pistons. In one such embodiment, an insulating layer of low heat conducting material could be installed, for example, to separate the relatively cold compression cylinder from the relatively hot power cylinder, as is commonly known in the art.

In a further exemplary embodiment, a DPCE engine further includes an intake valve coupled to the first cylinder, an exhaust valve coupled to the second cylinder and a crossover valve that couples an internal chamber of the first cylinder to an internal chamber of the second cylinder.

In some exemplary embodiments, the mechanically actuated Single Direction Close-Open-Close crossover valve (SDCOC crossover valve) may be constructed of several components: First, a valve body. Second, a Double-Sided-Axial-Poppet (DSAP) valve capable of decoupling the two chambers by sealing the SDCOC crossover valve on either side. More specifically, a first closed position (Close 1) with the DSAP valve sealing by its placement on the valve seat located on the surface of the power cylinder wall or power cylinder head, an open position in which the DSAP valve is not placed on any valve seat on any cylinder wall or cylinder head (and working fluid can pass from the compression cylinder to the power cylinder through the opening around the DSAP valve), and a second closed position (Close 2) with the DSAP valve sealing by its placement on the valve seat located on the surface of the compression cylinder wall or compression cylinder head. Third, a DSAP actuation push rod, which in one exemplary embodiment is an integral metal part of the DSAP. Fourth, a crossover valve return spring. Fifth, a rocker arm. Sixth, a cam follower/lifter. Seventh, a dedicated SDCOC crossover valve cam.

Other embodiments may include one or more of the above, in addition to other features components, as described herein.

In further exemplary embodiments, when the power piston moves toward its top-dead-center, the DSAP valve component may seal on its power-cylinder side due to the action of the SDCOC crossover valve cam setting and the valve reset spring force, as well as the pressure build-up in the compression cylinder.

In further exemplary embodiments, when the power piston approaches top-dead-center, the exhaust valve closes, and the SDCOC crossover valve opens. This may be performed via the cam rotational movement that pushes the cam follower and the rocker arm, which in turn pulls the valve actuation rod and lifts the DSAP component from its valve seat (Close 1 position).

The SDCOC crossover valve initial opening may reduce pressure differential between the two cylinders therefore diminishing most of the compression force that kept the SDCOC crossover valve in close position. This pressure leveling decreases the force required to continue and open the valve and transition it from Close 1 position via the open position to the Close 2 position.

In further exemplary embodiments, the SDCOC crossover valve closes at the Close 2 position as dictated by the camshaft controlled mechanical actuation mechanism. This may happen as the compression piston reaches its TDC and after almost all of the working fluid was transferred to the power cylinder. In addition, shortly before SDCOC crossover valve closes at the Close 2 position the pressure in the power cylinder may exceed the pressure in the compression cylinder (due to and during initial combustion state), therefore helping to push the DSAP valve farther, in the same direction of movement, and seal the SDCOC crossover valve by placing the DSAP valve on the opposite valve seat sealing surfaces, i.e., on the surface of the compression cylinder wall or compression cylinder head (Close 2 position). In some exemplary embodiments, a bias mechanism may add additional forces acting toward close 2 position. As an example for such a bias mechanism, rocker arm 17 may also serve as a flexible biasing device, adding predetermined adequate preload forces and thus helping valve 120 to seal against sealing surface 122. In some exemplary embodiments, combustion occur while the DSAP valve is moving from close 1 position to close 2 position.

In further exemplary embodiments, at the beginning of the engine's exhaust stroke, as the exhaust valve opens, the power cylinder pressure decreases sharply. Consequently, the force acting to keep the DSAP valve at Close 2 position may decrease as well. Following the beginning of the engine's exhaust stroke, the cam controlled mechanical actuation mechanism may act (enable) to move back (reset) the DSAP valve to its initial sealing surfaces, i.e., the one closer to the power cylinder (Close 1 position). At this stage of the cycle, the compression piston may be at or around a predetermined range close to its BDC or beginning of compression. This transition from Close 2 via an open position to Close 1 position could be timed to occur when the exhaust pressure is slightly higher or equal to the compression cylinder pressure, and therefore, no significant mass of working fluid is expected to pass via the crossover valve when it's open during this reset phase. In addition, if needed, a check valve would be added in serial to the SDCOC crossover valve to prevent exhausted working fluid transfer from the power cylinder to the compression cylinder during this open period.

In one exemplary embodiment, the intake valve is composed of a shaft having a conic shaped sealing surface, the same as being used in the intake valves in most four stroke engines. The exhaust valve may be composed of a shaft having a conic shaped sealing surface, as is commonly known in the art. In one embodiment the crossover valve includes a double sided axial (conic shape) poppet valve, (DSAP valve), with each of the sealing surfaces, which reside on a corresponding valve seat, seals off a common fluid passage and hence decouples the two cylinders.

In further exemplary embodiments the crossover valve includes a push (or pull) to open biasing mechanism and a push (or pull) to close biasing mechanism, including, for example, push pull rods. One example of a biasing mechanism is a spring. Another example is a camshaft based actuation component. Other biasing mechanism could be used without deviating from the scope of the present disclosure.

In some exemplary embodiments, an interstage valve may be constructed of several components: First, a valve body. Second, a Double-Sided-Axial-Poppet (DSAP) valve capable of decoupling the two chambers by sealing the interstage valve on either side. More specifically, a first closed position with the DSAP valve sealing by its placement on the valve seat located on the surface of the power cylinder wall or power cylinder head, an open position in which the DSAP valve is not placed on any valve seat on any cylinder wall or cylinder head (and working fluid can pass from the compression cylinder to the power cylinder through the opening around the DSAP valve), and a second closed position with the DSAP valve sealing by its placement on the valve seat located on the surface of the compression cylinder wall or compression cylinder head. Third, a Spring-Plunger Component (SPC), consisting of a disc spring in some embodiments, but can be any biasing element. Fourth, an additional Bias Mechanism Component (BMC) biasing the DSAP valve to close on the power cylinder wall or power cylinder head. Other embodiments may include one or more of the above components, in addition to other features, as described herein.

In further exemplary embodiments, when the power piston moves toward its top-dead-center, the DSAP valve component seals on the power-cylinder side due to the action of BMC and the pressure builds-up in the compression cylinder.

In further exemplary embodiments, when the power piston approaches or reaches top-dead-center, it creates contact with the plunger component of the SPC and pushes the plunger. This push compresses the spring component of the SPC, which preloads the spring.

In further exemplary embodiments, after compressing the spring component of the SPC, and still before the power piston reaches top-dead-center, the power piston reaches and pushes the DSAP valve, forcing the interstage valve to open. The interstage valve initial opening reduces pressure differential between the two cylinders therefore diminishing most of the compression force that kept the interstage valve in close position. This pressure leveling enables the spring-plunger (SPC) to expand and farther push the DSAP valve, which shifts the interstage valve toward a more open state.

In further exemplary embodiments, the interstage valve closes when the pressure in the power cylinder exceeds the pressure in the compression cylinder (due to and during initial combustion state), therefore pushing the DSAP valve farther, in the same direction of movement, and sealing the interstage valve by placing the DSAP valve on the opposite valve seat sealing surfaces, i.e., on the surface of the compression cylinder wall or compression cylinder head.

In further exemplary embodiments, at the beginning of the engine's exhaust stroke, as the exhaust valve opens, the power cylinder pressure decreases sharply. Consequently, the preloaded BMC pushes the DSAP valve to move back to its initial sealing surfaces, i.e., the one closer to the power cylinder. In some embodiments, the closing of the interstage valve to its initial close position may be assisted by a mechanical bias.

In one exemplary embodiment, the intake valve is composed of a shaft having a conic shaped sealing surface, similar to conventional intake valves in known four stroke engines. The exhaust valve is composed of a shaft having a conic shaped sealing surface, as is commonly known in the art. In one embodiment the interstage valve includes a double sided axial (conic shape) poppet valve (DSAP valve), where each of the sealing surfaces—when resides on its corresponded valve seat—seals off a common fluid passage and hence decouples the two cylinders.

In further exemplary embodiments the interstage valve includes a push to open biasing mechanism and a push to close biasing mechanism. One group of biasing mechanism, for example, is the group of various spring components.

In some exemplary embodiments, a method of improving combustion engine efficiency includes separating the intake and compression chamber (cool strokes) from the combustion and exhaust chamber (hot strokes), and thus enabling reduced temperature during intake and compression strokes and increased temperature during the combustion stroke, thereby increasing engine efficiency.

In some exemplary embodiments, a method of improving engine efficiency includes minimizing or reducing the temperature during intake and compression strokes. The lower the incoming and compressed air/charge temperature is, the higher the engine efficiency will be.

In some exemplary embodiments, a method of improving engine efficiency includes insulating and thermally enforcing the power piston and cylinder to operate under higher temperatures.

In some exemplary embodiments, a method of improving engine efficiency includes external isolating of the power cylinder.

In some exemplary embodiments, a DPCE engine is provided that greatly reduces external cooling requirements, which increases the potential heat available for heat output work conversion during the power stroke. Thus, fuel is burned more efficiently, thereby increasing overall efficiency and decreasing harmful emissions.

In some exemplary embodiments, a method of providing an improved efficiency combustion engine includes performing the intake and compression but not the exhaust strokes in a first cylinder and performing the power and exhaust strokes but not the intake strokes in a second cylinder, wherein the first cylinder is maintained at a cooler temperature than the second cylinder.

In some exemplary embodiments, a method of providing a more efficient internal combustion engine includes performing the intake and compression strokes, but not the exhaust stroke, in a first cylinder and performing the power and exhaust strokes, but not the intake stroke, in a second cylinder, wherein the first cylinder volume is smaller than the second cylinder volume. Such exemplary embodiments have an expansion ratio that is larger than the compression ratio, similar to an Atkinson or Miller cycle but having compression and expansion occurring in dedicated cylinders and not at the same cylinder as in conventional 4-stroke engines that impose a compromise between an optimal compression and an optimal expansion. Disparate cylinder volumes provide for additional energy conversion in the combustion chamber.

(Note: the following exemplary embodiments are referred to as first, second, etc. The hierarchy is for cross-referencing purposes and should not be construed to alter any of the previously described exemplary embodiments, or construed to imply a preferential embodiment or embodiments.)

In a first embodiment, an internal combustion engine comprises: a combustion chamber with a first aperture; a compression chamber with a second aperture; and a crossover valve comprising an internal chamber, first and second valve seats, a valve head, and first and second valve faces on the valve head, wherein the first aperture allows fluid communication between the combustion chamber and the internal chamber, the second aperture allows fluid communication between the compression chamber and the internal chamber, the first valve face couples to the first valve seat to occlude the first aperture, and the second valve face couples to the second valve seat to occlude the second aperture.

In a second embodiment, the engine of the first embodiment, wherein the valve head moves within the internal chamber so that the crossover valve alternatively occludes the first aperture and the second aperture.

In a third embodiment, the engine of the second embodiment, wherein the crossover valve head is smaller than the internal chamber in at least one dimension to allow fluid communication between the compression chamber and combustion chamber when the valve head is positioned within the internal chamber and does not occlude the first aperture and the second aperture.

In a fourth embodiment, the engine of any of the first through third embodiments, further comprising a bias that provides a force to assist the valve head move within the internal chamber in the direction of both the first and the second apertures.

In a fifth embodiment, the engine of the fourth embodiment, wherein the bias further comprises a camshaft, a camshaft follower, a rocker, a return spring, and a push rod.

In a sixth embodiment, the engine of any of the first through fifth embodiments, wherein the combustion chamber comprises a piston and the piston comprises a protrusion on a piston head, wherein the protrusion is configured to partially occupy the first aperture.

In a seventh embodiment, the engine of any of the first through sixth embodiments, wherein the compression chamber comprises a piston and the piston comprises a protrusion on a piston head, wherein the protrusion is configured to partially occupy the second aperture.

In an eight embodiment, the engine of any of the first through seventh embodiments, further comprising a differential pressure equalizer valve that couples the combustion chamber with the internal chamber of the crossover valve.

In a ninth embodiment, the engine of the eight embodiment, wherein the differential pressure equalizer valve comprises a differential pressure equalizer valve head with a smaller surface area than a surface area of the crossover valve head.

In a tenth embodiment, the engine of any of the first through ninth embodiments, wherein the valve head comprises at least one aperture configured to mate with a first at least one occlusion and a second at least one occlusion at the first and second apertures, respectively.

In an eleventh embodiment, the engine of the tenth embodiment, wherein the valve head comprises one selected from the group consisting of a square plate configuration and a concentric plate configuration.

In a twelfth embodiment, the engine of any of the first through eleventh embodiments, wherein the compression chamber and combustion chamber are thermally isolated from one another.

In a thirteenth embodiment, the engine of any of the first through twelfth embodiments, wherein the combustion chamber is thermally isolated from the surrounding environment such that the combustion chamber is maintained at a hotter temperature than the surrounding environment during operation.

In a fourteenth embodiment, the engine of any of the first through thirteenth embodiments, wherein the compression chamber comprises a plurality of air cooling ribs located on an external surface of the compression chamber.

In a fifteenth embodiment, the engine of any of the first through fourteenth embodiments, wherein the compression chamber comprises a plurality of liquid cooling passages within its housing.

In a sixteenth embodiment, the engine of any of the first through fifteenth embodiments wherein the combustion chamber comprises a plurality of exhaust heating passages for utilizing heat provided by exhaust gases expelled by the combustion chamber to further heat the combustion chamber.

In a seventeenth embodiment, the engine of any of the first through sixteenth embodiments, wherein the crossover valve further comprises a first contact element that is moveable relative to the valve head; a second contact element that is fixed relative to the valve head; a first bias comprising two ends, wherein one end is coupled to the valve body and the other end is coupled to the valve head; and a second bias comprising two ends, wherein one end is coupled to the valve head and the other end is coupled to the first contact element.

In an eighteenth embodiment, the engine of the seventeenth embodiment, wherein a boundary of the combustion chamber comprises a combustion piston that releasably contacts the first and second contact elements during a thermodynamic cycle of the engine, wherein the combustion piston, first contact element, and second contact element are arranged so that the combustion piston contacts the first contact element prior to contacting the second contact element.

In a nineteenth embodiment, the engine of the eighteenth embodiment, wherein the combustion piston and second contact element are arranged so that the first valve head unseats from the first valve seat when the combustion piston contacts the second contact element.

In a twentieth embodiment, the engine of any of the seventeenth through nineteenth embodiments, further comprising at least one selected from the group consisting of a compression chamber pressure relief valve and a combustion chamber pressure relief valve, wherein the compression chamber pressure relief valve and the combustion chamber pressure relief valve are distinct from the crossover valve, the compression chamber pressure relief valve allows fluid communication between the compression and combustion chambers when a pressure within the compression chamber exceeds a first predetermined value, and the combustion chamber pressure relief valve allows fluid communication between the combustion and compression chambers when a pressure within the combustion chamber exceeds a second predetermined value.

In a twenty-first embodiment, the engine of any of the first through twentieth embodiments, wherein the crossover valve further comprises: a contact element that is moveable relative to the valve head; a first bias comprising two ends, wherein one end is coupled to the valve body and the other end is coupled to the valve head; a second bias comprising two ends, wherein one end is coupled to the valve head and the other end is coupled to the contact element, wherein a first distance between the first valve face and the second valve face is greater than a second distance between the first valve seat and the second valve seat, wherein the first and second distances are measured in a direction of motion of a combustion piston that forms a boundary of the combustion chamber.

In a twenty-second embodiment, the engine of the twenty-first embodiment, wherein the combustion piston releasably contacts the contact element during a thermodynamic cycle of the engine.

In a twenty-third embodiment, the engine of the twenty-second embodiment, wherein the combustion piston includes a protrusion for releasably contacting the contact element.

In a twenty-fourth embodiment, the engine of any of the first through twenty-third embodiments, wherein the combustion chamber and compression are oriented substantially parallel and side-by-side.

In a twenty-fifth embodiment, the engine of the twenty-fourth embodiment, wherein the crossover valve further comprises a first contact element that is moveable relative to the valve head; a second contact element that is fixed relative to the valve head; a first bias comprising two ends, wherein one end is coupled to the valve body and the other end is coupled to the valve head; and a second bias comprising two ends, wherein one end is coupled to the valve head and the other end is coupled to the first contact element.

In a twenty-sixth embodiment, the engine of the twenty-fifth embodiment, wherein the compression piston moves the first and second contact elements in a direction perpendicular to the compression piston's direction of motion.

In a twenty-seventh embodiment, the engine of any of the first through twenty-sixth embodiments, wherein the compression chamber comprises a third aperture, and the engine further comprises: a second combustion chamber comprising a fourth aperture; and a second crossover valve comprising a second internal chamber, third and fourth valve seats, a second valve head, and third and fourth valve faces on the second valve head, wherein the third aperture allows fluid communication between the compression chamber and the second internal chamber, the fourth aperture allows fluid communication between the second combustion chamber and the second internal chamber, the third valve face couples to the third valve seat to occlude the third aperture, and the fourth valve face couples to the fourth valve seat to occlude the fourth aperture.

In a twenty-eight embodiment, the engine of the twenty-seventh embodiment, further comprising pistons associated with each of the compression chamber, combustion chamber, and second combustion chamber, wherein each piston is connected to a respective crankshaft, wherein each of the respective crankshafts is connected to a respective gear, and wherein the gear associated with the compression chamber is coupled to the gears associated with each of the combustion chamber and second combustion chamber.

In a twenty-ninth embodiment, the engine of the twenty-eight embodiment, wherein the gear associated with the compression chamber has half the number of teeth as each of the gears associated with the combustion chamber and the second combustion chamber.

In a thirtieth embodiment, the engine of any of the first through twenty-ninth embodiments, wherein a boundary of the compression chamber is formed by surfaces of a compression cylinder and a compression piston therein, wherein a boundary of the combustion chamber is formed by surfaces of a combustion cylinder and a combustion piston therein, wherein the combustion cylinder includes a third piston coupled to the combustion piston, wherein the third piston utilizes heat energy generated by the combustion piston to perform power strokes.

In a thirty-first embodiment, the engine of the thirtieth embodiment, wherein the combustion piston comprises a disc-shaped inner combustion piston comprising a lateral cylindrical surface and forming a first internal chamber within the combustion cylinder; and the third piston comprises a ring-shaped outer power piston surrounding the lateral cylindrical surface of the combustion piston and forming a second internal chamber within the combustion cylinder, wherein the second internal chamber at least partially surrounds the first internal chamber.

In a thirty-second embodiment, an internal combustion engine comprises: a combustion chamber with a first aperture; a compression chamber with a second aperture; and a crossover valve comprising an internal chamber, a valve head, a first closed position, and a second closed position, wherein the first closed position occludes the first aperture and the second closed position occludes the second aperture, the valve head moves in one direction within the internal chamber from the first closed position to the second closed position, the valve head moves in one direction within the internal chamber from the second closed position to the first closed position, the first aperture allows fluid communication between the combustion chamber and the internal chamber, and the second aperture allows fluid communication between the compression chamber and the internal chamber.

In a thirty-third embodiment, the engine of the thirty-second embodiment, wherein the crossover valve head is smaller than the internal chamber in at least one dimension to allow fluid communication between the compression chamber and combustion chamber when the crossover valve is not in the first closed position and second closed position.

In a thirty-fourth embodiment, the engine of any of the thirty-second and thirty-third embodiments, further comprising a bias that provides a force to assist the valve head move within the internal chamber in the direction of both the first and the second closed positions.

In a thirty-fifth embodiment, the engine of the thirty-fourth embodiment, wherein the bias further comprises a camshaft, a camshaft follower, a rocker, a return spring, and a push rod.

In a thirty-sixth embodiment, the engine of any of the thirty-second through thirty-fifth embodiments, wherein the valve head comprises at least one aperture configured to mate with a first at least one occlusion and a second at least one occlusion at the first and second closed positions, respectively.

In a thirty-seventh embodiment, the engine of the thirty-sixth embodiment, wherein the valve head comprises one selected from the group consisting of a square plate configuration and a concentric plate configuration.

In a thirty-eight embodiment, the engine of any of the thirty-second through thirty-seventh embodiments, wherein the compression chamber and combustion chamber are thermally isolated from one another.

In a thirty-ninth embodiment, the engine of any of the thirty-second through thirty-eight embodiments, wherein the crossover valve further comprises a first contact element that is moveable relative to the valve head; a second contact element that is fixed relative to the valve head; a first bias comprising two ends, wherein one end is coupled to the valve body and the other end is coupled to the valve head; and a second bias comprising two ends, wherein one end is coupled to the valve head and the other end is coupled to the first contact element.

In a fortieth embodiment, the engine of the thirty-ninth embodiment, wherein a boundary of the combustion chamber comprises a combustion piston that releasably contacts the first and second contact elements during a thermodynamic cycle of the engine, wherein the combustion piston, first contact element, and second contact element are arranged so that the combustion piston contacts the first contact element prior to contacting the second contact element.

In a forty-first embodiment, the engine of the fortieth embodiment, wherein the combustion piston and second contact element are arranged so that the first valve head leaves the first closed position when the combustion piston contacts the second contact element.

In a forty-second embodiment, a method of operating an internal combustion engine, wherein the engine comprises a combustion piston, a compression cylinder, a compression piston, a combustion cylinder, and a crossover valve between the compression and combustion cylinders, wherein the crossover valve has a first closed position and a second closed position, wherein the combustion piston and combustion cylinder define a combustion chamber, and wherein the compression piston and compression cylinder define a compression chamber, the method comprising: placing the crossover valve in a first closed position at a time when an exhaust valve in the combustion chamber opens, wherein the crossover valve is in the first closed position if the valve prevents fluid communication between the combustion cylinder and an internal chamber of the crossover valve; maintaining the crossover valve in the first closed position until the combustion piston reaches at least top-dead center; placing the crossover valve in an open position at a time when the combustion piston moves away from top-dead center, wherein the crossover valve is in an open position when the valve allows fluid communication between the combustion cylinder and the compression cylinder; placing the crossover valve in a second closed position at a time when the compression piston is at top-dead center, wherein the crossover valve is in the second closed position when the valve prevents fluid communication between the compression cylinder and an internal chamber of the valve; and placing the crossover valve in a reset position at a time when an intake valve in the compression chamber closes, wherein the crossover valve is in the reset position when the valve prevents fluid communication between the combustion chamber and the internal chamber of the crossover valve and fluid communication between the compression chamber and the internal chamber of the crossover valve.

BRIEF DESCRIPTION OF THE DRAWINGS

FIG. 14A is a simplified cross-sectional illustration showing crossover valve operation in accordance with various exemplary embodiments of the present invention. FIG. 14B is a simplified cross-sectional illustration showing crossover valve operation in accordance with various exemplary embodiments of the present invention. FIG. 14C is a simplified cross-sectional illustration showing crossover valve operation in accordance with various exemplary embodiments of the present invention.

FIG. 15A is a simplified cross-sectional side view of a DPCE apparatus, with a crossover valve differential pressure equalizer.

FIG. 15B is a simplified cross-sectional side view of a DPCE apparatus, with a crossover valve differential pressure equalizer.

FIG. 17A is a simplified cross-sectional illustration showing crossover valve operation in accordance with various exemplary embodiments of the present invention. FIG. 17B is a simplified cross-sectional illustration showing crossover valve operation in accordance with various exemplary embodiments of the present invention. FIG. 17C is a simplified cross-sectional illustration showing crossover valve operation in accordance with various exemplary embodiments of the present invention.

FIG. 18A is a simplified 3D cross-sectional illustration showing Parallel Square Plate valve (PSP valve). FIG. 18B is a simplified 3D cross-sectional illustration showing a PSP valve. FIG. 18C is a simplified 3D cross-sectional illustration showing a PSP valve.

FIG. 19A is a simplified 3D cross-sectional illustration showing a Parallel Concentric Plate valve (PCP valve). FIG. 19B is a simplified 3D cross-sectional illustration showing a PCP valve. FIG. 19C is a simplified 3D cross-sectional illustration showing a PCP valve.

FIG. 20A-20E. FIG. 20A is a simplified cross-sectional illustration showing crossover valve operation in accordance with various exemplary embodiments of the present invention. FIG. 20B is a simplified cross-sectional illustration showing crossover valve operation in accordance with various exemplary embodiments of the present invention. FIG. 20C is a simplified cross-sectional illustration showing crossover valve operation in accordance with various exemplary embodiments of the present invention. FIG. 20D is a simplified cross-sectional illustration showing crossover valve operation in accordance with various exemplary embodiments of the present invention. FIG. 20E is a simplified cross-sectional illustration showing crossover valve operation in accordance with various exemplary embodiments of the present invention.

FIG. 38A is a simplified Three-Dimensional (3D) and 3D partial cross-sectional illustration showing interstage valve operation in accordance with various exemplary embodiments of the present invention. FIG. 38B is a simplified 3D cut-away illustration showing interstage valve operation in accordance with various exemplary embodiments of the present invention. FIG. 38C is a simplified 3D cut-away illustration showing interstage valve operation in accordance with various exemplary embodiments of the present invention. FIG. 38D is a simplified 3D cut-away illustration showing interstage valve operation in accordance with various exemplary embodiments of the present invention.

FIG. 39A is a simplified cross-sectional illustration of an interstage-valve in accordance with exemplary embodiments. FIG. 39N is a simplified cross-sectional illustration of an interstage-valve in accordance with exemplary embodiments.

FIG. 42A is a simplified cross-sectional illustration of a mechanical interstage valve positioned perpendicular to cylinder motion line of a DPCE apparatus in which both cylinders are parallel to each other and both pistons move in a tandem manner, in accordance with exemplary embodiments of the invention. FIG. 42B is another simplified cross-sectional illustration of the mechanical interstage valve of FIG. 42A. FIG. 42C is another simplified cross-sectional illustration of the mechanical interstage valve of FIG. 42A. FIG. 42D is another simplified cross-sectional illustration of the mechanical interstage valve of FIG. 42A. FIG. 42E is another simplified cross-sectional illustration of the mechanical interstage valve of FIG. 42A. FIG. 42F is another simplified cross-sectional illustration of the mechanical interstage valve of FIG. 42A. FIG. 42G is another simplified cross-sectional illustration of the mechanical interstage valve of FIG. 42A. FIG. 42H is another simplified cross-sectional illustration of the mechanical interstage valve of FIG. 42A.

DETAILED DESCRIPTION OF EXEMPLARY EMBODIMENTS

The invention is described in detail below with reference to the figures, wherein similar elements are referenced with similar numerals throughout. It is understood that the figures are not necessarily drawn to scale. Nor do they necessarily show all the details of the various exemplary embodiments illustrated. Rather, they merely show certain features and elements to provide an enabling description of the exemplary embodiments of the invention.

Figure 1:
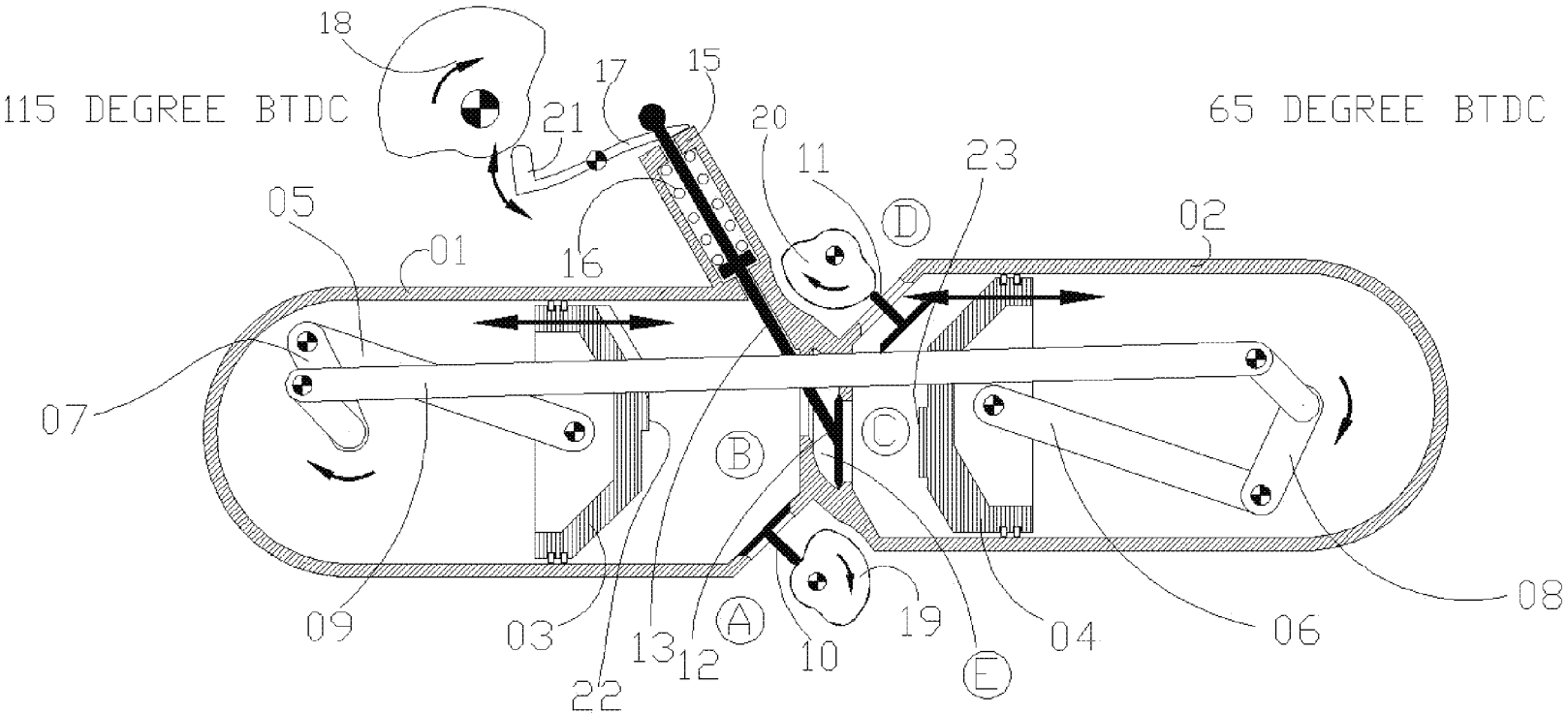
FIG. 1 is a simplified cross-sectional side view of a DPCE apparatus, in accordance with exemplary embodiments of the present invention, wherein the compression crankshaft angle is illustrated at 115 degrees before the compression piston reaches its Top Dead Center (TDC) and the power crankshaft angle is illustrated at 65 degrees before the power piston reaches its TDC.
Figure 2:
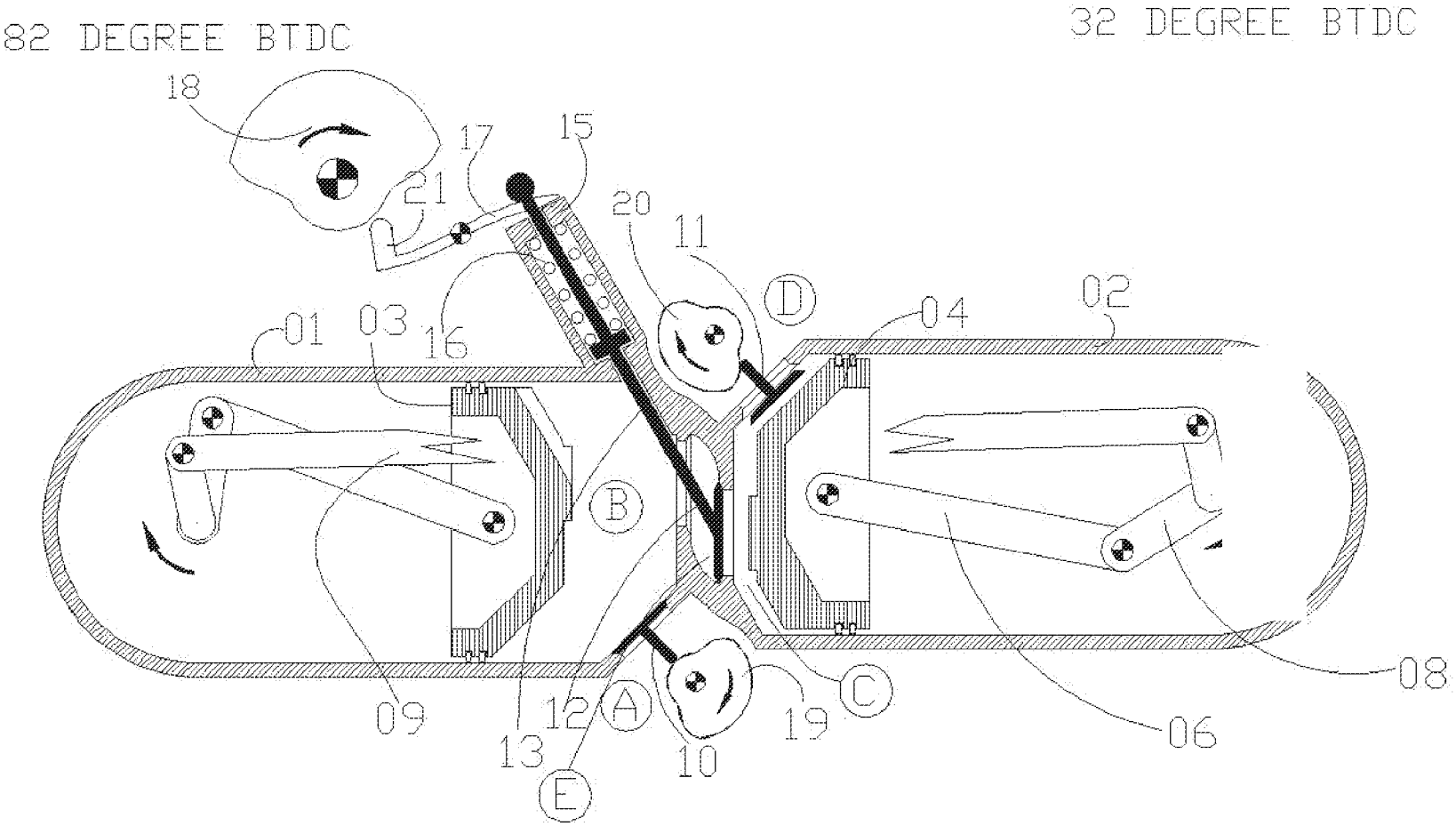
FIG. 2 is a simplified cross-sectional side view of the DPCE apparatus of FIG. 1, wherein the compression crankshaft angle is illustrated at 82 degrees before its TDC and the power crankshaft angle is illustrated at 32 degrees before the power piston reaches its TDC.
Figure 3:
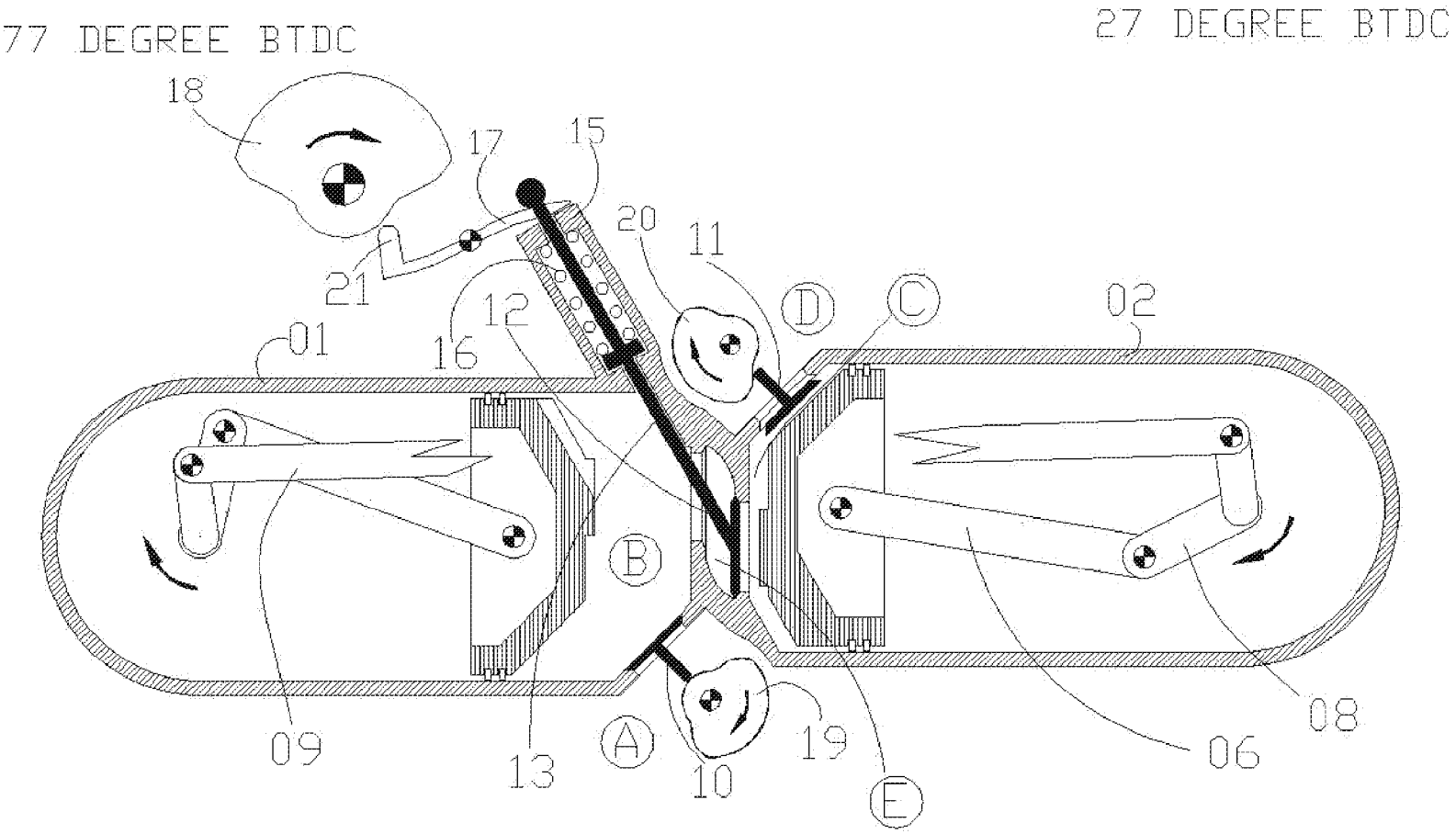
FIG. 3 is a simplified cross-sectional side view of the DPCE apparatus of FIG. 1, wherein the compression crankshaft angle is illustrated at 77 degrees before its TDC, and the power crankshaft angle is illustrated at 27 degrees before the power piston reaches its TDC.
Figure 4:
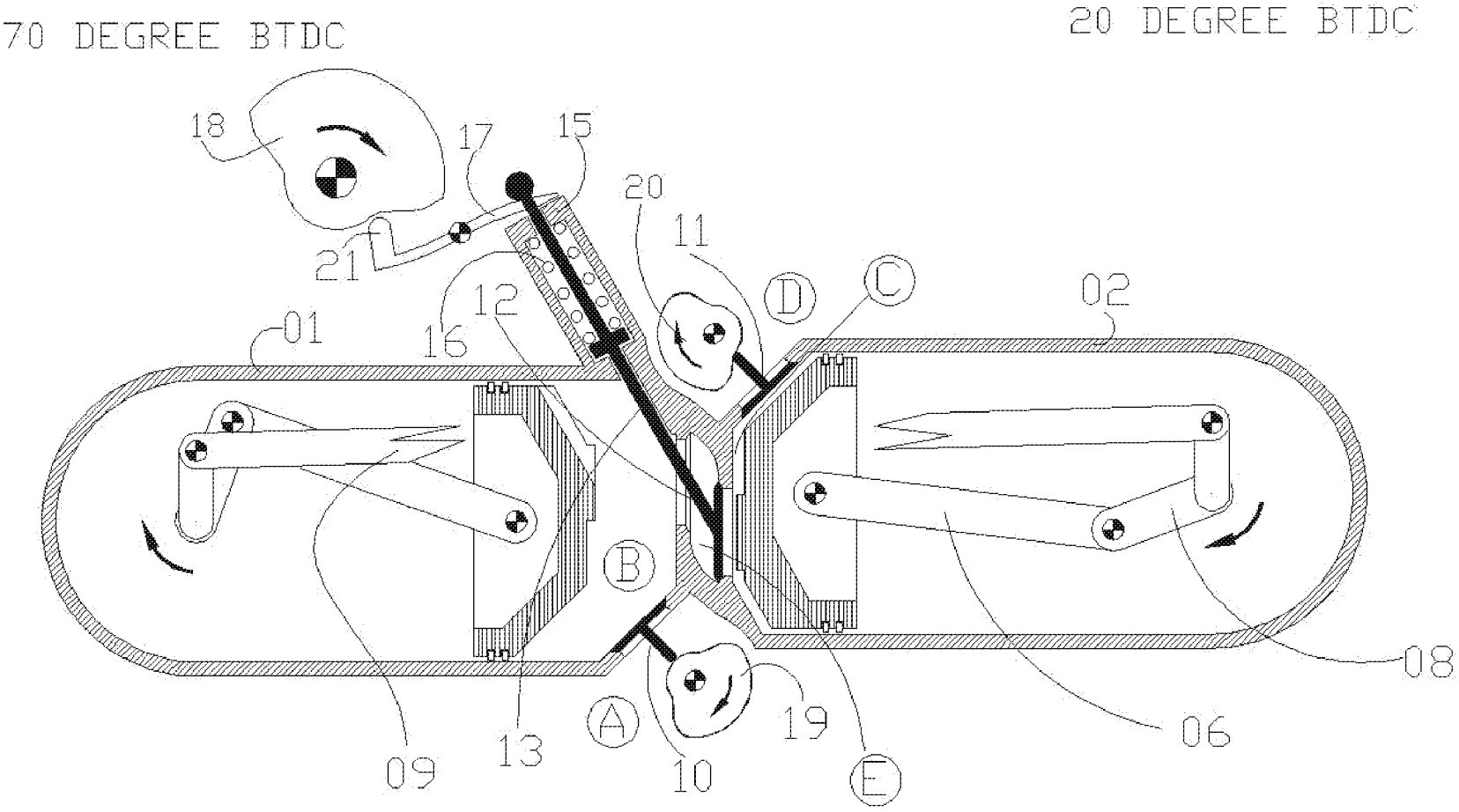
FIG. 4 is a simplified cross-sectional side view of the DPCE apparatus of FIG. 1, wherein the compression crankshaft angle is illustrated at 70 degrees before its TDC, and the power crankshaft angle is illustrated at 20 degrees before the power piston reaches its TDC.

Referring to FIG. 1, in accordance with one embodiment of the present invention, a DPCE cylinder includes: a compression cylinder 01, a power cylinder 02, a compression piston 03, a power piston 04, two respective piston connecting rods 05 and 06, a compression crankshaft 07, a power crankshaft 08, a crankshaft connecting rod 09, an intake valve 10 that is operated by camshaft 19, an exhaust valve 11 that is operated by camshaft 20 and an crossover valve 12 that is operated by camshaft 18 via cam follower 21, rocker 17, and push/pull rod 13. Crossover valve return spring 16 is housed in crossover valve return spring housing. The compression cylinder 01 is a piston engine cylinder that houses the compression piston 03, the intake valve 10, part of the crossover valve 12 and optionally a spark plug (not shown) located in front of the surface of compression piston 03 facing the compression chamber in cylinder 01. The power cylinder 02 is a piston engine cylinder that houses the power piston 04, the exhaust valve 11, part of the crossover valve 12 and optionally a spark plug (not shown) located in front of the surface of the power piston facing the combustion chamber in cylinder 02. The compression piston 03 serves the intake and the compression engine strokes. The power piston 04 serves the power and the exhaust strokes. The connecting rods 05 and 06 connect their respective pistons to their respective crankshafts. The compression crankshaft 07 converts rotational motion into compression piston 03 reciprocating motion. The reciprocating motion of the power piston 04 is converted into rotational motion of the power crankshaft 08, which is converted to engine rotational motion or work (e.g., the power crankshaft may also serve as the DPCE output shaft). The crankshaft connecting rod 09 translates the rotation of power crankshaft 08 into rotation of the compression crankshaft 07. Both compression piston 03 and power piston 04 may have or may not have irregular structure or protrusion 22 and 23, respectively. The function of these protrusions may be to decrease the dead space.

In exemplary embodiments, predetermined phase delay is introduced via the crankshafts 07 and 08, such that power piston 04 moves in advance of compression piston 03.

In exemplary embodiments of the present invention, the intake valve 10 is composed of a shaft having a conic shaped sealing surface, as is commonly known in the art. The intake valve 10, located on the compression cylinder 01, governs the naturally aspirated ambient air or the carbureted air/fuel charge, or forced induction of the charge, as they flow into the compression cylinder 01. The compression cylinder 01 has at least one intake valve. In some embodiments of the present invention, the intake valve location, relative to the position of compression piston 03, function, and operation may be similar or identical to the intake valves of conventional four-stroke internal combustion engines. The location of the compression piston 03 when the intake valve opens and/or closes may vary. In some embodiments of the present invention, the timing of the opening and/or closing of the intake valve may vary. In one example, the intake valve may open within the range of a few crankshaft degrees before the compression piston 03 reaches its TDC through approximately 50 crankshaft degrees after the compression piston 03 reaches its TDC. In one example, the intake valve may close within the range of a few crankshaft degrees after the compression piston 03 reaches its Bottom Dead Center (BDC) through approximately 70 crankshaft degrees after the compression piston 03 reaches its BDC.

In one embodiment, the intake valve may open within a starting when compression piston 03 reaches its TDC through approximately 10 crankshaft degrees after the compression piston 03 reaches its TDC, and after the closing on crossover valve 12. At BDC, which is the end of the intake stroke, working fluid continues to enter the cylinder cases due to the dynamic flow characteristics. For this reason it is may be advantageous to close the intake valve after the compression piston BDC. In one embodiment, the intake valve may close within the range of a few crankshaft degrees before the compression piston 03 reaches its BDC through approximately 70 crankshaft degrees after the compression piston 03 reaches its BDC. In one example, the intake valve may close within a narrower range starting when compression piston 03 reaches its BDC through approximately 50 crankshaft degrees after the compression piston 03 reaches its TDC, and after the closing on crossover valve 12.

In exemplary embodiments of the present invention, the exhaust valve 11 is composed of a shaft having a conic shaped sealing surface, as is commonly known in the art. The exhaust valve 11, located on the power cylinder 02 governs the exhalation of burned gases. The power cylinder 02 has at least one exhaust valve. In some embodiments, the exhaust valve location, functions and operation method may be similar or identical to exhaust valves of conventional four-stroke internal combustion engines. The location of the power piston 04 when the exhaust valve opens may vary. In some embodiments, the exhaust valve may open approximately 60 crankshaft degrees before power piston 04 reaches its BDC through approximately 20 crankshaft degrees after power piston 04 reaches its BDC. The location of the power piston 04 when the exhaust valve closes may also vary. In some embodiments, the exhaust valve may close approximately 15 crankshaft degrees before power piston 04 reaches its TDC through approximately 5 crankshaft degrees after power piston 04 reaches its TDC In one embodiment, the exhaust valve may open within a range starting when power piston 04 reaches its BDC through approximately 30 crankshaft degrees after the power piston 04 reaches its BDC. In one embodiment, the exhaust valve may close within a narrower preferred range starting 5 degrees before power piston 04 reaches its TDC through approximately when power piston 04 reaches its TDC.

In one embodiment, the crossover valve 12 is composed of the following components. First, a valve body. Second, a Double-Sided-Axial-Poppet (DSAP) valve capable of decoupling the two chambers by sealing the SDCOC crossover valve on either side. More specifically, a first closed position (Close 1) with the DSAP valve sealing by its placement on the valve seat located on the surface of the power cylinder wall or power cylinder head, an open position (Charge transfer) in which the DSAP valve is not placed on any valve seat on any cylinder wall or cylinder head, and working fluid can pass from the compression cylinder to the power cylinder through the opening around the DSAP valve, and a second closed position (Close 2) with the DSAP valve sealing by its placement on the valve seat located on the surface of the compression cylinder wall or compression cylinder head. Third, a DSAP actuation push pull rod, which in one exemplary embodiment is an integral metal part of the DSAP. Fourth, a valve reset spring. Fifth, a rocker arm. Sixth, a cam follower/lifter. Seventh, a dedicated SDCOC crossover valve cam.

In some embodiments, the working fluid may pass through the DSAP (in addition to, or instead of, moving around it) when the DSAP is not located on a valve seat.

Referring to FIGS. 1-13, when the power piston moves towards its TDC, the DSAP valve is sealed on its power-cylinder side due to the SDCOC crossover valve cam setting (position) and the valve reset spring force, as well as the pressure build-up in the compression cylinder. When the power piston approaches TDC, the exhaust valve closes, and the SDCOC crossover valve opens. This is done via the cam rotational movement (new position) that pushes the cam follower and the rocker arm, which in turn pulls the valve actuation rod and lifts the DSAP component from its valve seat (Close 1 position) and opens it. The SDCOC crossover valve initial opening reduces pressure differential between the two cylinders, therefore diminishing most of the compression force that helped keep the SDCOC crossover valve in close position. This pressure leveling decreases the force required to continue and open the SDCOC crossover valve and transition it from Close 1 position via the open position to the Close 2 position. In addition, this is also when the pressure in the power cylinder exceeds the pressure in the compression cylinder (due to and during initial combustion state), therefore helping to push the DSAP valve farther, in the same direction of movement, and seal the SDCOC crossover valve by placing the DSAP valve on the opposite valve seat sealing surfaces, i.e., on the surface of the compression cylinder wall or compression cylinder head (Close 2 position). During the beginning of the engine's exhaust stroke, as the exhaust valve opens, the power cylinder pressure decreases sharply. Consequently, the force acting to keep the DSAP valve at Close 2 position decreases as well. Following the beginning of the engine's exhaust stroke, the cam controlled mechanical actuation mechanism acts to move back the DSAP valve from its sealing seat on the compression cylinder (Close 2 position) to its initial sealing surfaces, i.e., the one closer to the power cylinder (Close 1 position). At this stage of the cycle, the compression piston is at or around its BDC or beginning of compression. This transition from Close 2 via an open position to Close 1 position could be timed to occur when the pressures at the two cylinders are almost equal, and therefore, no significant mass of working fluid is expected to pass via the crossover valve when its open during this reset phase. In addition a check valve may be added in serial to the SDCOC crossover valve to prevent working fluid transfer during this open period.

Exemplary embodiments of a single (see FIGS. 1-19) or double (see FIGS. 20A-E) crossover valve may provide many benefits to split-cycle engine designs, including the DPCE split cycle engine if it (they) provides the following characteristics: As a first advantage, the valve may be sufficiently wide that it does not restrict charger transfer (not a bottle neck), yet sufficiently narrow in profile that it does not act as a compartment that holds "dead volume" or "crevice volume". Such dead volumes known in the art, in some cases as a "connecting tube," or dead volume within the compression cylinder, which hold a fraction of the working fluid and prevent that fraction from participating in the currently executed combustion/expansion process. Other dead volumes, again at the connecting tube or the combustion cylinder, cause decompression of the working fluid before combustion, thus reducing efficiency.

The size of the valves described herein will depend on each engine design and on the RPM in which the valve (s) operates. In some embodiments, a valve with an area of about 0.2 $cm^2$ (area) (which may be an orifice with a diameter of 1.6 cm) may be used for an engine design at 3000 RPM, for each 100 cmx3 working fluid (volume).

As a second advantage, exemplary embodiments may include a plate type valve that increases valve-seat peripheries and reduces required lift range when compared to common poppet valve types. The effective valve area may, in some embodiments, be understood as the product of the element lift and the sum of the valve-seat peripheries (or transfer opening passage edges) less the guide and end contacting surfaces. As used here, a valve seat periphery may be understood to refer to a length of a circumference of a valve.

As a third advantage, exemplary embodiments may address major shortcoming of prior art split-cycle engines: they may avoid a connecting tube or intermediate combustion chamber and directly couple the two cylinders while preserving an integrated cycle, in which the working fluid that is inducted and compressed, is combusted immediately as part of a single cycle. In this respect, some exemplary embodiments may continue to compress the working fluid, while transferring it from chamber B to chamber C (while crossover valve 12 is open), as long as the reduction in chamber B volume (while compression piston 03 moves to its TDC) is larger than the increase in chamber C volume (while power piston 04 moves away from its TDC). Continuing to compress the working fluid while transferring from chamber B to chamber C may shift the point where the working fluid maximum compression is reached (the point where the sum of the volume of chambers B, E and C is the lowest: "minimal volume") to after power piston TDC. Some exemplary embodiments may have the point of maximum compression by 3-30 degrees after power piston TDC.

As a fourth advantage, exemplary embodiments may have combustion initiated and developed while transferring the working fluid from chamber B to chamber C (while crossover valve 12 is open, including other crossover valve types, for example but not limited to, those depicted in FIGS. 1-20). Having combustion initiated and developed with an open crossover valve enables timing of combustion initiation to the point of maximum compression, thus increasing engine efficiency. By doing so, embodiments disclosed herein may very closely, with little to no delay, imitate the conventional IC engine Otto cycle, but using a split cycle platform. By doing so, exemplary embodiments offer substantial benefits, for example the decoupling of the compression ratio from the expansion ratio, and having a superior thermal management. In addition, the larger the "dead space" is, the smaller crankshafts phase angle shift (phase-lag between the two pistons) is, for a given compression ratio. A smaller phase-lag dictates a faster actuation (movement from closed to open more quickly) of the transfer valve, which may be, mechanically-wise, more challenging and may further degrade the efficiency of the engine. Exemplary embodiments may beneficially increase the efficiency of the engine by reducing dead space and, hence, increasing phase lag. Because of the faster actuation—i.e., moving from closed to open (or vice versa) more quickly—higher inertia forces are present, which may lead to higher wear and tear.

Additionally, exemplary embodiments may include an opposed or "V" (the two cylinder heads or cylinder walls close to Top Dead Center are touching) cylinder and crankshaft configuration that reduces dead space and maintains an improved temperature differential between the cylinders through isolation. Exemplary embodiments may include a method of isolating the engine cylinders in an opposed or "V" configuration to permit improved temperature differentiation, in contrast to some known engines containing substantial dead space in the port connecting the two cylinders.

As described above, crossover valve 12 may include a first closed position (Close 1) with the valve seating on the surface of the power cylinder wall or power cylinder head, an open position in which the valve is not seated on any cylinder wall or cylinder head (and working fluid can pass from the compression cylinder to the power cylinder through the opening around the valve), and a second closed position (Close 2) with the valve seating on the surface of the compression cylinder wall or compression cylinder head. Hence, the valve state changes from close to open and again to close while moving in only one direction (Single Direction Close-Open-Close crossover valve: SDCOC crossover valve). Exemplary embodiments may comprise split-cycle internal combustion engine with a SDCOC crossover valve that has its position resets from Close 2 to Close 1 at a later stage of the engine cycle than the prior art, such position reset may occur after the opening of the exhaust valve, for example. The one directional movement of the SDCOC crossover valve may be advantageous since its operation involves less acceleration and deceleration and therefore having reduced inertia forces, which may make it easier to implement. Conventional poppet valves that have only one close position may need to reverse the direction of their movement and overcome larger inertia forces compared to embodiments of a Single Direction Close-Open-Close crossover valve disclosed herein. Split Cycle engine equipped with an exemplary SDCOC crossover valve rather than with conventional crossover poppet valve, may reduce valve acceleration by a magnitude of 50 percent.

Referring again to FIG. 1, within the compression cylinder 01 is compression piston 03. The compression piston 03 moves relative to the compression cylinder 01 in the direction as indicated by the illustrated arrows. Within the power cylinder 02 is a power piston 04. The power piston 04 moves relative to the power cylinder 02 in the direction as indicated by the illustrated arrows. The compression cylinder 01 and the compression piston 03 define chamber B. The power cylinder 02 and the power piston 04 define chamber C. The volume within crossover valve 12, between the two valve seats (see valve seats 121 and 122 in FIG. 14B) define chamber E. In some embodiments, the compression crankshaft angle trails the power crankshaft angle such that the power piston 04 moves in advance of the compression piston 03. Chamber B may be in fluid communication with chamber C when crossover valve 12 is in an open state. Chamber B, through intake valve 10, may be in fluid communication with carbureted naturally aspirated fuel/air charge or forced induced fuel/air charge, A. Chamber C, through exhaust valve 11, may be in fluid communication with ambient air D. When in an open state, exhaust valve 11 allows exhaust gases to exhale.

Figure 8:
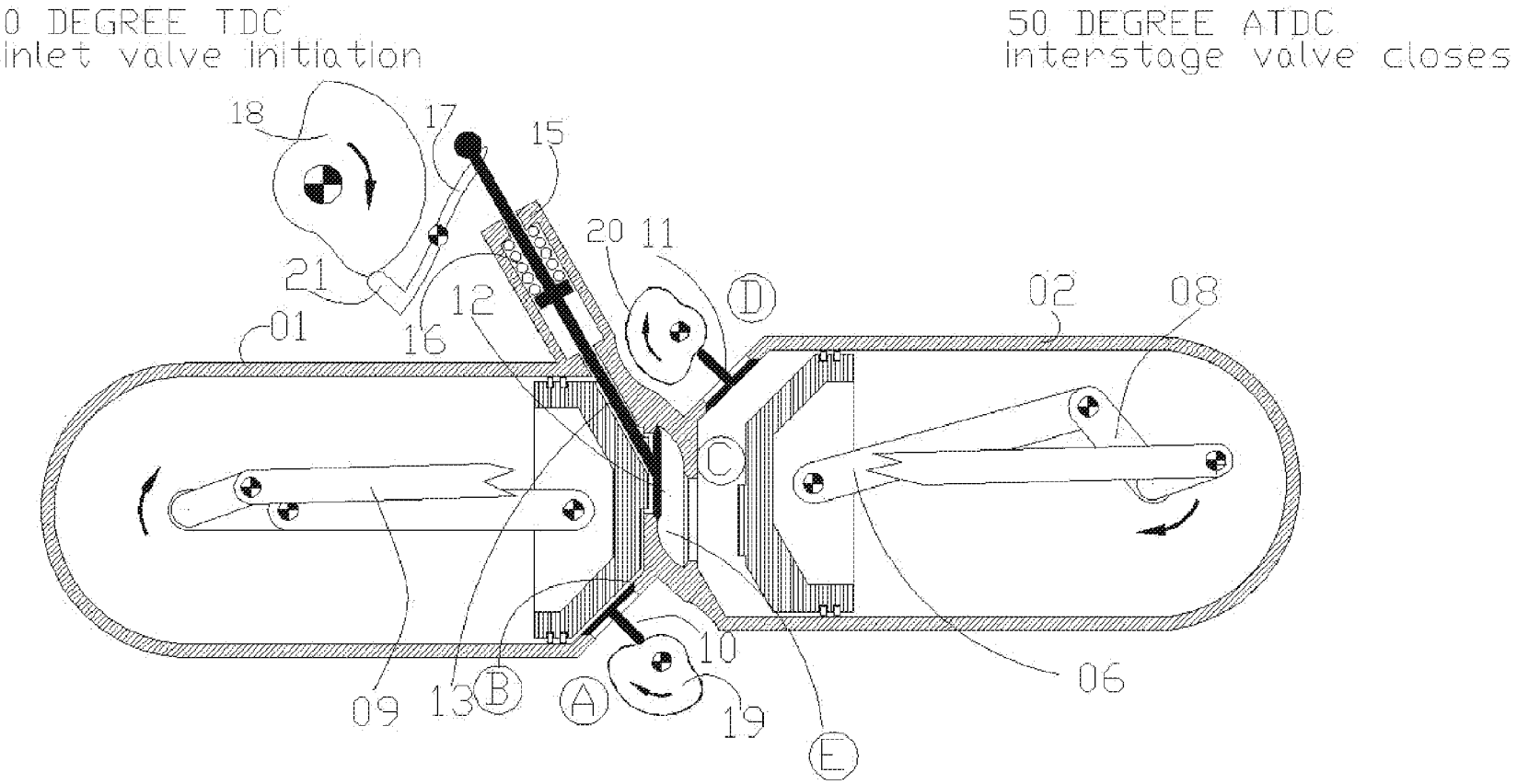
FIG. 8 is a simplified cross-sectional side view of the DPCE apparatus of FIG. 1, wherein the compression crankshaft angle is illustrated at Top Dead Center (TDC). and the power crankshaft angle is illustrated at 50 degrees after its TDC.
Figure 9:
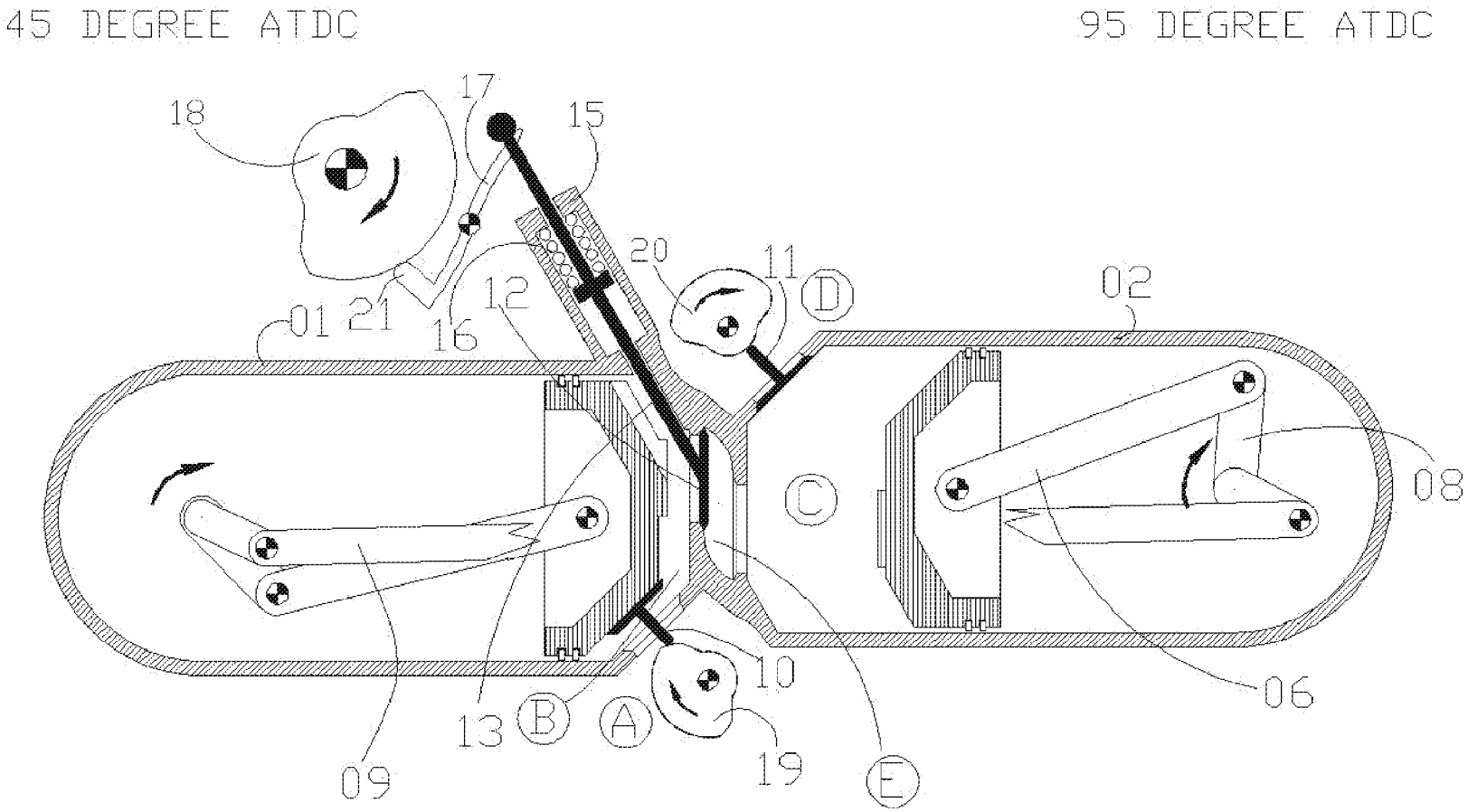
FIG. 9 is a simplified cross-sectional side view of the DPCE apparatus of FIG. 1, wherein the compression crankshaft angle is illustrated at 45 degrees after its TDC, and the power crankshaft angle is illustrated at 95 degrees after its TDC.
Figure 10:
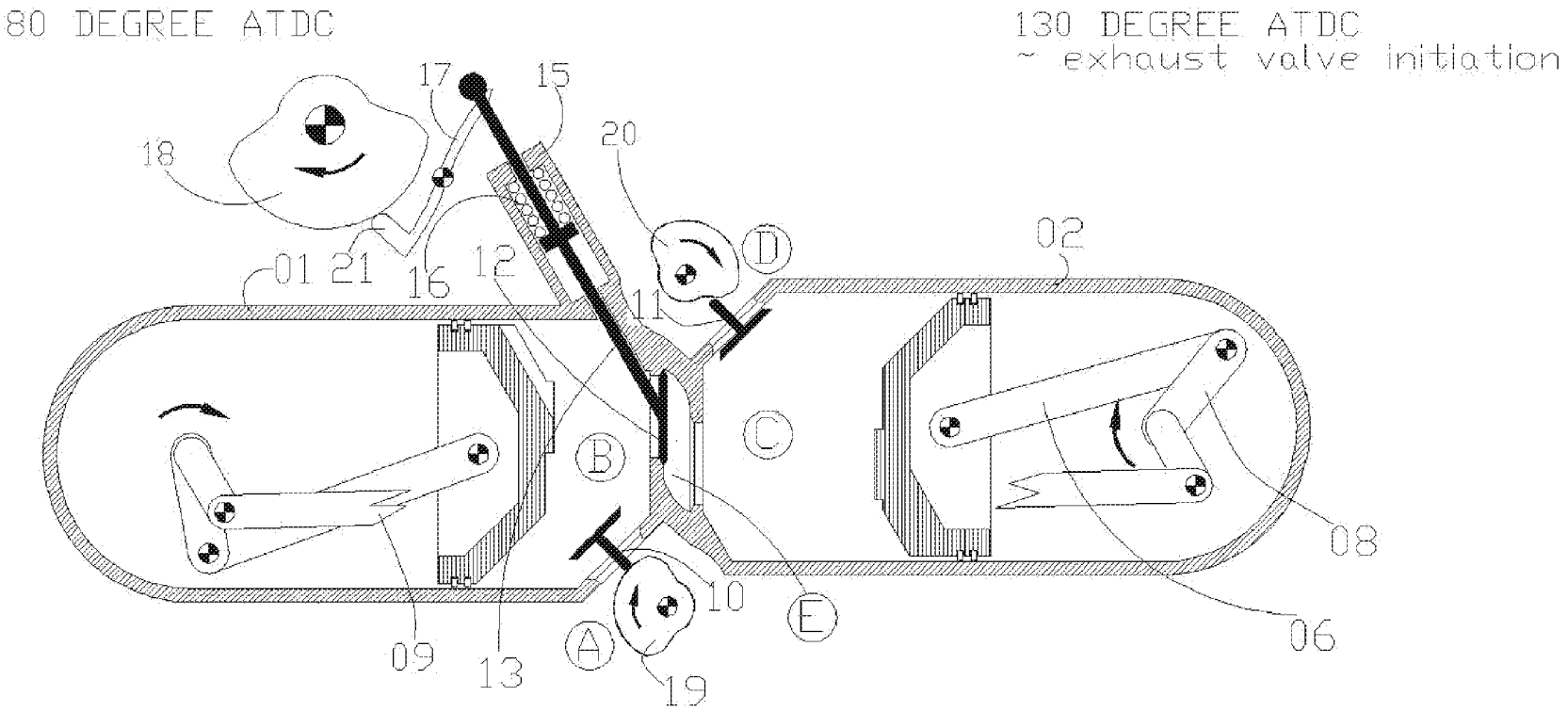
FIG. 10 is a simplified cross-sectional side view of the DPCE apparatus of FIG. 1, wherein the compression crankshaft angle is illustrated at 80 degrees after its TDC, and the power crankshaft angle is illustrated at 130 degrees after its TDC.

During a combustion stroke, the power piston 04 may push the power connecting rod 06, causing the power crankshaft 08 to rotate clockwise as illustrated in FIGS. 8, 9, and 10. During an exhaust stroke, inertial forces (which may be initiated by a flywheel mass—not shown) cause the power crankshaft 08 to continue its clockwise rotation, and cause the power connecting rod 06 to move power piston 04, which in turn exhales burnt fuel exhaust through valve 11 as illustrated in FIGS. 11, 12, 13, 1, 2, and 3. The power crankshaft 08 rotation articulates rotation, through a crankshaft connecting rod 09, of the compression crankshaft 07 for phase shifted synchronous rotation (i.e., both crankshafts rotate at the same speed but differ in their dynamic angles).

In exemplary embodiments, the relative positions of the power piston 04 and the compression piston 03 may be phase-shifted by a desired amount to achieve a desired engine compression ratio. In some exemplary embodiments, the DPCE dual cylinder apparatus utilizes conventional pressurized cooling and oil lubrication methods and systems (not shown). In some exemplary embodiments, the components of the power chamber C are temperature controlled using a cooling system, thereby cooling the power chamber C structure components (such as the cylinder 02, piston 04, and parts of valve 12). In some exemplary embodiments, some or all of the components may be fabricated out of high-temperature resistant materials such as ceramics or ceramic coating, carbon, titanium, nickel-alloy, nanocomposite, or stainless steel. In some exemplary embodiments, the DPCE apparatus can utilize well-known high voltage timing and spark plugs electrical systems (not shown), as well as an electrical starter motor to control engine initial rotation.

As explained above, the compression connecting rod 05 connects the compression crankshaft 07 with the compression piston 03 causing the compression piston 03 to move relative to the cylinder in a reciprocating manner. The power connecting rod 06 connects the power crankshaft 08 with the power piston 04. During the combustion phase, the power connecting rod 06 transfers the reciprocating motion of the power piston 04 into the power crankshaft 08, causing the power crankshaft to rotate. During the exhaust phase, the power crankshaft 08 rotation and momentum pushes the power piston 04 back toward the compression cylinder 01, which causes the burned gases to be exhaled via the exhaust valve (exhaust stroke).

Referring to FIG. 1, the compression crankshaft 07 converts rotational motion into compression piston 03 reciprocating motion. The compression crankshaft 07 connects the compression connecting rod 05 with the crankshaft connecting rod 09. Motion of the crankshaft connecting rod 09 causes the compression crankshaft 07 to rotate. Compression crankshaft 07 rotation produces motion of the compression connecting rod 05 that in turn moves the compression piston 03 relative to its cylinder housing 01 in a reciprocating manner.

In various exemplary embodiments of the present invention, the compression crankshaft 07 and power crankshaft 08 structural configurations may vary in accordance with desired engine configurations and designs. For example, possible crankshaft design factors may include: the number of dual cylinders, the relative cylinder positioning, the crankshaft gearing mechanism, and the direction of rotation.

The power crankshaft 08 connects the power connecting rod 06 with the crankshaft connecting rod 09. As combustion occurs, the reciprocating motion of power piston 04 causes, through the power connecting rod 06, the power crankshaft 08, which may also be coupled to the engine output shaft (not shown), to rotate, which causes the connecting rod 09 to rotate the compression crankshaft 07, thereby generating reciprocating motion of the compression piston 03 as described above.

The crankshaft connecting rod 09 connects the power crankshaft 08 with the compression crankshaft 07 and thus provides both crankshafts with synchronous rotation. Alternative embodiments of the present invention may include, for the crankshaft connecting rod 09, standard rotational energy connecting elements such as: timing belts, multi rod mechanisms gears, drive shafts combined with 90 degrees helical gear boxes and/or combination of the above, for example.

FIGS. 1 through 13 illustrate perspective views of the crankshaft connecting rod 09 coupled to crankshafts 07 and 08, which are coupled to respective piston connecting rods 05 and 06. The crankshafts 07 and 08 may be relatively oriented so as to provide a predetermined phase difference between the otherwise synchronous motion of pistons 03 and 04. A predetermined phase difference between the TDC positions of the compression piston and power piston may introduce a relative piston phase delay or advance. FIGS. 1 through 17 illustrate that piston connecting rods 05 and 06 are out of phase, thereby providing a desired phase delay (also known as phase lag) or phase advance between the TDC positions of pistons 03 and 04. In exemplary embodiments, as illustrated in FIGS. 1 to 13, a phase delay is introduced such that the power piston 04 moves slightly in advance of compression piston 03, thereby permitting the compressed charge to be delivered under nearly the full compression stroke and permitting the power piston 04 to complete a full exhaust stroke. Such advantages of the phase delays where the power piston leads the compression piston are also described in U.S. Pat. No. 1,372,216 to Casaday and U.S. Pat. Application No. 2003/0015171 A1 to Scuderi, the entire contents of both of which are incorporated by reference herein in their entireties. Control and modulation of the degree of the phase lag would alter the engine effective compression ratio. The smaller the phase lag is, the larger the compression ratio is. Modulation of the phase lag could serve as to set a compression ratio that would better fit the combustion of a particular fuel, for example, higher phase lag and smaller compression ratio for gasoline and spark ignited (SI) fuels and smaller phase lag and higher compression ratio for diesel and compression ignited (CI) fuels. Modulation of the DPCE engine phase lag could attribute multi-fuel capabilities to the engine. In farther embodiment, dynamic phase lag changes (Modulation) can be implemented while the engine is in operation mode or at rest mode. Phase lag dynamic modulation as function of engine loads, speed, temperature etc may increase engine performance significantly.

Figure 5:
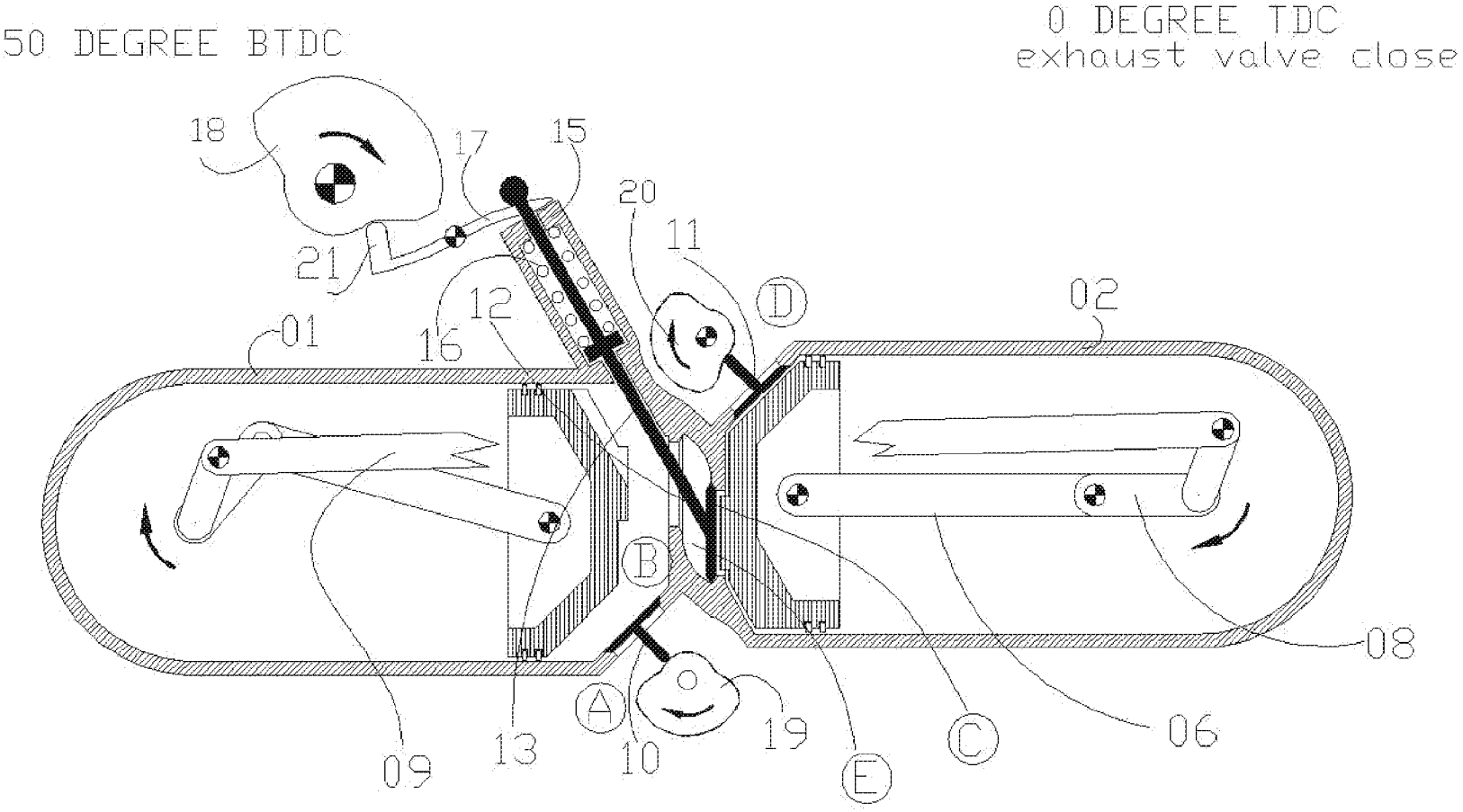
FIG. 5 is a simplified cross-sectional side view of the DPCE apparatus of FIG. 1, wherein the compression crankshaft angle is illustrated at 50 degrees before its TDC, and the power crankshaft angle is illustrated at its TDC.
Figure 6:
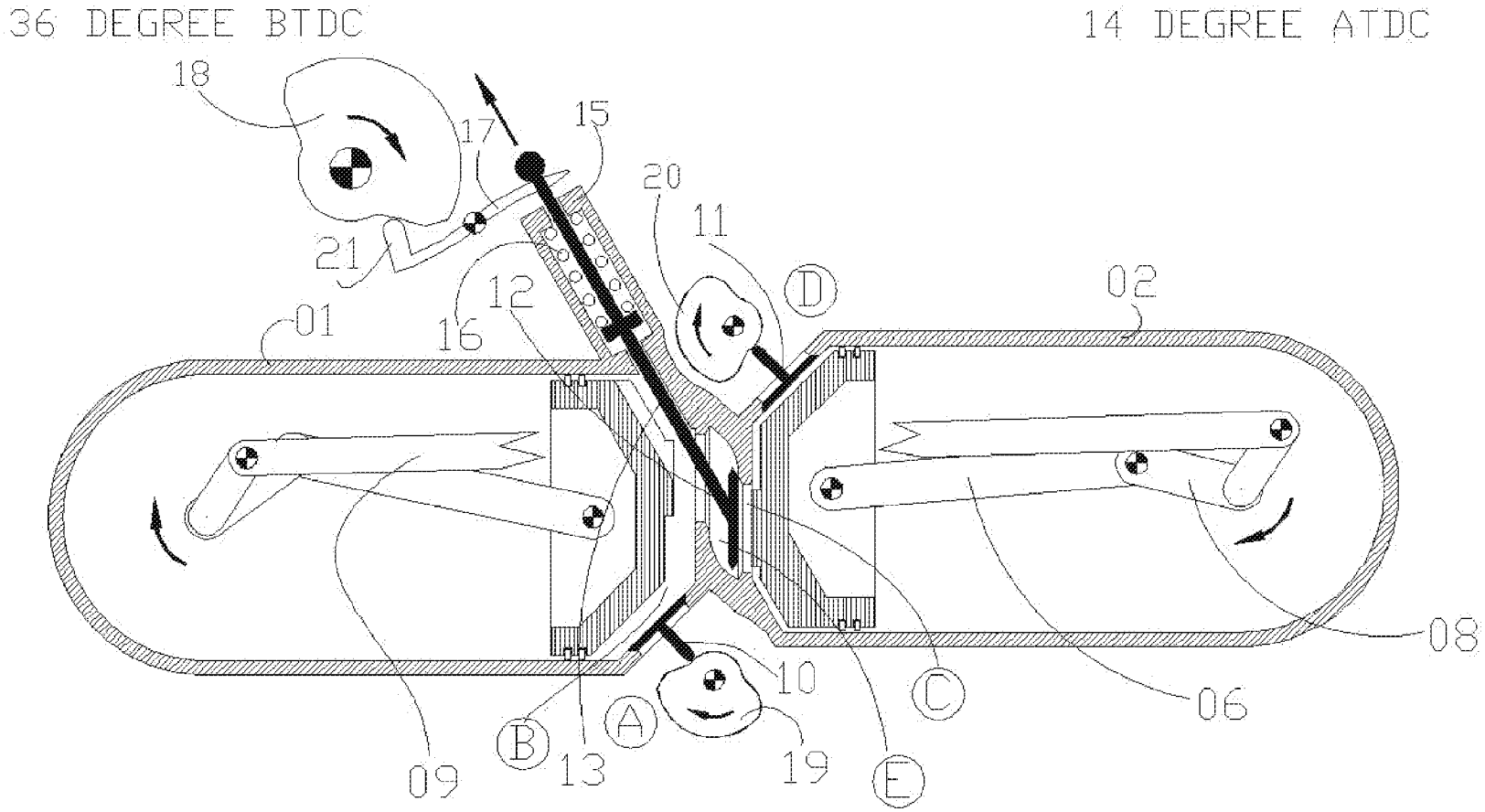
FIG. 6 is a simplified cross-sectional side view of the DPCE apparatus of FIG. 1, wherein the compression crankshaft angle is illustrated at 36 degrees before its TDC, and the power crankshaft angle is illustrated at 14 degrees after its TDC.
Figure 7:
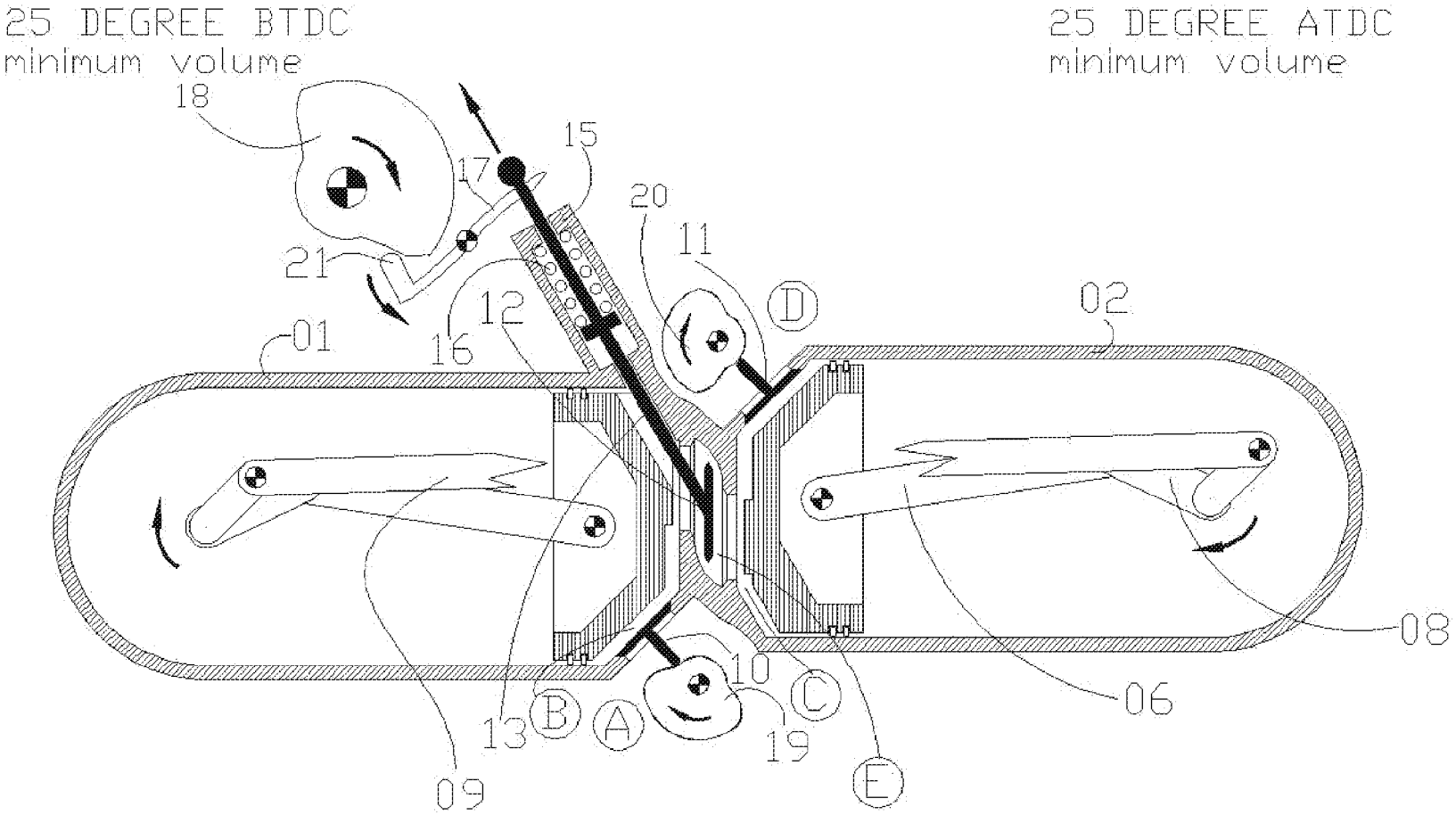
FIG. 7 is a simplified cross-sectional side view of the DPCE apparatus of FIG. 1, wherein the compression crankshaft angle is illustrated at 25 degrees before its TDC, and the power crankshaft angle is illustrated at 25 degrees after its TDC.
Figure 11:
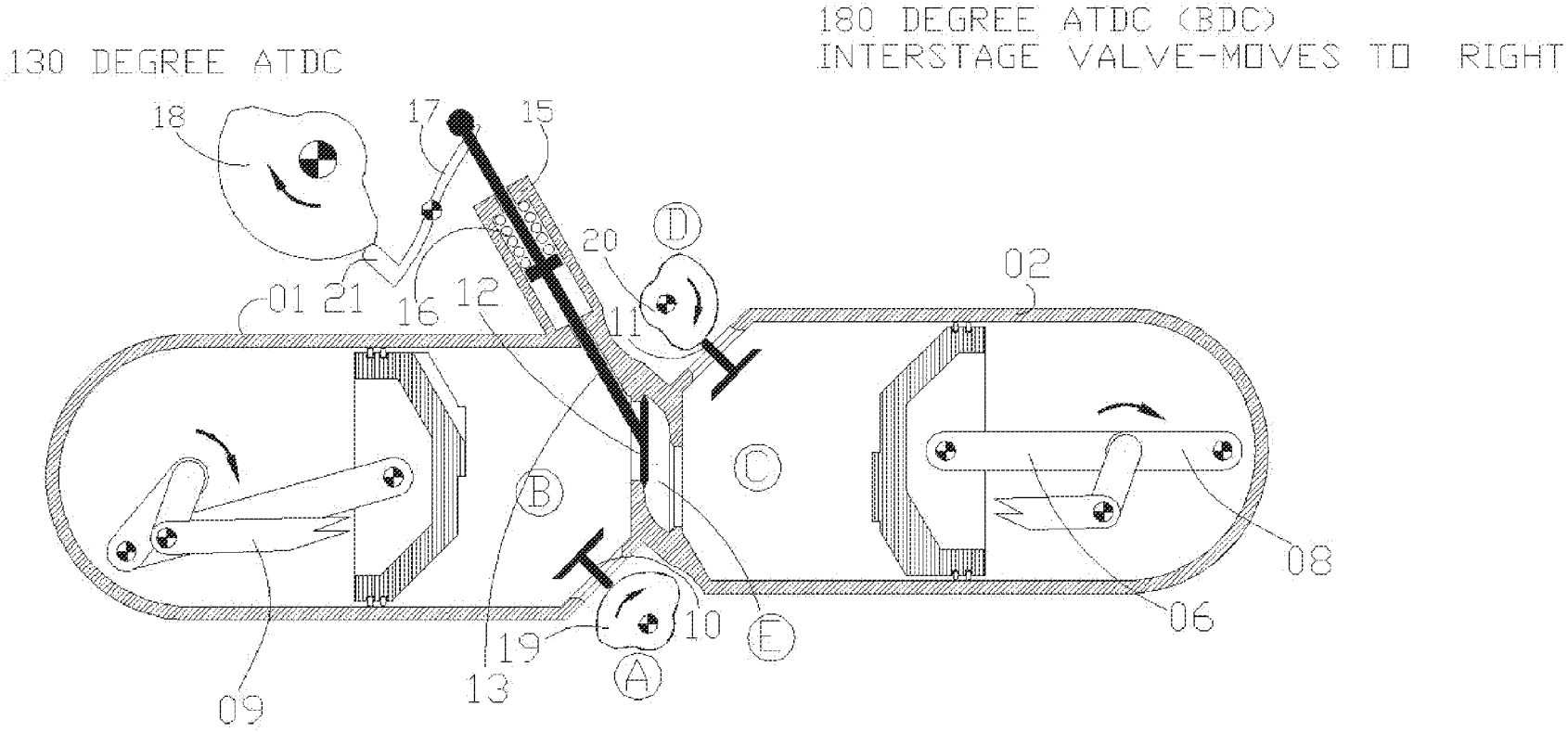
FIG. 11 is a simplified cross-sectional side view of the DPCE apparatus of FIG. 1, wherein the compression crankshaft angle is illustrated at 130 degrees, and the power crankshaft angle is illustrated at Bottom Dead Center (BDC).
Figure 12:
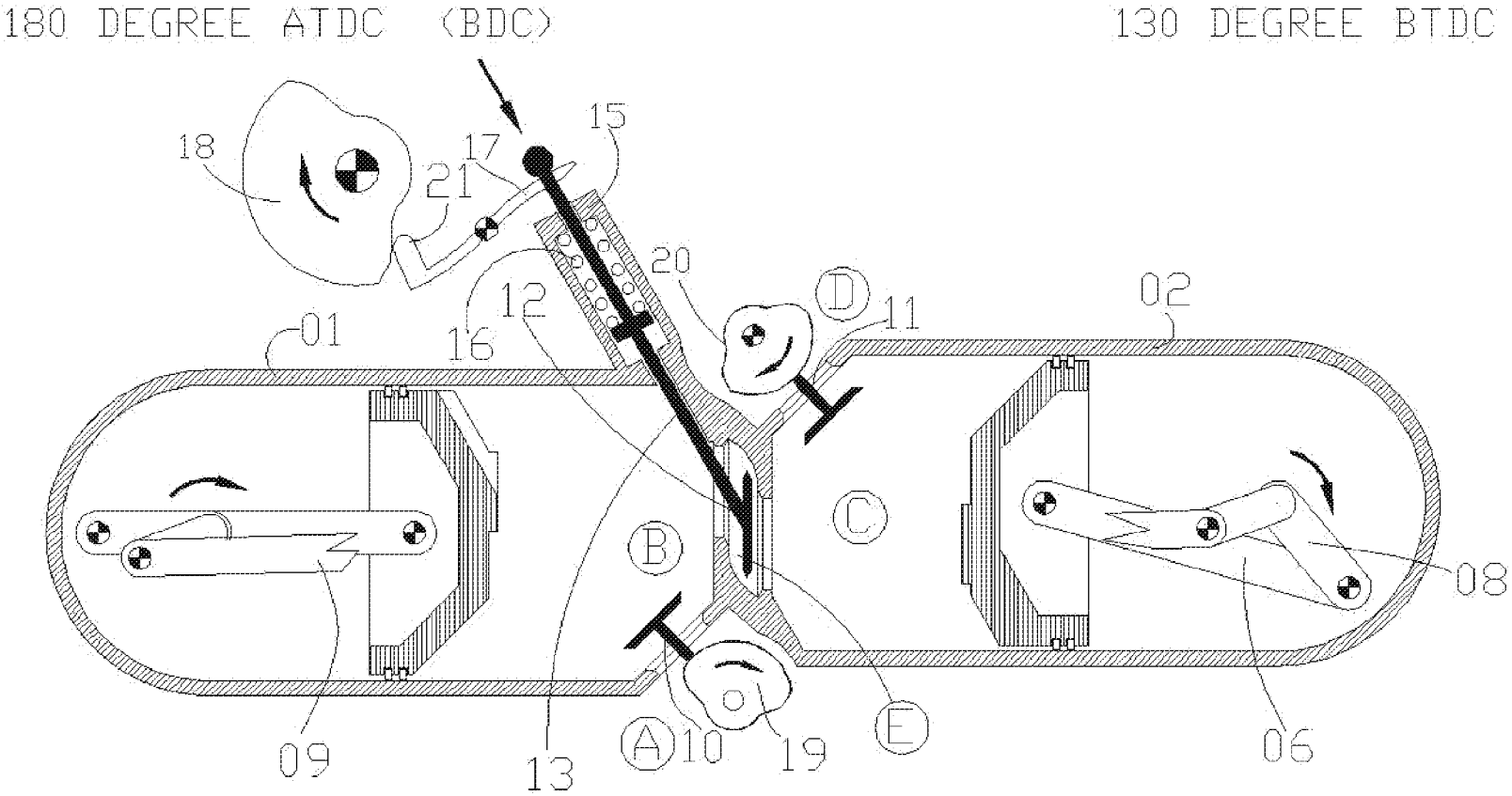
FIG. 12 is a simplified cross-sectional side view of the DPCE apparatus of FIG. 1, wherein the compression crankshaft angle is illustrated at 180 degrees after its TDC (BDC), and the power crankshaft angle is illustrated at 130 degrees Before its TDC.
Figure 13:
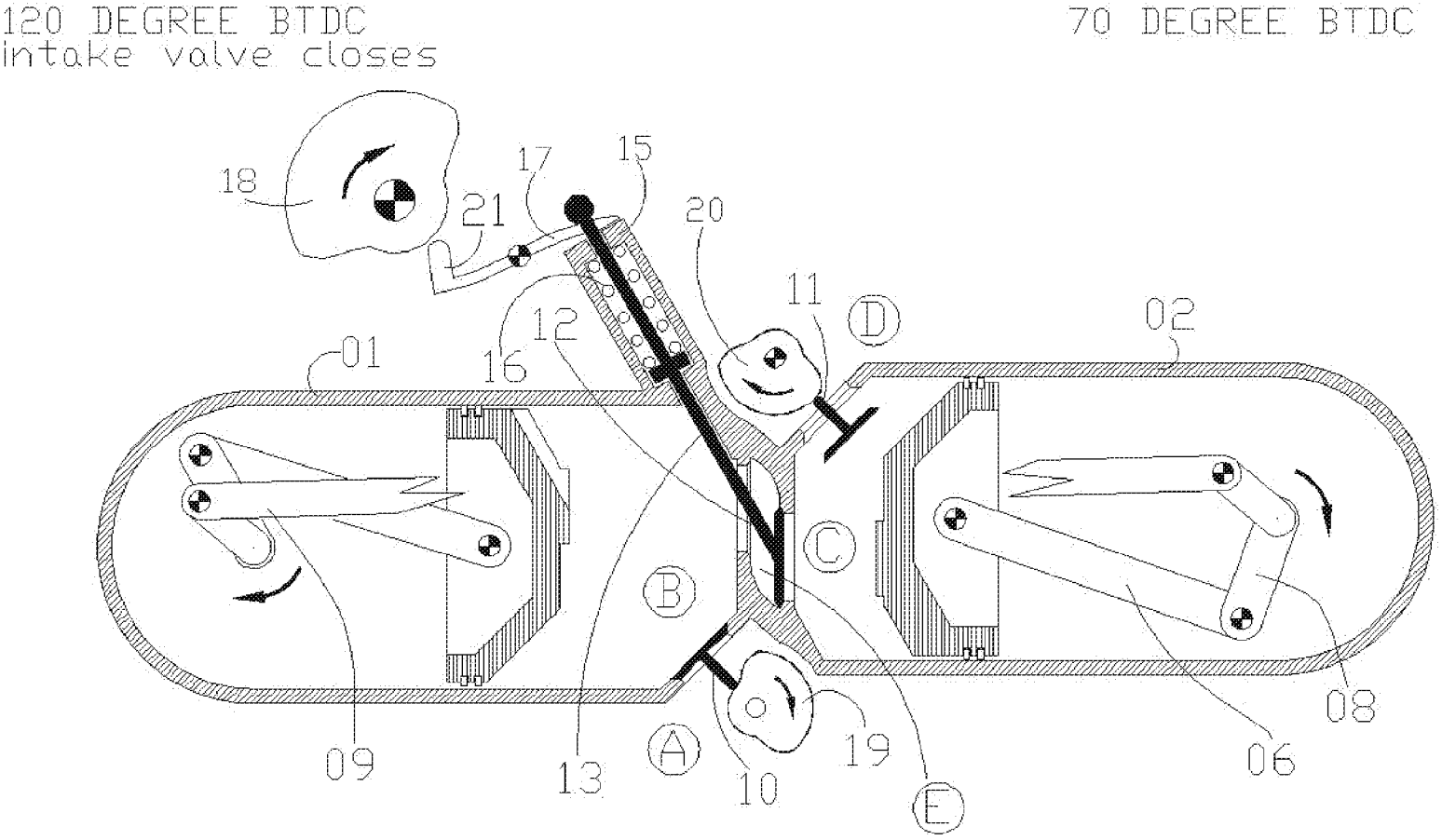
FIG. 13 is a simplified cross-sectional side view of the DPCE apparatus of FIG. 1, wherein the compression crankshaft angle is illustrated at 120 degrees before its TDC, and the power crankshaft angle is illustrated at 70 degrees before its TDC.

As illustrated in FIGS. 1 through 13, while an electrical starter (not shown) engages DPCE output shaft (not shown), both crankshafts 07 and 08 start their clockwise rotation and both pistons 03 and 04 begin their reciprocating motion. As illustrated in FIG. 9, the compression piston 03 and the power piston 04 move in the direction that increases chamber B and chamber C volume. Since intake valve 10 is in its open state and because chamber B volume constantly increases at this stage, carbureted fuel or fresh air charge (when using a fuel injection system) flows from point A (which represents a carburetor output port, for example) through intake valve 10 into chamber B. The location of the compression piston 03 when the intake valve opens may vary. In some embodiments of the present invention, the timing of the opening of the intake valve may vary. In one example, the intake valve may open a few crankshaft degrees before compression piston 03 reaches its TDC through approximately 50 crankshaft degrees after compression piston 03 reaches its TDC. As shown in FIGS. 10 through 12, respectively, chamber B volume increases while fuel-air charge flows in. As compression piston 03 passes beyond its BDC point (for example, somewhere between 10 to 70 degrees after BDC, as shown in FIG. 13), intake valve 10 closes, trapping chamber B air-fuel charge (working fluid) content. While crankshafts clockwise rotation continues (as shown in FIG. 13 and FIG. 1), chamber B volume decreases and the temperature and pressure of the air-fuel charge increases. As the power piston 04 approaches its TDC (FIGS. 4 and 5), almost all of the burned working fluid is pushed out through the open exhaust valve (11). This is because the DPCE is designed, in one embodiment, to have minimal clearance, that is to have chamber C volume as low as possible when piston 04 is at its TDC (FIG. 5). This is also because of protrusion s 23 that decrease further chamber C volume when piston 04 is at TDC, filling and eliminating, for example, potential dead space at the vicinity of crossover valve 12. As the power piston 04 passes through its TDC (FIG. 5 through 8), crossover valve 12 opens and the air-fuel charge in chamber B flows into chamber C, which is gradually increasing in volume due to piston 4 movement away from TDC. As written above, during the part of the engine cycle which is depicted in FIG. 5 through 8, crossover valve 12 opens (FIG. 5) and the air-fuel charge in chamber B flows into chamber C (FIGS. 6 and 7) and crossover valve 12 closes (FIG. 8). This charge flow can be described as having 3 phases: The first phase in which compression piston 03, while moving towered its TDC, is decreasing chamber B volume more than power piston 04, while moving away from its TDC, is increasing chamber C volume (FIG. 5, FIG. 6 and just before the position depicted in FIG. 7); The second phase in which compression piston 03, while moving towered its TDC, is decreasing chamber B volume exactly to the same extent as power piston 04, while moving away from its TDC, is increasing chamber C volume (the position depicted in FIG. 7); and a third phase in which compression piston 03, while moving towered its TDC, is decreasing chamber B volume less than power piston 04, while moving away from its TDC, is increasing chamber C volume (just following the position depicted in FIG. 7, and FIG. 8). In one embodiment, this written above second phase (FIG. 7) is the point in the cycle in which the maximum compression of the working fluid is achieved. This could also be described as the point in which the sum of the volumes of chambers B, E, and C is the smallest, while crossover valve 12 is open. In one embodiment, the pressure built up due to combustion may be timed to compound on top of this point of maximum compression. At a certain predetermined point (for example, while crossover valve 12 is open and the compression piston 03 moves toward its TDC, as illustrated in FIGS. 6 through 8, although, some exemplary embodiments may introduce delay or advance), combustion of the air-fuel charge is initiated via an ignition mechanism, such as spark plug firing or compression ignition. As the compression piston 03 approaches its TDC (FIGS. 7 and 8), almost all of the compressed working fluid is pushed through the open crossover valve (12) from chamber B via chamber E to chamber C. This is because the DPCE is designed, in one embodiment, to have minimal clearance, that is to have chamber B volume as low as possible when piston 03 is at its TDC (FIG. 8). This is also because of protrusion s 22 that decrease further chamber C volume when piston 03 is at TDC, filling and eliminating, for example, potential dead space at the vicinity of crossover valve 12. As the compression piston 03 passes through its TDC (FIG. 8), crossover valve 12 closes.

FIGS. 6 through 10 illustrate the power stroke, according to exemplary embodiments of the present invention. As combustion occurs (spark plug firing or compression ignition at a predetermined piston location shown within the dynamic range illustrated in FIGS. 5 through 8, although some deviation may be permitted in some embodiments), the pressures of chambers B and C increase, forcing power piston 04 and compression piston 03 away from each other. Although the torque produced by the compression piston opposes engine rotation, the torque produced by the power piston during most of the power stroke is greater and the net torque turns the power crankshaft clockwise (as well as the coupled compression crankshaft). Meanwhile, the crossover valve 12 closes (FIGS. 8 and 9) because of (1) crossover valve 12 camshaft 18 actuating mechanism, (2) increasing pressure in chamber C, and (3) decreasing pressure in chamber B.

Referring now to FIGS. 8 and 9, when compression piston 03 is pulled back from its TDC position, according to exemplary embodiments of the present invention, intake valve 10 reopens, thus allowing a new air-fuel charge A to enter chamber B.

Referring now to FIGS. 10 through 13, in exemplary embodiments of the present invention, the exhaust stroke may begin about 40 to 60 crankshaft degrees before power piston 04 reaches its Bottom Dead Center position (FIG. 11). The exhaust valve 11 opens and the burned exhaust gases are pushed out from chamber C through open exhaust valve 11 into the ambient environment D. Although the timing of the strokes of the engine is given in exemplary embodiments, it should be understood that the timing described herein may be adjusted in some embodiments.

Thus, the DPCE engine divides the strokes performed by a single piston and cylinder of conventional internal combustion engines into two thermally differentiated cylinders in which each cylinder executes half of the four-stroke cycle. A relatively "cold" cylinder executes the intake and compression, but not the exhaust stroke, and a thermally isolated "hot" cylinder executes the combustion and exhaust, but not the intake stroke. Compared to conventional engines, this advantageous system and process enables the DPCE engine to work at higher combustion chamber temperatures and at lower intake and compression chamber temperatures. Utilizing higher combustion temperatures while maintaining lower intake and compression temperatures reduces engine cooling requirements, lowers compression energy requirements, and thus boosts engine efficiency. Additionally, thermally isolating the power cylinder from the external environment, according to exemplary embodiments of the present invention, limits external heat losses and thus enables a larger portion of the fuel heat energy to be converted into useful work, allows the reuse of heat energy in the next stroke, and therefore permits less fuel to be burned in each cycle.

Figure 14C:
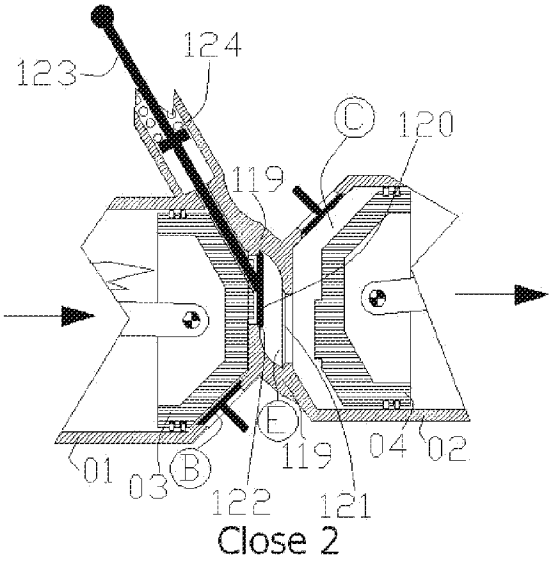
FIGS. 14A-14C.
Figure 14B:
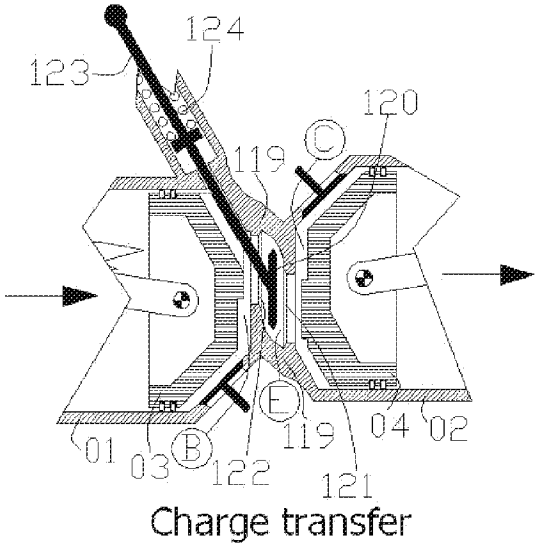
Figure 14A:
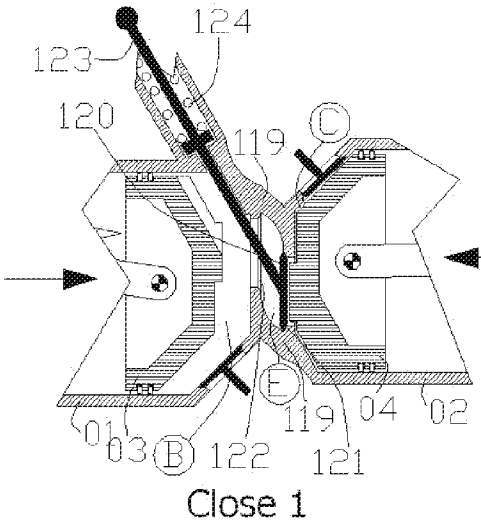

Referring now to exemplary mechanical crossover valve as illustrated in cross sectional drawings at FIG. 14A-C. FIG. 14A illustrates a cross section of a crossover valve that depicts the various parts (components) that may generally include main valve body 119, power side (chamber C) sealing surface 121 (valve seat 121), compression side (chamber B) sealing surface 122 (valve seat 122), DSAP valve head 120 (comprising two valve faces), DSAP valve push rod 123, and crossover valve return spring 124. It also contains chamber E, which is located within the crossover valve. Chamber E borders are valve body 119, upstream to (the right of) valve seat 122 and downstream to (the left of) valve seat 121. In FIG. 14A, Chamber E is fluidly coupled to chamber B with neglectable pressure differential between the two chambers. As illustrated in FIG. 14A, DSAP valve 120 engages sealing surface 121 and thus decouple chambers B and E from chamber C. FIG. 14B illustrates DSAP valve 120 and valve body 119 in relative position such that neither sealing valve seat 121 nor sealing valve seat 122 seals thus enabling compression chamber B and power chamber C reciprocate fluid exchange through chamber E, for example, to transfer the compressed working fluid from chamber B to chamber C. Thus, FIG. 14B illustrates a DSAP 120 valve positioning that causes the crossover valve to be in its open state. FIG. 14C illustrates DSAP valve 120 engages sealing surface 122 and thus decouple chamber B from chambers C and E. In FIG. 14C, Chamber E is fluidly coupled to chamber C with neglectable pressure differential between the two chambers. When used in the embodiments of FIGS. 1-20, mechanical crossover valve 12 may separate compression chamber B and power chamber C. In these situations each chamber may include regions of different fluid pressure.

As described previously, dead volume in a split-cycle engine can significantly reduce the engine efficiency. Minimizing the dead volume may be beneficial in split-cycle engines in general and in DPCE split-cycle engines, in particular. In a typical split-cycle engine there are at least 3 potential locations of dead volume, and for ease of description the current DPCE split-cycle design will be used as an example. The 3 potential locations of dead volume are: 1) When compression piston 03 is at its TDC (FIG. 8), any residual volume at chamber B is considered dead volume since it will hold compressed working fluid that would not be transferred to Chamber C to participate in the power (combustion) stroke; 2) When power piston 04 is at its TDC (FIG. 5), any residual volume at chamber C is considered dead volume since it will cause a partial decompression of the working fluid at chamber B when the crossover valve opens (decompression of the working fluid prior to combustion reduces efficiency); and 3) Any portion of the volume within chamber E that hold working fluid that is being prevented to participate in the power (combustion) stroke is considered dead volume as not having this working fluid combusted reduces efficiency. The mechanical crossover valve as illustrated in FIG. 14A-C reduces all the 3 sources of dead volume that were described above: 1) When compression piston 03 is at its TDC (FIG. 8) in maximal proximity to the cylinder head, and DSAP valve 120 is placed on valve seat 122, and in one embodiment, protrusion 22 eliminates any residual dead volume, the dead volume at chamber B is reduced. Almost all of the working fluid is transferred to chamber C to participate in the power (combustion) stroke; 2) When power piston 04 is at its TDC (FIG. 5), in maximal proximity to its cylinder head, and DSAP valve 120 is placed on valve seat 121, and in one embodiment, protrusion 23 eliminates any residual dead volume, the dead volume at chamber C is reduced. Therefore, when DSAP valve 120 cracks open (FIG. 6), almost no decompression of the working fluid at chamber B occurs. Avoiding decompression of the working fluid prior to combustion prevents reduced efficiency; and 3) At the end of the charge transfer from chamber B to Chamber C (FIG. 8), chamber E is in direct fluid connection with chamber C. Therefore, all the working fluid within chamber E is participating in the combustion (power) stroke.

An exemplary embodiment of a mechanical crossover valve will now be discussed with reference to FIGS. 14A-C. The mechanical crossover valve may be used as crossover valve 12 in the embodiments described above with respect to FIGS. 1-13 and for illustrative purposes the following description of the mechanical crossover valve of FIGS. 14A-C may refer to elements mentioned above in connection with FIGS. 1-13 as well. It should be understood that use of the mechanical crossover valve of FIGS. 14A-C is not limited to the embodiments described above with respect to FIGS. 1-13, but may be used in other applications, including other types of double piston cycle engines, other split-cycle engines, four-stroke engines, rotary engines and compressors, for example. The properties of a Single Direction Close-Open-Close crossover valve (SDCOC crossover valve) are advantageous to any system that requires the utilization of a very fast operating valve. Since any known split cycle engine uses at least one crossover valve, and since those crossover valves operation requirements are about 2-6 times faster than common IC engine valve, the use of a SDCOC crossover valve as part of any split cycle engine is of great value.

Referring to FIG. 14A, the mechanical crossover valve may generally include main valve body 119, DSAP valve 120, sealing seat 121, sealing seat 122, DSAP valve push rod 123, and crossover valve return spring 124. When used in the embodiments of FIGS. 1-13, the mechanical crossover valve may separate compression chamber B and combustion chamber C. In this situation each chamber may include regions of different fluid pressure. Within the mechanical crossover valve, the movement of DSAP valve 120 relative to the main valve body 119 may allow the coupling or decoupling of fluid communication between chamber B and chamber C. As illustrated in FIG. 14A, DSAP valve 120 seals against power cylinder side's sealing seat 121 of valve body 119, which may prevent high pressure fluid transfer from compression chamber B into power chamber C (passing through chamber E). FIG. 14C is a cross-sectional view of the mechanical crossover valve. As illustrated in FIG. 14C when DSAP valve 120 seals against compression cylinder side's sealing seat 122 of valve body 119, high pressure working fluid is blocked from being transferred back from power chamber C into compression chamber B (passing through chamber E).

FIG. 14B is a cross-sectional view of the mechanical crossover valve. As illustrated in FIGS. 5-8, as power piston 04 approach its TDC, DSAP valve 120 opens due to the rotation of its dedicated cam (18) (see FIG. 5), which pushes the rocker arm follower (21), that in turn, due to the rocker pivot, the other edge of the rocker arm (17) pulls push rod (123) causing the DSAP valve 120 to leave its seat on sealing surface 121 of valve body 119 and to crack open (see also FIG. 6). This leads to a working fluid flow from chamber B via chamber E to chamber C (as illustrated in FIGS. 5-8). The cracking of DSAP valve 120 (FIG. 6) creates a sharp drop in pressure differential magnitude across the DSAP valve 120 as to almost equalize the pressure of chambers B, E and C.

FIG. 14B is a cross-sectional view of the mechanical crossover valve. As also illustrated in FIG. 7, as power piston 04 continues its movements away from TDC, the mechanical crossover valve remain open allowing the continuation of fluid transfer from compression chamber B into power chamber C. FIG. 14B also depicts an example of when combustion initiation might increase the pressure level at chamber C, contributing to the forces pushing DSAP valve 120 to the left and keeping the crossover valve open.

As illustrated in FIGS. 7 and 8, when power piston 04 continues its movements away from TDC, combustion in the power cylinder causes sharp increase in chamber C pressure. Referring to the part numbers depicted in FIGS. 14A-C, but still to the parts positions as illustrated in FIGS. 7 and 8, the DSAP valve 120 proceed its cam actuated movement toward valve sealing seat 122, and is seated on seat 122 (FIG. 8) supplemented by sudden chamber C pressure burst (combustion). From this stage onward, engine power stroke carries on at chamber C (FIGS. 8-11) while intake may start at chamber B by the opening of the intake valve 10.

As illustrated in FIGS. 10 and 11, when power piston 04 approaches its BDC exhaust valve 11 opens and the burnt gaseous exhale, and chamber C high pressure diminishes. Referring to the part numbers depicted in FIGS. 14A-C, but to the parts positions as illustrated in FIG. 12, following exhaust valve 11 opening, as can be seen in FIG. 12, DSAP valve 120 leave its seat on sealing surface 122 of valve body 119 (close 2 position) and moves back (resets) to seat on sealing surface 121 of valve body 119 (close 1 position), as can be seen in FIG. 13. This movement is again due to the rotation of its dedicated cam (18) (see FIGS. 11-13), which release its push of the rocker arm follower (21), that in turn, due to the rocker pivot, the other edge of the rocker arm (17) press on push rod (123), and together with crossover valve return spring 124 force, overcome Double-Sided-Axial-Poppet (DSAP) valve 120 force. Thus, the push rod 123 push back DSAP valve 120 to seal against sealing seat 121. Once the said valve seals against sealing seat 121, the crossover valve decouples fluid passage between compression chamber B and power chamber C enabling the next compression stroke to occur.

It should be noted that during the DPCE operation, as illustrated and discussed using FIGS. 5 through 8 and FIGS. 14A-C the DSAP valve 120 moves in one direction while alternating between closed, opened and closed again, position. The mechanical crossover valve is advantageous since it has a first closed position with the DSAP valve 120 sealing on the surface 121 valve seat of power cylinder head (Close 1 position), an open position in which the valve is not seated on any cylinder wall or cylinder head (and working fluid can pass from the compression cylinder to the power cylinder through the opening around the valve), and a second closed position with the valve sealing on the surface 122 of the compression cylinder head (Close 2 position). Hence the valve state may change from close to open and again to close while moving in only one direction. The one directional movement of DSAP valve 120 has significant advantages over conventional poppet valves since its operation involves less inertia forces. The conventional poppet valves that have only one close position need to reverse the direction of their movement and overcome larger inertia forces than the Single Direction Close-Open-Close crossover valve.

Figures 15A, 15B:
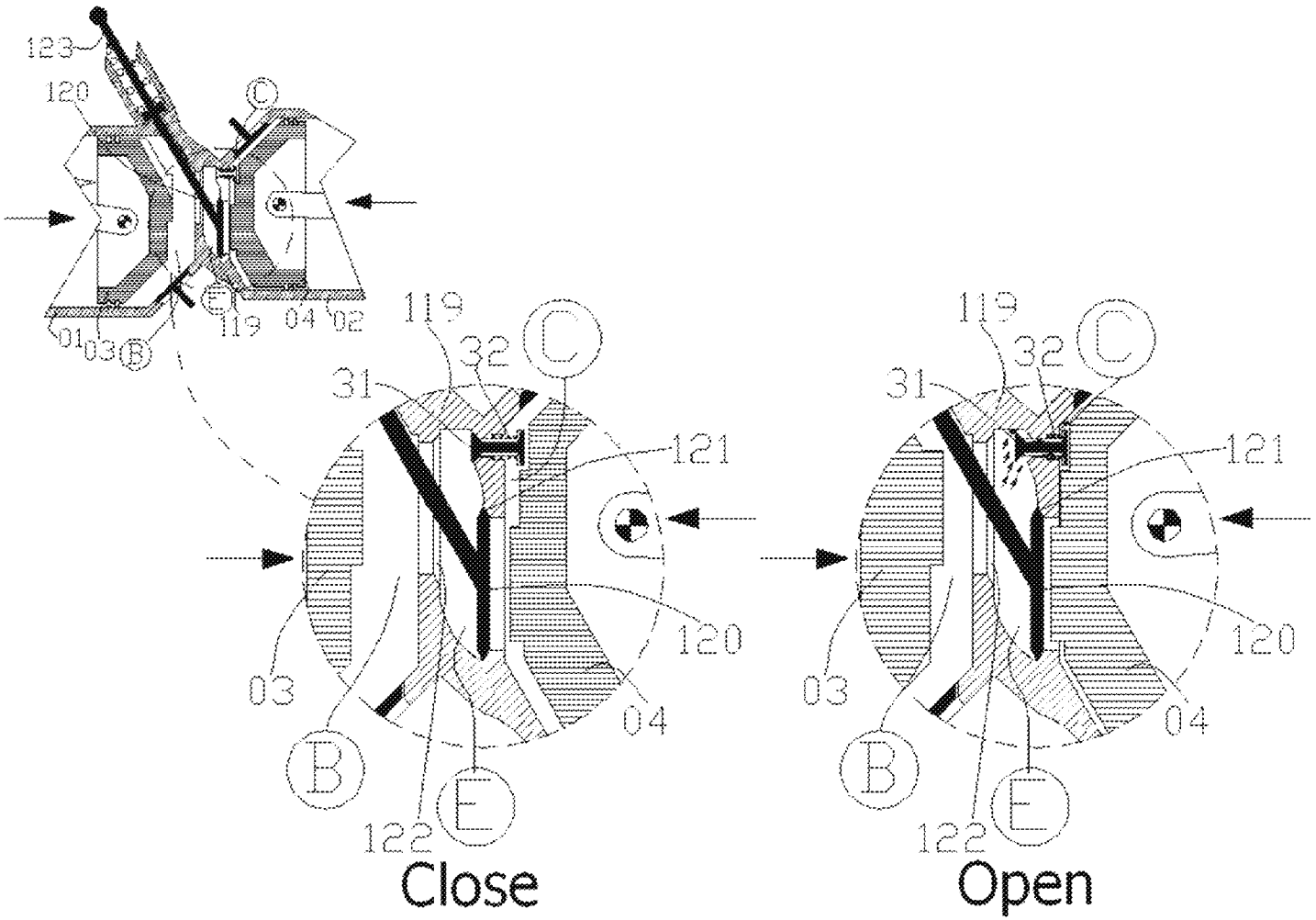
FIGS. 15A-15B.

Referring to FIG. 15, exemplary embodiments of the present invention may be equipped with differential pressure equalizer valve 31. In general, the differential pressure equalizer assists in the cracking of crossover valve 120 from its close 1 position to the open position. This may be particularly advantageous as a DPCE is scaled up to have larger working fluid displacement, by increasing the pistons and cylinders size, where the size of crossover valve 120 would be proportionally increased as well. In all general cases, and in particular in such cases of larger DPCE, the forces required to crack open crossover valve 120 (see also FIGS. 14A-C) may become exceedingly high as this force is proportional to the square area of the DSAP valve surface, the surface which is exposed to the compressed working fluid in chamber B (and chamber E, which is the volume within crossover valve 120, and is fluidly connected during the compression stroke to chamber B) during the compression stroke (the left side surface of the DSAP valve; mark 120). Differential pressure equalizer valve 31 has a substantially smaller surface area, compared to the DSAP valve, which is described in the text above. Therefore, as power piston 04 approaches TDC, slowing down and just before its linear velocity reaches zero, it pushes differential pressure equalizer valve 31 allowing initial fluid communication between chambers E with chamber C. Fluid communication between chamber E and chamber C reduces the deferential pressure between chamber E and chamber C. Lowering the said differential pressure reduces the force required to crack open crossover valve 12 and therefore ease the cracking of the said valve.

In some embodiments, the size (area) of the differential pressure equalizer is no more than 10% of the size (area) of the crossover valve. In some embodiments, an increase in valve size may require an increase in the percentage.

Figure 16:
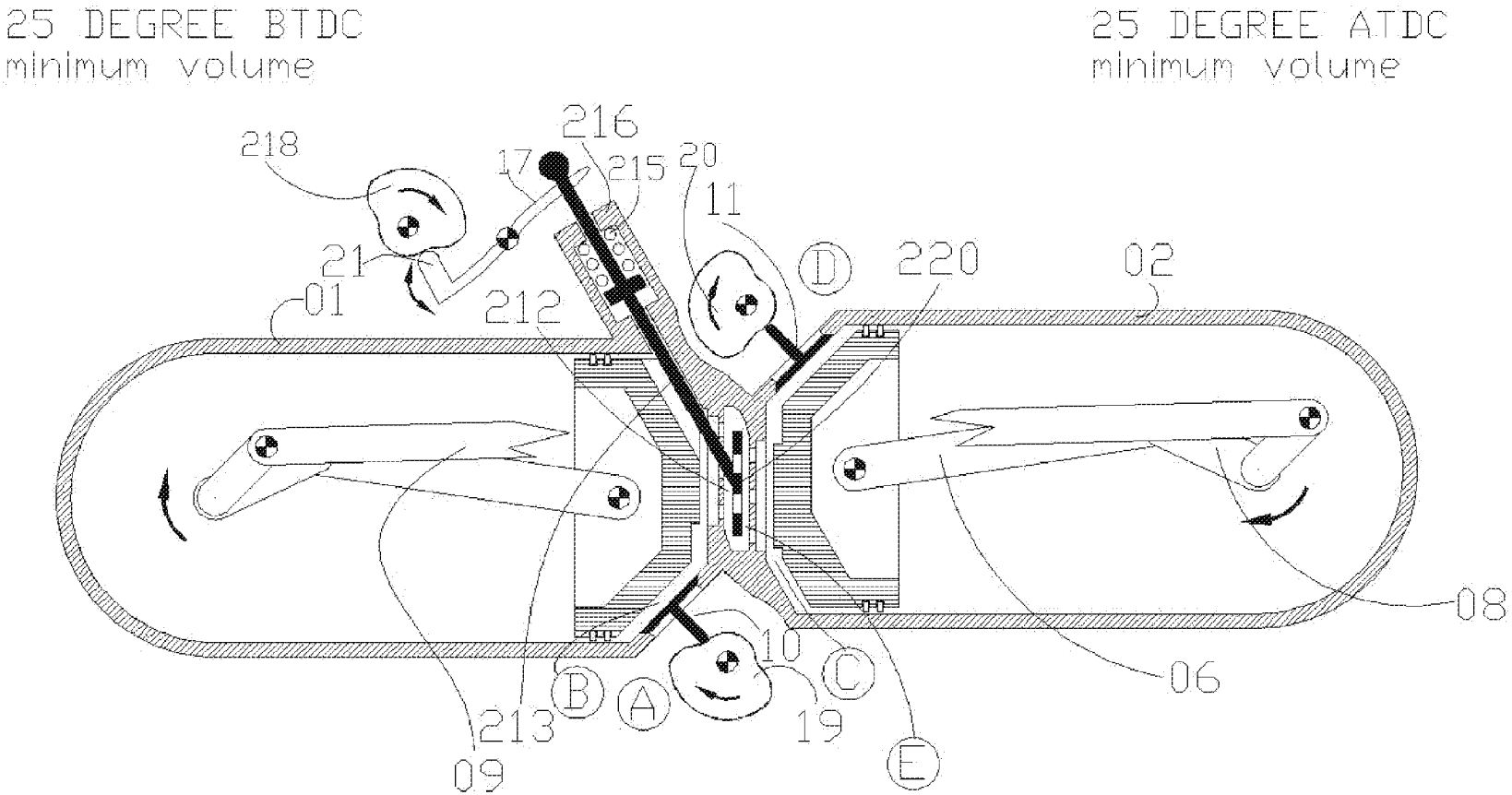
FIG. 16 is a simplified cross-sectional side view of a DPCE apparatus, in accordance with exemplary embodiments of the present invention, wherein the compression crankshaft angle is illustrated at 25 degrees before the compression piston reaches its Top Dead Center (TDC) and the power crankshaft angle is illustrated at a 5 degrees after the power piston reaches its TDC.
Figure 19C:
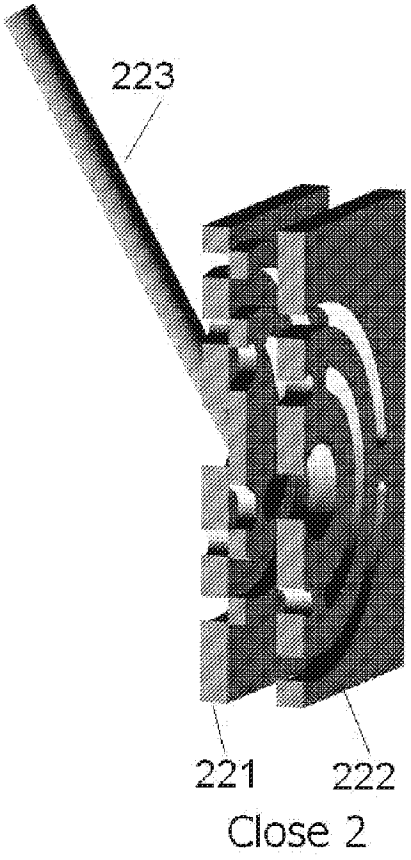
FIG. 19A-19C.
Figure 19B:
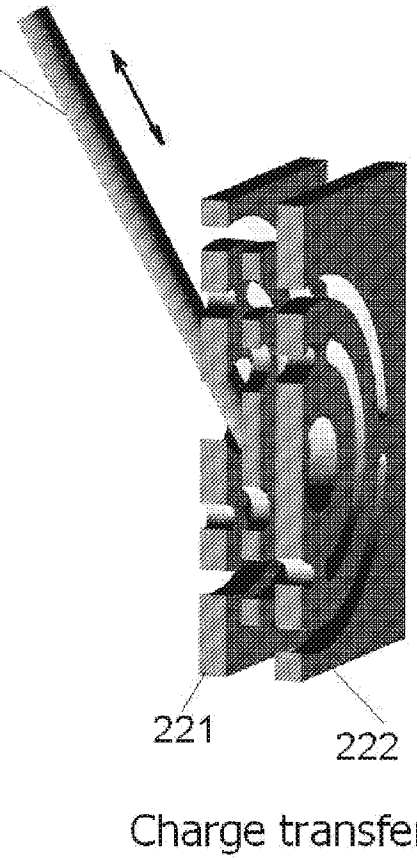
Figure 19A:
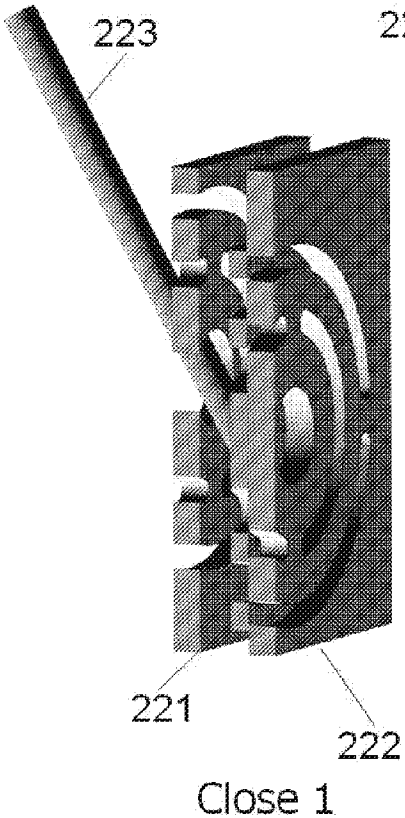

FIG. 16 is exemplary embodiments of the present invention having a Single Direction Close-Open-Close crossover valve (SDCOC crossover valve) equipped with Parallel Square Plate crossover valve (PSP crossover valve; see also FIGS. 18A-C for a 3D illustration) or Parallel Concentric Plate crossover valve (PCP crossover valve; see also FIGS. 19A-C for a 3D illustration). The PSP crossover valve and the PCP crossover valve may serve as crossover valve 12, and as an alternative to the Double Sided Axial Poppet valve (DSAP valve) that is illustrated in FIGS. 1 through 15. The SDCOC effective valve area is defined as the product of the element lift and the sum of the valve-seat peripheries (or transfer opening passage edges) less the guide and end contacting surfaces. Having SDCOC valve equipped with PSP or PCP type valves instead of poppet type valve, extend the sum of the valve-set peripheries, therefore increasing valve flow capacity and reducing the required valve displacement range, which in turn reduces accelerations. In general, since a split cycle crossover valve's required time span (i.e., from initial valve opening state to final valve close state) is approximately 2-6 times faster than the time span required in common internal combustion engine valves, reducing the needed valve displacement range may be beneficial to reducing the needed accelerations (for identical engine RPM). Utilizing SDCOC crossover valves (A DSAP valve and even to a further extant, the PSP or PCP crossover valves) technology reduces the needed accelerations and enables the use of smaller and lighter camshafts, rockers, valve steams etc. Reduces acceleration will also extend system life and reliability.

As will be readily recognized by one of ordinary skill in the art, apertures of different sizes and shapes could be used in place of the square and concentric shapes described above, without deviating from the scope of this disclosure.

Figure 17C:
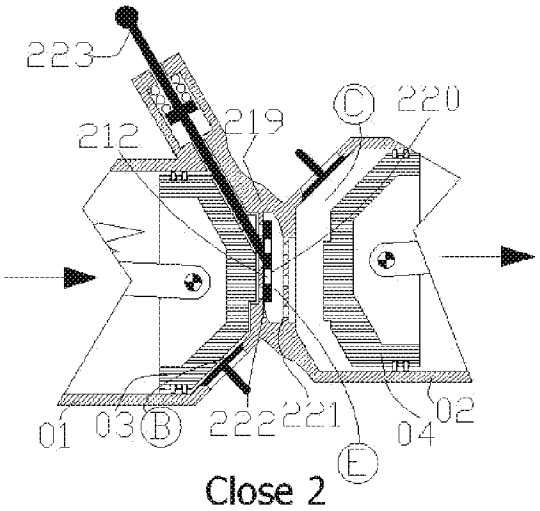
FIG. 17A-17C.
Figure 17B:
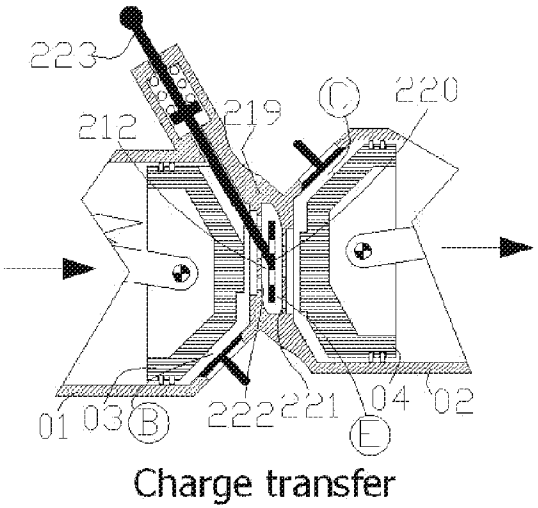
Figure 17A:
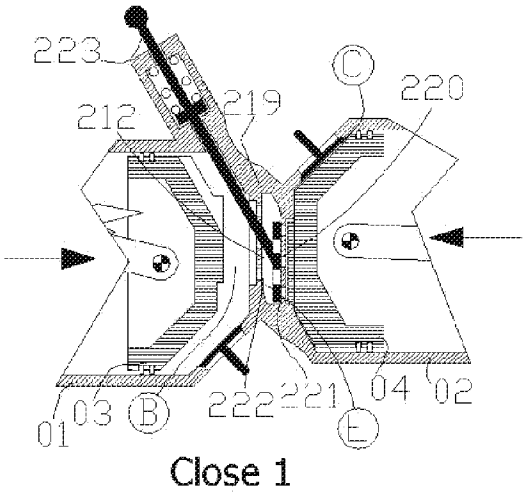
Figures 18A, 18B, 18C:
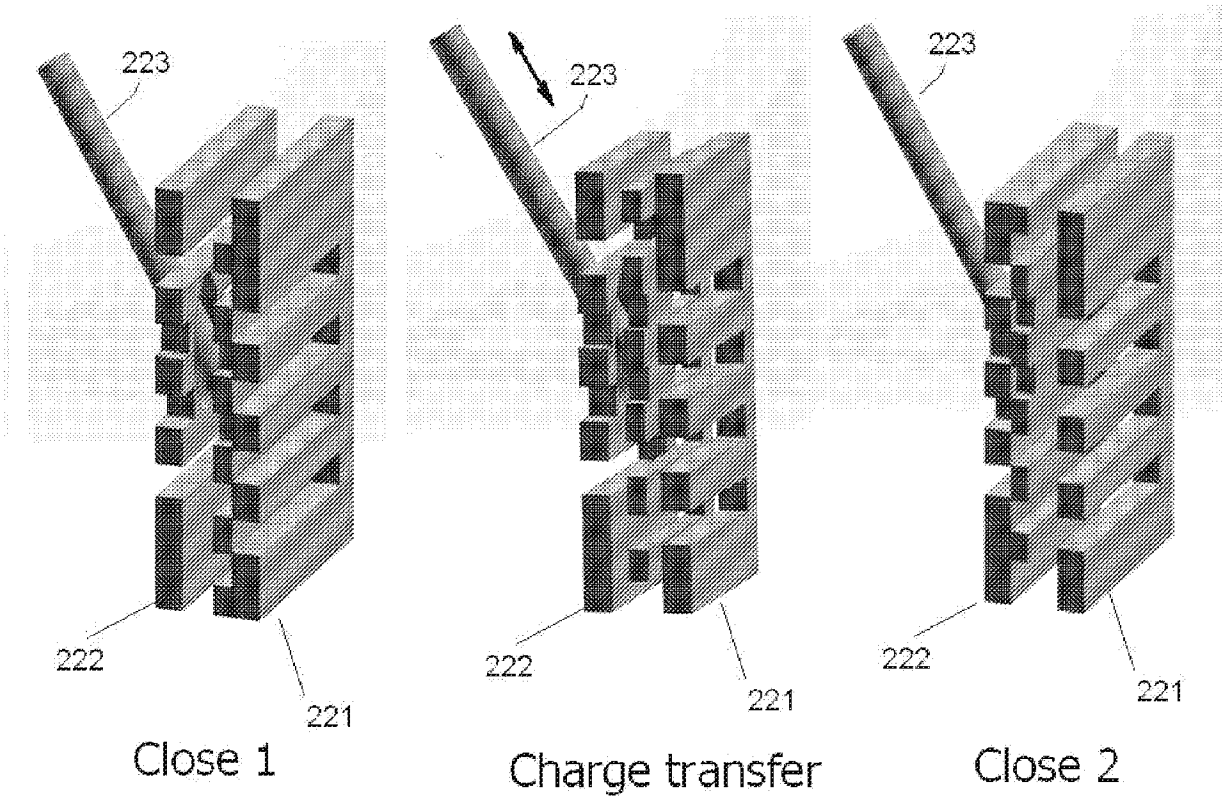
FIG. 18A-18C.

FIGS. 17A-C illustrate the present invention equipped with said PSP or PCP type crossover valves. In FIG. 17A plate valve 220 engages valve seat 221 therefore decouple compression chamber B and SDCOC internal volume E from power chamber C. FIG. 17B illustrates direct fluid communication between all three chambers i.e. chambers B, E and C, valve plate 220 does not engage valve seat 221 nor valve seat 222. In FIG. 17C, plate valve 220 engages valve seat 222 and thus decouple power chamber C and SDCOC internal volume E from compression camber B. SDCOC valve equipped with PSP valve or PCP valve, rather than with a DSAP valve may reduce valve acceleration magnitude by 30 to 40 percent. To a lesser degree, the apertures may reduce the gap between the valve head and the chamber walls.

Similar advantages may be achieved with valves having different apertures.

FIGS. 18A-C and 19A-C respectively illustrates PSP and PCP 3D partial section valves, both figures retain same relevant component number and same function description as is outlined above for FIGS. 17A-C.

As will be understood by those of skill in the art, the actuation of a SDCOC valve could be made with many different actuation principles without deviating from the scope of the disclosure. For example, but not by way of limitation, a rocker may push the rod (as opposed to pull), the follower could run in a grove placed on the cam that would make it a push/pull mechanism, pneumatic actuation, desmodromic actuation, or electromagnetic.

In some embodiments, during compression stroke, prior to crossover valve crack to open event, compression pressure pushes sealing valve member toward close position one.

Some embodiments may include an optional crossover bypass valve (as described herein). During compression stroke, a few compression piston crankshaft degrees prior to a predetermined crossover valve crack to open event, a crossover bypass valve opens thus lowering (or equalize) the differential pressure across both sides of the crossover valve. Lowering said differential pressure reduces the force required to initiate crossover valve crack to open movement.

In some embodiments, high combustion cylinder pressure during the early combustion period may push crossover valve toward close position two.

As noted herein, existence of dead volume within split-cycle engines harms engine performance and efficiency. Previous art crossover valve mechanisms inherently incorporate significant amount of dead volume. This is not the case with the crossover valves described here because when the power piston reaches its top dead center (end of exhaust stroke) the crossover valve seals on close position 1 located on the power chamber surface, therefore no significant power cylinder dead volume exist. In addition, when the compression piston reaches its top dead center (end of compression stroke), the crossover valve seals on close position 2 located on the compression chamber surface therefore no significant compression cylinder dead volume exist.

As known in the art, most four stroke internal combustion intake and exhaust valves operate as follow: Rotating camshaft pushes poppet valve stem against squeezed coil spring force so as to force the valve to move to its full open position. As the camshaft continuous to rotate, the camshaft outer circumference profile allows the valve stem to be retracted, now pushed back by the coil spring expansion into its initial valve close position. In common intake and exhaust valves, the above described valve cycle movement (i.e. movement toward full open and back to close position), takes about 180 degrees crankshaft rotation, which is enough time to complete the valve function without over stressing the valve structure and its mechanical operating system.

Since split-cycle crossover valve operation time (from initial open to final close) is much shorter than common intake and exhaust valve operation, the crossover valve cycle should be completed faster (20-60 degrees crankshaft compared to 180 degrees for common intake and exhaust valve). Therefore already known in the art intake and exhaust valves operation methods cannot be implemented without serious damaging the split-cycle crossover valve structure, which reduces its endurance properties.

In some embodiment, the crossover valves described herein implement a unidirectional movement (instead of bidirectional movement) to moves the valve from close to open and back to close (close1 to open to close2 in a unidirectional movement), which in turn dramatically reduced the involved acceleration forces. This improves the valve mechanical endurance properties. The reset of the SDCOC crossover valves to its initial close position (close1 position) is performed later in the cycle at or around the beginning of the exhaust and compression strokes.

Referring now to exemplary mechanical crossover valve as illustrated in cross sectional drawings at FIGS. 20A-E. FIG. 20A illustrates a cross section of a crossover valve that depicts the various parts (components) that may generally include main valve body 319, power side (chamber C) sealing surface 321 (valve seat 321), and compression side (chamber B) sealing surface 322 (valve seat 322). It also depicts two Single-Sided-Axial-Poppet (SSAP) SSAP valves, the first is SSAP valve 320A, which is depicted in FIG. 20A in the open position (but may be seated on valve seat 322; see FIG. 20C). The second is SSAP valve 320B, which is depicted in FIG. 20A in the close 1 position, while seating on valve seat 321. It also contains chamber E, which is located within the crossover valve. Chamber E borders are valve body 319, upstream to (the right of) valve seat 322 and downstream to (the left of) valve seat 321. The compression side includes compression cylinder 01 and a compression piston 03. The power side includes a power cylinder 02 and a power piston 04. Compression piston 03 may be connected to power piston 04 by a rod and crankshafts, in a similar manner to the DPCE described above with respect to FIGS. 1-13.

In FIG. 20A, SSAP valve 320A is open and therefore chamber E is fluidly coupled to chamber B with neglectable pressure differential between the two chambers. As illustrated in FIG. 20A, SSAP valve 320B engages sealing surface 321 and thus decouples chambers B and E from chamber C. FIG. 20B illustrates both SSAP valves 320A and 320B and valve body 319 in relative position such that neither sealing valve seat 321 nor sealing valve seat 322 seals, thus enabling compression chamber B and power chamber C reciprocate fluid exchange through chamber E, for example, to transfer the compressed working fluid from chamber B to chamber C. Thus, FIG. 20B illustrates SSAP valves 320A and 320B positioning that cause the crossover valve to be in its open state. FIG. 20C illustrates SSAP valve 320A engaging sealing surface 322 and thus decoupling chamber B from chambers C and E. In FIG. 20C, Chamber E is fluidly coupled to chamber C with neglectable pressure differential between the two chambers. FIG. 20D illustrates SSAP valve 320A sealing surface 322 and SSAP valve 320B sealing surface 320B and, thus, sealing Chamber B from Chamber E, Chamber C from Chamber E, and Chamber B from Chamber C.

Although referred here as a "single-sided" valve, one of ordinary skill in the art will readily recognize that a valve with two sealable faces may be employed without deviating from the scope of this disclosure. As used with respect to FIGS. 20A-E, a "single-sided valve" refers to utilizing only one face of the valve to seal (either the sealing surface on the compression side or the piston side).

As described, the mechanical crossover valve of FIGS. 20A-E may separate compression chamber B and power chamber C. In these situations each chamber may include regions of different fluid pressure. Having dead volume in a split-cycle engine can significantly reduce the engine efficiency. Minimizing the dead volume may be beneficial in split-cycle engines in general and in DPCE split-cycle engines, in particular. In a typical split-cycle engine there are at least 3 potential locations of dead volume, and for ease of description the current DPCE split-cycle design will be used as an example. The 3 potential locations of dead volume are: 1) When compression piston 03 is at its TDC (FIG. 20C), any residual volume at chamber B is considered dead volume since it will hold compressed working fluid that would not be transferred to Chamber C to participate in the power (combustion) stroke; 2) When power piston 04 is at its TDC (FIG. 20A), any residual volume at chamber C is considered dead volume since it will cause a partial decompression of the working fluid at chamber B when the crossover valve opens (decompression of the working fluid prior to combustion reduces efficiency); and 3) Any portion of the volume within chamber E that hold working fluid that is being prevented to participate in the power (combustion) stroke is considered dead volume as not having this working fluid combusted reduces efficiency. The mechanical crossover valve as illustrated in FIG. 20A-E reduces all the 3 sources of dead volume that were described above: 1) When compression piston 03 is at its TDC (FIG. 20C) in maximal proximity to the cylinder head, and SSAP valve 320A is placed on valve seat 322 (FIG. 20C). Almost all of the working fluid is transferred to chamber E, which is fluidly coupled to C, to participate in the power (combustion) stroke; 2) When power piston 04 is at its TDC (FIG. 20A), in maximal proximity to its cylinder head, and SSAP valve 320B is placed on valve seat 321, the dead volume at chamber C is reduced. Therefore, when SSAP valve 320B cracks open (FIG. 20B), almost no decompression of the working fluid occurs at chambers E, which is fluidly coupled to B occurs. Avoiding decompression of the working fluid prior to combustion prevents reduced efficiency; and 3) At the end of the charge transfer from chamber B to Chamber C (FIG. 20C), chamber E is in direct fluid connection with chamber C. Therefore, all the working fluid within chamber E is participating in the combustion (power) stroke.

An exemplary embodiment of a mechanical crossover valve will now be discussed with reference to FIGS. 20A-E. The mechanical crossover valve may be used in a similar manner as crossover valve 12 in the embodiments described above with respect to FIGS. 1-13 and for illustrative purposes the following description of the mechanical crossover valve of FIGS. 20A-E may refer to elements mentioned above in connection with FIGS. 1-13 as well. Since FIGS. 20A-E attempt to illustrate the thermodynamic cycle in five steps what FIGS. 1-13 demonstrated in 13 steps, reference may be made to the description of FIGS. 1-13 for more explanation. In addition, similar cam mechanisms may be used to control the timing of SSAP valves 320A and 320 B, with modifications to account for differences in timing.

It should be understood that use of the mechanical crossover valve of FIGS. 20A-E is not limited to the embodiments described above with respect to FIGS. 1-13, but may be used in other applications, including other types of double piston cycle engines, In-line split-cycle engines with one or two crossover valves, other split-cycle engines, four-stroke engines, rotary engines and compressors, for example. Both SSAP valves 320A and 320B are Single Direction Close-Open Valves (SDCO valves) with similar advantages to those that were described for Single Direction Close-Open-Close crossover valve (SDCOC crossover valve). The properties of a pair of Single Direction Close-Open Valves (SDCO valves) that are operated in sequence as described above and in FIG. 20 A-E, for example, are advantageous to any system that requires the utilization of a very fast operating valve. Since any known split cycle engine uses at least one crossover valve, and since those crossover valves operation requirements are about 2-6 times faster than common IC engine valve, the use of a pair of Single Direction Close-Open Valves (SDCO valves), as part of any split cycle engine, is of great value.

Referring to FIG. 20A, the mechanical crossover valve may generally include main valve body 319 and both SSAP valves 320A and 320B. When used in the embodiments of FIGS. 1-13, the mechanical crossover valve may separate compression chamber B and combustion chamber C. In this situation each chamber may include regions of different fluid pressure. Within the mechanical crossover valve, the movement of both SSAP valves 320A and 320B relative to the main valve body 319 may allow the coupling or decoupling of fluid communication between chamber B and chamber C. As illustrated in FIG. 20A, SSAP valve 320B seals against power cylinder side's sealing seat 321 of valve body 319, which may prevent high pressure fluid transfer from compression chamber B into power chamber C (passing through chamber E). FIG. 20C is a cross-sectional view of the mechanical crossover valve. As illustrated in FIG. 20C when SSAP valve 320A seals against compression cylinder side's sealing seat 322 of valve body 319, high pressure working fluid is blocked from being transferred back from power chamber C into compression chamber B (passing through chamber E).

FIG. 20B is a cross-sectional view of the mechanical crossover valve. In a similar fashion to crossover valve 12 described with reference to FIGS. 5-8, as power piston 04 approach its TDC, SSAP valve 320B opens due to the rotation of its dedicated cam. As noted above, the cam structure may be similar to cam (18) depicted in FIG. 5. The rotation of its dedicated cam may cause SSAP valve 320B to leave its seat on sealing surface 321 of valve body 319 and to crack open (see FIG. 6 for an exemplary cam structure). This may lead to a working fluid flow from chamber B via chamber E to chamber C (see FIGS. 5-8 for similar arrangement). The cracking of SSAP valve 320B creates a sharp drop in pressure differential magnitude across the SSAP valve 320B as to almost equalize the pressure of chambers B, E and C.

FIG. 20B is a cross-sectional view of the mechanical crossover valve. In a similar fashion to FIG. 7, as power piston 04 continues its movements away from TDC, the mechanical crossover valve remain open allowing the continuation of fluid transfer from compression chamber B into power chamber C. FIG. 20B also depicts an example of when combustion initiation occurs and combustion develops.

In a similar fashion to FIGS. 7 and 8, when power piston 04 continues its movements away from TDC, combustion in the power cylinder causes sharp increase in chamber C pressure. Referring to the part numbers depicted in FIG. 20, but the engine positions as illustrated in FIGS. 7 and 8, SSAP valve 320A, which is controlled by its own cam, (similar to cam 18 of FIGS. 1-13) initiates SSAP valve 320A cam actuated movement toward valve sealing seat 322 and is seated on seat 322 (FIG. 20C). This movement may be supported by sudden chamber C pressure burst (combustion) which may help push SSAP valve 320A in the same direction. From this stage onward, engine power stroke carries on at chamber C (see FIGS. 8-11 for a similar arrangement) while intake may start at chamber B by the opening of the intake valve 10.

Referring to FIG. 20D, and to the similar process illustrated in FIGS. 10 and 11, when power piston 04 approaches its Bottom Dead Center (BDC), and slightly before, at, or slightly after, the exhaust valve opens (and the burnt gaseous exhale, and chamber C high pressure diminishes), SSAP valve 320B may close by returning to seat 321. Referring to the part numbers depicted in FIGS. 20A-E, but to the engine positions as illustrated in FIG. 12, following exhaust valve 11 opening, as can be seen in FIG. 12, SSAP valve 320B leaves its open position and moves back (reset, stage 1) to seat on sealing surface 321 of valve body 319 (close 1 position), as can be seen in FIG. 13 and FIG. 20D. This is stage 1 of the reset process. This movement is again due to the rotation of its dedicated cam (18) (see FIGS. 11-13). Once SSAP valve 320B seals against sealing seat 321, the crossover valve decouples fluid passage between compression chamber B and power chamber C by both SSAP valves 320A and 320B.

Referring to FIG. 20E, as compression piston 03 moves away from its BDC and the compression stroke commences, SSAP valve 320A may leave valve seat 322 to fluidly couple chamber B and chamber E. This transition is the second stage of resetting (reset, stage 2). This completes the resetting of both SSAP valves 320A and 320B positioning to that which is described in FIG. 20A, enabling the execution of the next engine cycle. Notice that during the reset process (both stage 1 and stage 2, FIGS. 20 D and E), there is no fluid passage between compression chamber B and power chamber C, which may be advantageous. However, if in some cases, such a fluid passage between compression chamber B and power chamber C is desired, this could be achieved by having, at the desired point in time, both SSAP valves 320A and 320B open. Using both SSAP valves 320A and 320B to govern the fluid passage between compression chamber B and power chamber C adds superior control capabilities.

It should be noted that during SSAP valve 320B opening, as illustrated FIGS. 20 A-B (see also the similar arrangement illustrated and discussed with respect to FIGS. 5 through 8), the SSAP valve 320B moves in one direction while alternating between closed and opened position, without the need to close again as typically is required from a common IC engine poppet valve. Moreover, SSAP valve 320B moves half the distance moved by DSAP valve 120 (FIG. 14 A-C) during a thermodynamic cycle. The combined operation of both SSAP valves 320A and 320B is advantageous since it has a first closed position with the SSAP valve 320B sealing on the surface 321 valve seat of power cylinder head (Close 1 position), an open position in which both SSAP valves 320A and 320B are not seated on any cylinder wall or cylinder head (and working fluid can pass from the compression cylinder to the power cylinder through the opening around the valve), and a second closed position with the SSAP valve 320A sealing on the sealing seat 322 of the compression cylinder head (Close 2 position). Hence, during the critical time of charge transfer from chamber B via Chamber E to chamber C (FIGS. 5-8) only SSAP valve 320B state needs to change from close to open (without the need to close again) while moving in only one direction, followed by SSAP valve 320A state change from open to close (without the need to open again). Notice that both SSAP valves 320A and 320B need to travel a relatively short distance (compared to DSAP valve 120), and that there could be also an overlap in their motions, which can greatly shorten the time needed in order to complete the process described in FIG. 5-8. This in turn, may enable execution of the engine cycle with a smaller phase lags, between the power and compression pistons, enabling achieving higher compression ratios, which in turn enable the use of diesel fuels and CI ignition. The one directional movement, the faster execution, and the shorter travel of both SSAP valves 320A and 320B, has significant advantages over conventional poppet valves since its operation involves less inertia forces. The conventional poppet valves need to reverse the direction of their movement and overcome larger inertia forces.

In some embodiments, both SSAP valves 320A and 320B described in FIG. 20 A-E could be instead of being a SSAP valve type with a solid head, may comprise one or more apertures, such as one or more of the PSP and PCP valve types described above with respect to FIGS. 18 A-C and 19 A-C, respectively.

Although not described above with respect to FIGS. 1-20, a combustion or compression piston may include a protrusion configured to lightly touch the valve so as to facilitate opening of the valve, in a similar fashion to the pistons described below with respect to FIGS. 21-44.

FIGS. 21-33 describe another embodiment of a DPCE with a crossover (or "interstage") valve. Although there are a number of similarities between the timing and positioning of components in FIGS. 1-13, a full description of the operation of the DPCE is repeated here for clarity.

Figure 21:
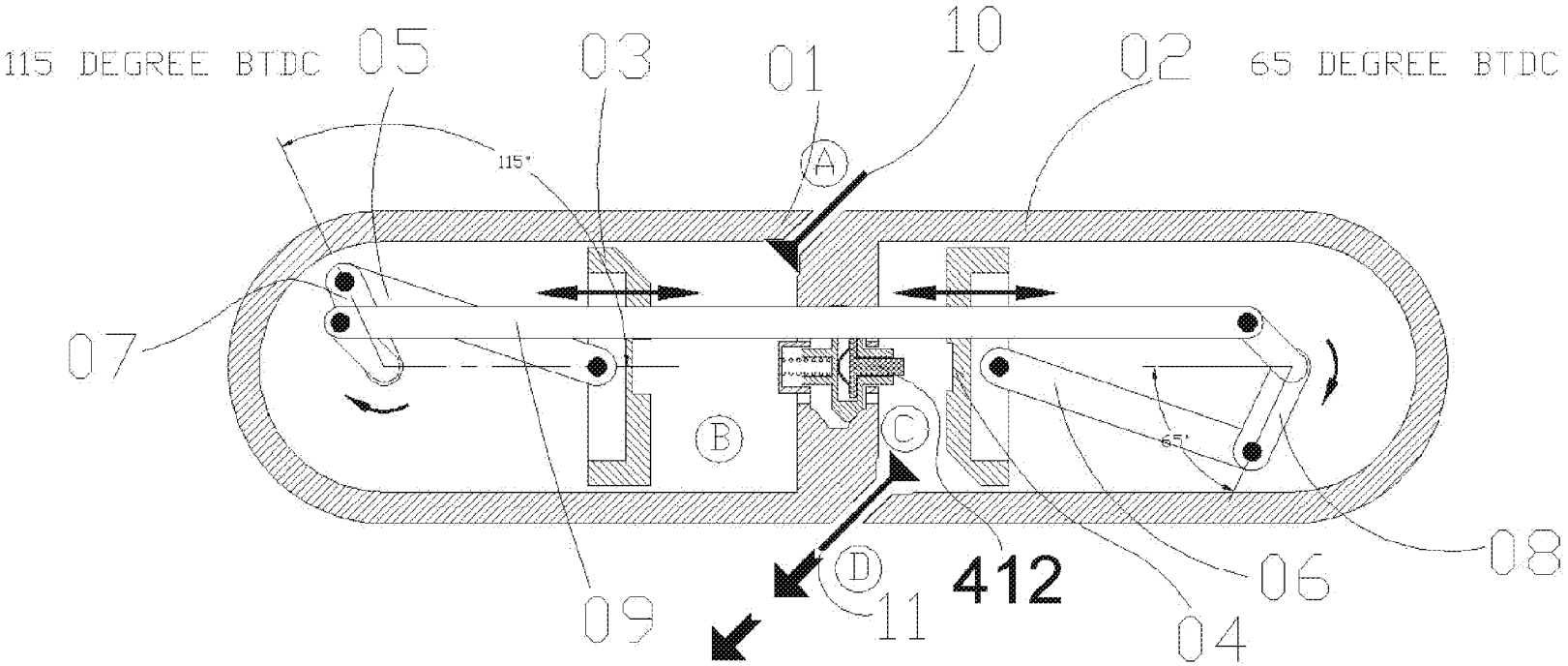
FIG. 21 is a simplified cross-sectional side view of a DPCE apparatus, in accordance with exemplary embodiments of the present invention, wherein the compression crankshaft angle is illustrated at 115 degrees before the compression piston reaches its Top Dead Center (TDC) and the power crankshaft angle is illustrated at 65 degrees before the power piston reaches its TDC.
Figure 22:
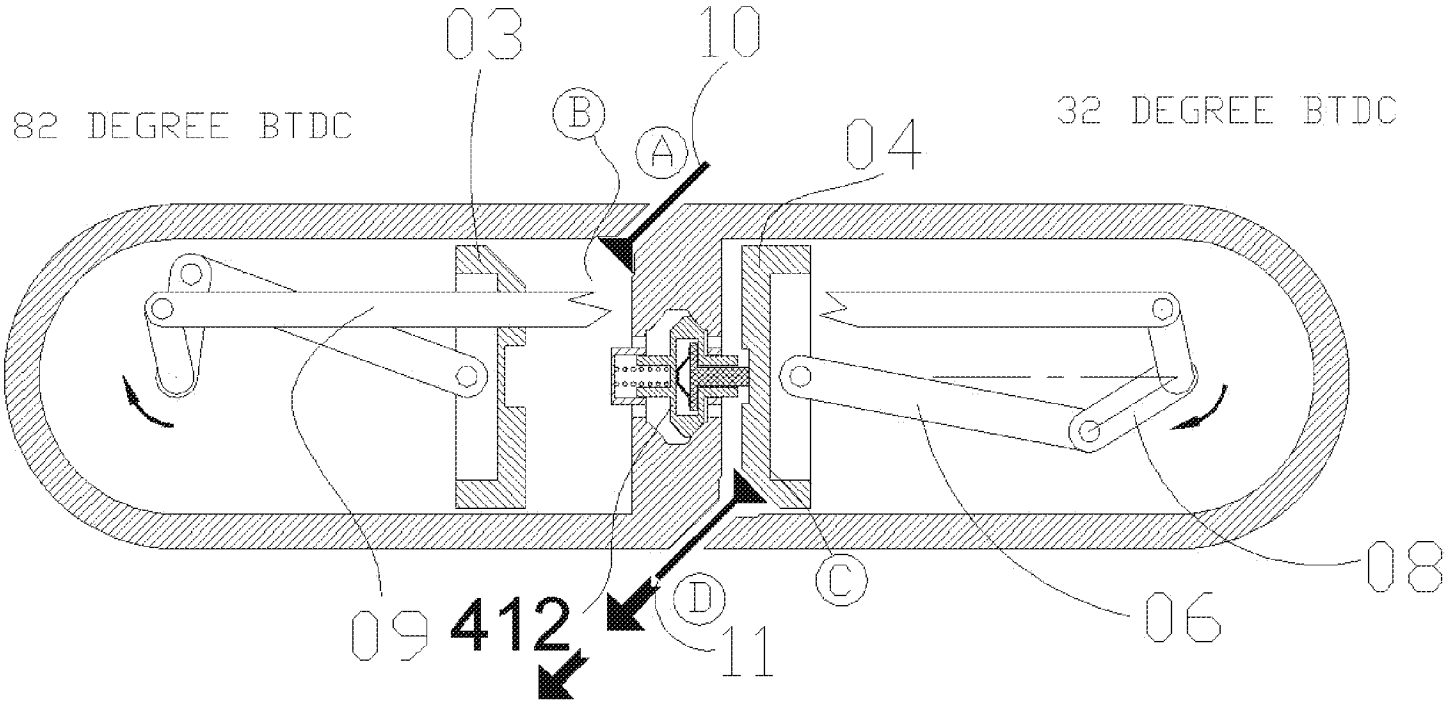
FIG. 22 is a simplified cross-sectional side view of the DPCE apparatus of FIG. 21, wherein the compression crankshaft angle is illustrated at 82 degrees before its TDC and the power crankshaft angle is illustrated at 32 degrees before the power piston reaches its TDC.
Figure 23:
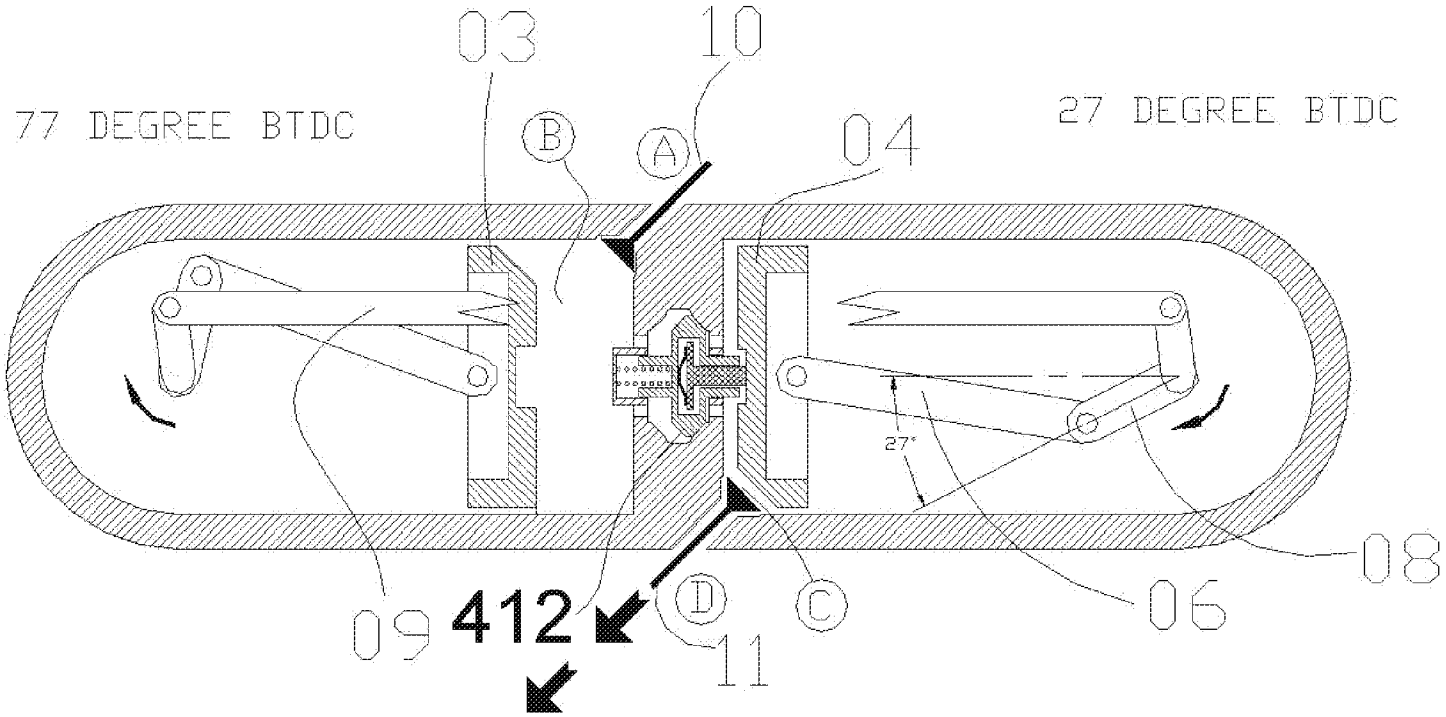
FIG. 23 is a simplified cross-sectional side view of the DPCE apparatus of FIG. 21, wherein the compression crankshaft angle is illustrated at 77 degrees before its TDC, and the power crankshaft angle is illustrated at 27 degrees before the power piston reaches its TDC.
Figure 24:
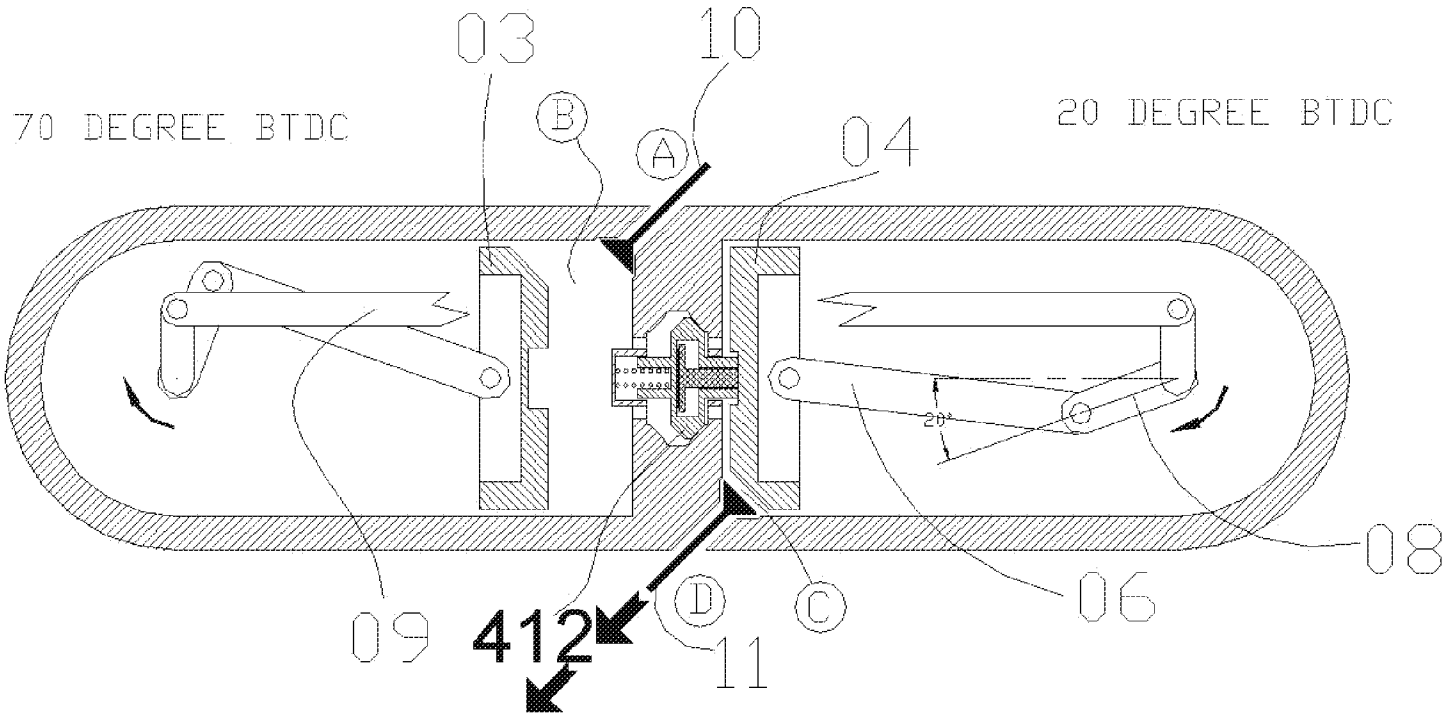
FIG. 24 is a simplified cross-sectional side view of the DPCE apparatus of FIG. 21, wherein the compression crankshaft angle is illustrated at 70 degrees before its TDC, and the power crankshaft angle is illustrated at 20 degrees before the power piston reaches its TDC.
Figure 25:
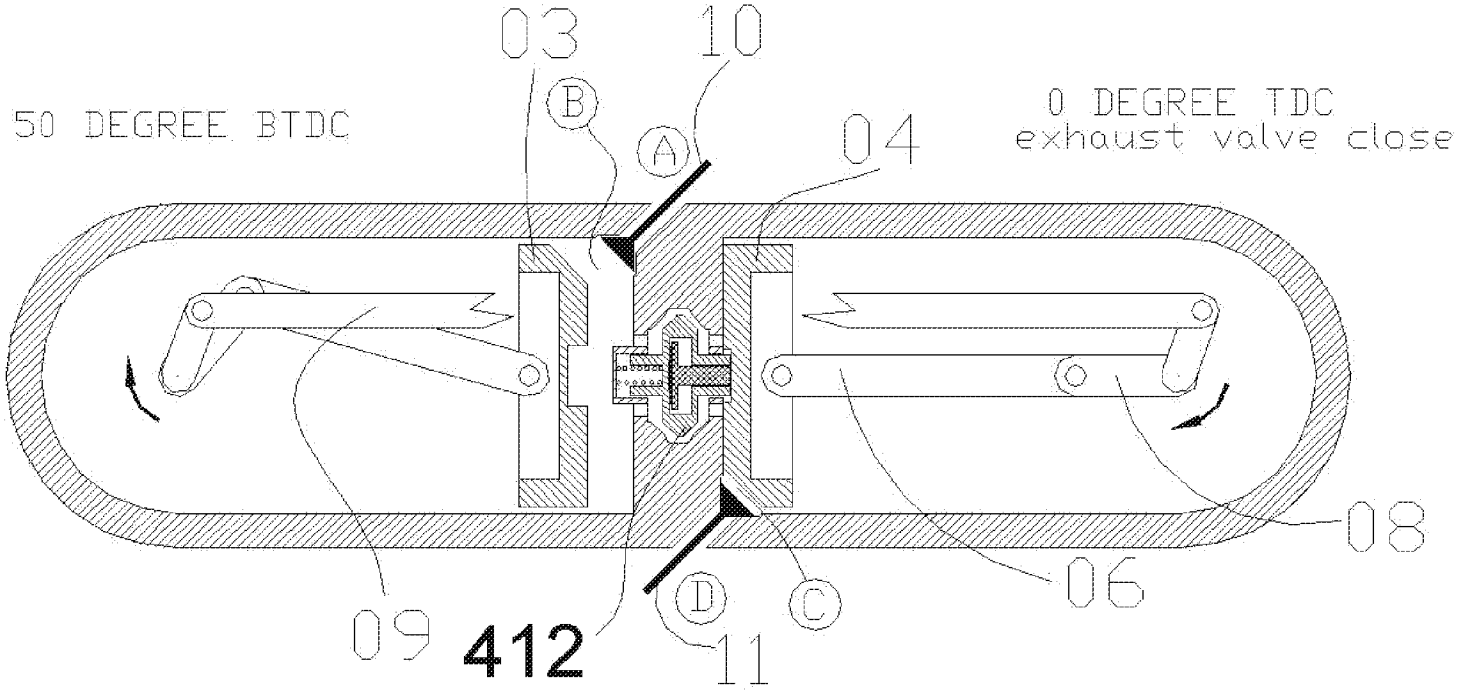
FIG. 25 is a simplified cross-sectional side view of the DPCE apparatus of FIG. 21, wherein the compression crankshaft angle is illustrated at 50 degrees before its TDC, and the power crankshaft angle is illustrated at its TDC.

Referring to FIG. 21, in accordance with one embodiment of the present invention, a DPCE cylinder includes: a compression cylinder 01, a power cylinder 02, a compression piston 03, a power piston 04, two respective piston connecting rods 05 and 06, a compression crankshaft 07, a power crankshaft 08, a crankshaft connecting rod 09, an intake valve 10, an exhaust valve 11 and an interstage valve 412. The compression cylinder 01 is a piston engine cylinder that houses the compression piston 03, the intake valve 10, part of the interstage valve 412 and optionally a spark plug (not shown) located in front of the surface of compression piston 03 facing the compression chamber in cylinder 01. The power cylinder 02 is a piston engine cylinder that houses the power piston 04, the exhaust valve 11, part of the interstage valve 412 and optionally a spark plug (not shown) located in front of the surface of the power piston facing the combustion chamber in cylinder 02. The compression piston 03 serves the intake and the compression engine strokes. The power piston 04 serves the power and the exhaust strokes. The connecting rods 05 and 06 connect their respective pistons to their respective crankshafts. The compression crankshaft 07 converts rotational motion into compression piston 03 reciprocating motion. The reciprocating motion of the power piston 04 is converted into rotational motion of the power crankshaft 08, which is converted to engine rotational motion or work (e.g., the power crankshaft may also serve as the DPCE output shaft). The crankshaft connecting rod 09 translates the rotation of power crankshaft 08 into rotation of the compression crankshaft 07.

In exemplary embodiments, predetermined phase delay is introduced via the crankshafts 07 and 08, such that power piston 04 moves in advance of compression piston 03.

In exemplary embodiments of the present invention, the intake valve 10 is composed of a shaft having a conic shaped sealing surface, as is commonly known in the art. The intake valve 10, located on the compression cylinder 01, governs the naturally aspirated ambient air or the carbureted air/fuel charge, or forced induction of the charge, as they flow into the compression cylinder 01. The compression cylinder 01 has at least one intake valve. In some embodiments of the present invention, the intake valve location, relative to the position of compression piston 03, function, and operation may be similar or identical to the intake valves of conventional four-stroke internal combustion engines. The location of the compression piston 03 when the intake valve opens may vary. In some embodiments of the present invention, the timing of the opening of the intake valve may vary. In one example, the intake valve may open within the range of a few crankshaft degrees before the compression piston 03 reaches its TDC through approximately 50 crankshaft degrees after the compression piston 03 reaches its TDC. In one example, the intake valve may close within the range of a few crankshaft degrees after the compression piston 03 reaches its Bottom Dead Center (BDC) through approximately 70 crankshaft degrees after the compression piston 03 reaches its BDC.

In exemplary embodiments of the present invention, the exhaust valve 11 is composed of a shaft having a conic shaped sealing surface, as is commonly known in the art. The exhaust valve 11, located on the power cylinder 02 governs the exhalation of burned gases. The power cylinder 02 has at least one exhaust valve. In some embodiments, the exhaust valve location, functions and operation method may be similar or identical to exhaust valves of conventional four-stroke internal combustion engines. The location of the power piston 04 when the exhaust valve opens may vary. In some embodiments, the exhaust valve may open approximately 60 crankshaft degrees before power piston 04 reaches its BDC through approximately 20 crankshaft degrees after power piston 04 reaches its BDC. The location of the power piston 04 when the exhaust valve closes may vary. In some embodiments, the exhaust valve may close approximately 15 crankshaft degrees before power piston 04 reaches its TDC through approximately 5 crankshaft degrees after power piston 04 reaches its TDC.

In one embodiment, the interstage valve 412 is composed of the following components. First, a valve body. Second, a Double-Sided-Axial-Poppet (DSAP) valve capable of decoupling the two chambers by sealing the interstage valve on either side. Third, a Spring-Plunger Component (SPC) (consisting of a disc spring in some embodiments, but other biasing element mechanisms could be utilized), and forth an additional Bias Mechanism Component (BMC) biasing the DSAP valve to seal on the side closer to the power cylinder. When the power piston moves towards its TDC, the DSAP valve is sealed on its power-cylinder side due to the interstage valve BMC and the pressure build-up in the compression cylinder. When the power piston approaches TDC it creates contact with the spring-plunger component (SPC) of the interstage valve and pushes the SPC. After compressing the SPC, and still before the power piston reaches its TDC, the power piston reaches and pushes also the DSAP valve, cracking it open, resulting in pressure leveling between the two chambers (Chambers B and C). This pressure leveling enables the SPC to expand and farther push the DSAP valve toward the compression cylinder, opening the interstage valve further. Combustion in the power-cylinder pushes the DSAP valve farther still, sealing interstage valve 412 by placing the DSAP valve on its opposite sealing surfaces (valve seat), i.e., the ones closer to the compression cylinder. During the beginning of the engine exhaust stroke, when burned working fluid is exhaled, power cylinder pressure sharply reduces. Consequently, the preloaded BMC pushes the DSAP valve back and resets the DSAP valve to its initial sealing surfaces, i.e., the ones closer to the power cylinder, while closing interstage valve 412.

In some embodiments, the plunger and other features which contact the combustion piston may more generally be termed a contact element, encompassing other structures for performing equivalent functions as those described above. Also, the springs may more generally be termed biases, encompassing other structures for performing equivalent functions as those described above.

Figure 28:
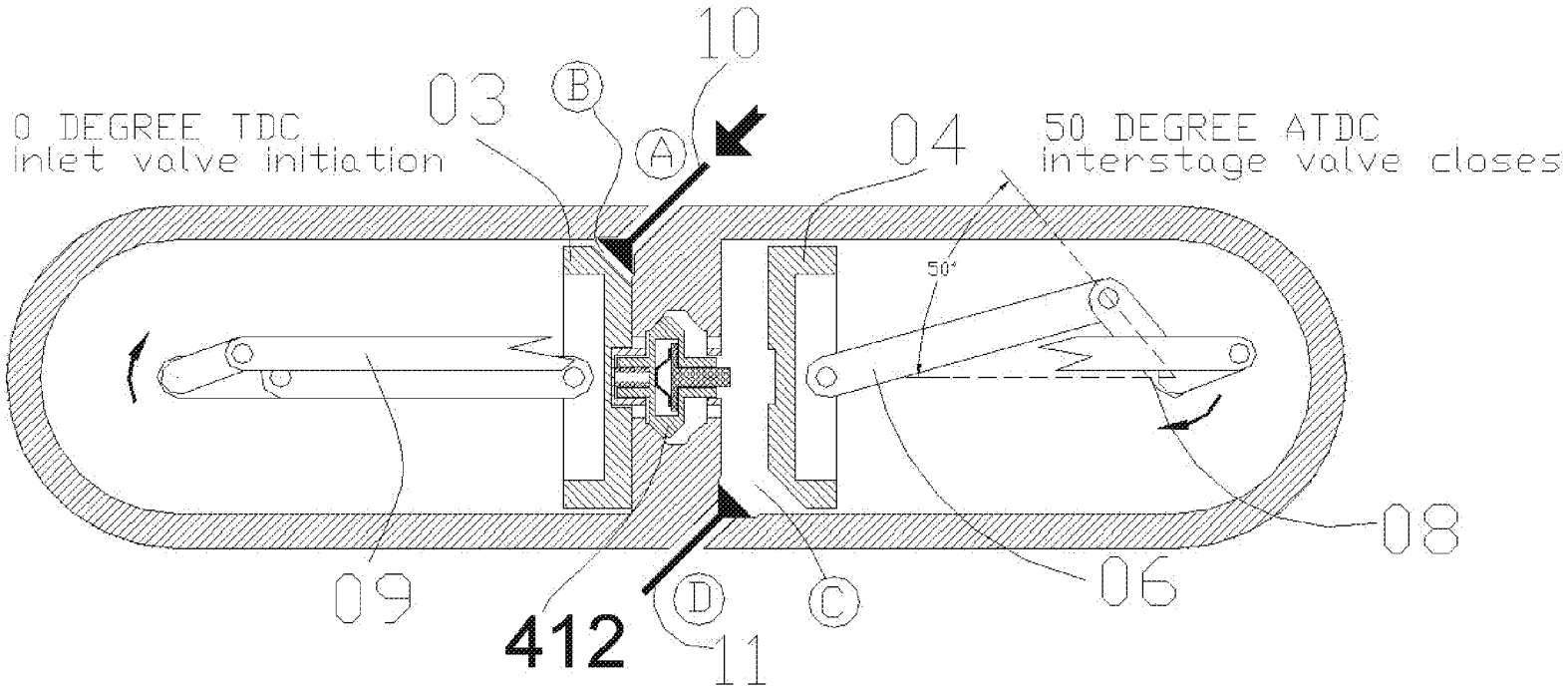
FIG. 28 is a simplified cross-sectional side view of the DPCE apparatus of FIG. 21, wherein the compression crankshaft angle is illustrated at Bottom Dead Center (BDC). and the power crankshaft angle is illustrated at 50 degrees after its TDC.
Figure 29:
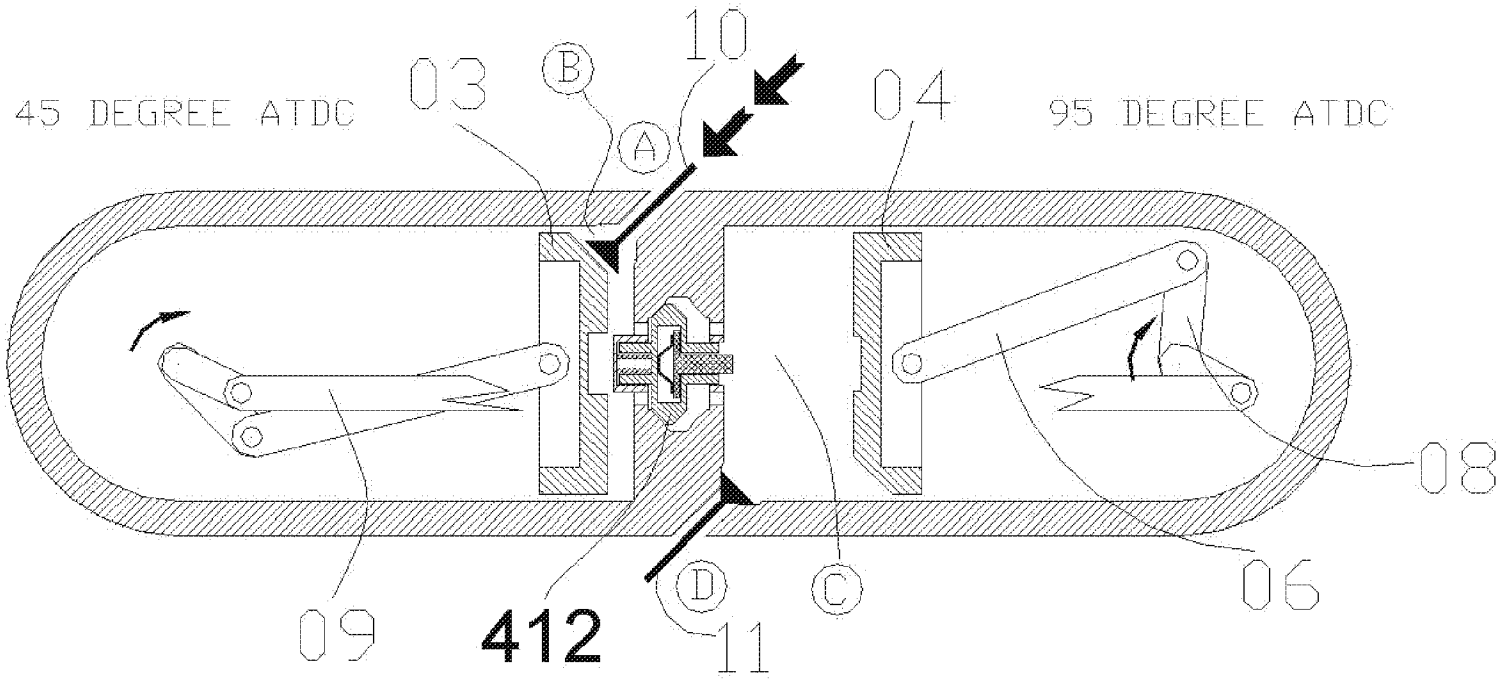
FIG. 29 is a simplified cross-sectional side view of the DPCE apparatus of FIG. 21, wherein the compression crankshaft angle is illustrated at 45 degrees after its TDC, and the power crankshaft angle is illustrated at 95 degrees after its TDC.
Figure 30:
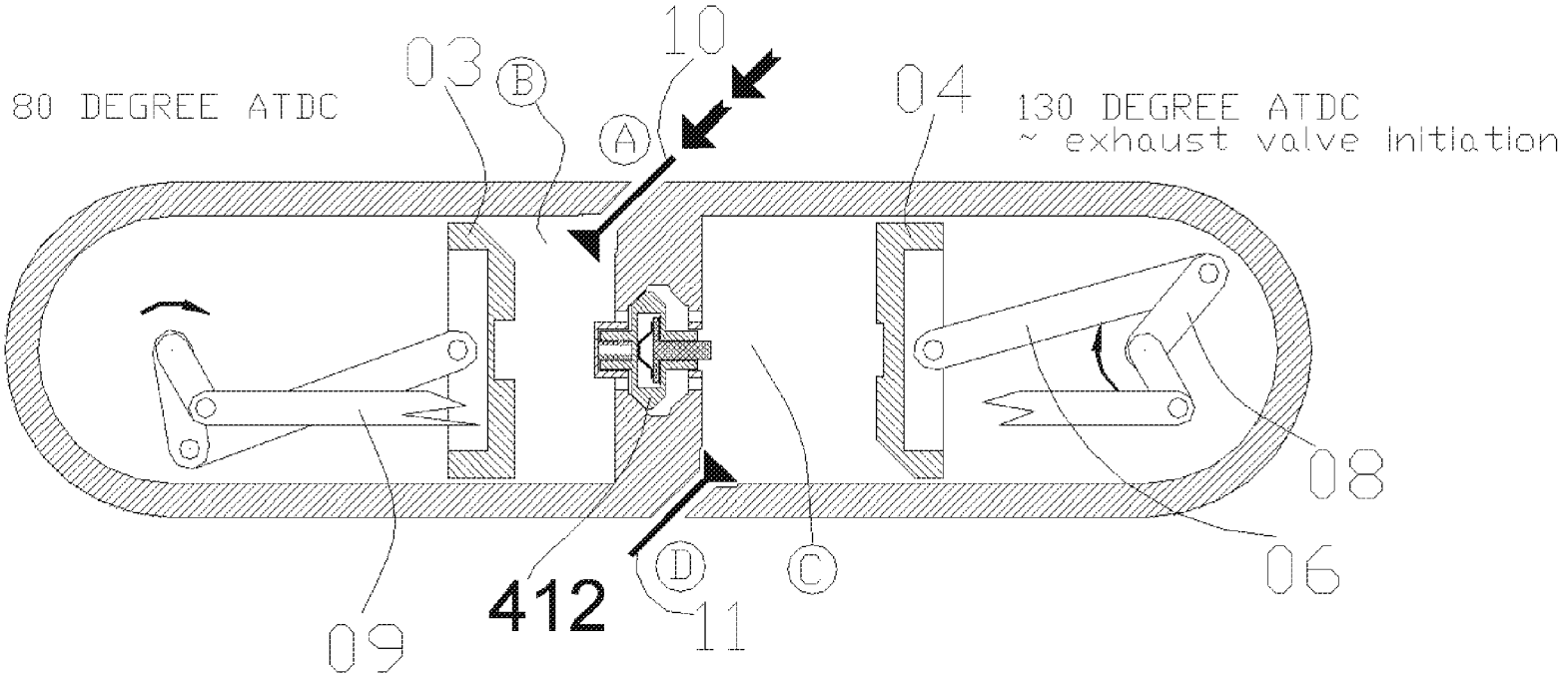
FIG. 30 is a simplified cross-sectional side view of the DPCE apparatus of FIG. 21, wherein the compression crankshaft angle is illustrated at 80 degrees after its TDC, and the power crankshaft angle is illustrated at 130 degrees after its TDC.

Referring again to FIG. 21, within the compression cylinder 01 is compression piston 03. The compression piston 03 moves relative to the compression cylinder 01 in the direction as indicated by the illustrated arrows. Within the power cylinder 02 is a power piston 04. The power piston 04 moves relative to the power cylinder 02 in the direction as indicated by the illustrated arrows. The compression cylinder 01 and the compression piston 03 define chamber B. The power cylinder 02 and the power piston 04 define chamber C. In some embodiments, the compression crankshaft angle trails the power crankshaft angle such that the power piston 04 moves in advance of the compression piston 03. Chamber B may be in fluid communication with chamber C when interstage valve 412 is in an open state. Chamber B, through intake valve 10, may be in fluid communication with carbureted naturally aspirated fuel/air charge or forced induced fuel/air charge, A. Chamber C, through exhaust valve 11, may be in fluid communication with ambient air D. When in an open state, exhaust valve 11 allows exhaust gases to exhale. During a combustion stroke, the power piston 04 may push the power connecting rod 06, causing the power crankshaft 08 to rotate clockwise as illustrated in FIGS. 28, 29, and 30. During an exhaust stroke, inertial forces (which may be initiated by a flywheel mass—not shown) cause the power crankshaft 08 to continue its clockwise rotation, and cause the power connecting rod 06 to move power piston 04, which in turn exhales burnt fuel exhaust through valve 11 as illustrated in FIGS. 31, 32, 33, 21, 22, and 23. The power crankshaft 08 rotation articulates rotation, through a crankshaft connecting rod 09, of the compression crankshaft 07 for phase shifted synchronous rotation (i.e., both crankshafts rotate at the same speed but differ in their dynamic angles). In exemplary embodiments, the relative positions of the power piston 04 and the compression piston 03 may be phase-shifted by a desired amount to achieve a desired engine compression ratio.

Interstage valve 412 may have superior sealing properties, since while the valve can couple or decouple chamber B with chamber C by the displacement of the DSAP valve, it can do this without any additional mechanical device or components that perturb the valve to actuate it from outside. Avoiding such protrusion, which could potentially connect (leak) the inner engine chambers (B and C) with ambient air A, provides a solution with superior sealing properties.

In some embodiments, interstage valve 412 may eliminate the need for an externally actuated mechanism to control the valve (such as a cam, for example). In this way, interstage valve 412 may avoid seal an actuation mechanism and thereby prevent leakage from the interstage valve chamber to, for example, the ambient air.

In some exemplary embodiments, the DPCE dual cylinder apparatus utilizes conventional pressurized cooling and oil lubrication methods and systems (not shown). In some exemplary embodiments, the components of the power chamber C are temperature controlled using a cooling system, thereby cooling the power chamber C structure components (such as the cylinder 02, piston 04, and parts of valve 412). Moreover, in some exemplary embodiments, some or all of the components may be fabricated out of high-temperature resistant materials such as ceramics or ceramic coating, carbon, titanium, nickel-alloy, nanocomposite, or stainless steel. In some exemplary embodiments, the DPCE apparatus can utilize well-known high voltage timing and spark plugs electrical systems (not shown), as well as an electrical starter motor (not shown) to control engine initial rotation.

As explained above, the compression connecting rod 05 connects the compression crankshaft 07 with the compression piston 03 causing the compression piston 03 to move relative to the cylinder in a reciprocating manner. The power connecting rod 06 connects the power crankshaft 08 with the power piston 04. During the combustion phase, the power connecting rod 06 transfers the reciprocating motion of the power piston 04 into the power crankshaft 08, causing the power crankshaft to rotate. During the exhaust phase, the power crankshaft 08 rotation and momentum pushes the power piston 04 back toward the compression cylinder 01, which causes the burned gases to be exhaled via the exhaust valve (exhaust stroke).

Referring to FIG. 21, the compression crankshaft 07 converts rotational motion into compression piston 03 reciprocating motion. The compression crankshaft 07 connects the compression connecting rod 05 with the crankshaft connecting rod 09. Motion of the crankshaft connecting rod 09 causes the compression crankshaft 07 to rotate. Compression crankshaft 07 rotation produces motion of the compression connecting rod 05 that in turn moves the compression piston 03 relative to its cylinder housing 01 in a reciprocating manner.

In various exemplary embodiments of the present invention, the compression crankshaft 07 and power crankshaft 08 structural configurations may vary in accordance with desired engine configurations and designs. For example, possible crankshaft design factors may include: the number of dual cylinders, the relative cylinder positioning, the crankshaft gearing mechanism, and the direction of rotation.

The power crankshaft 08 connects the power connecting rod 06 with the crankshaft connecting rod 09. As combustion occurs, the reciprocating motion of power piston 04 causes, through the power connecting rod 06, the power crankshaft 08, which may also be coupled to the engine output shaft (not shown), to rotate, which causes the connecting rod 09 to rotate the compression crankshaft 07, thereby generating reciprocating motion of the compression piston 03 as described above.

The crankshaft connecting rod 09 connects the power crankshaft 08 with the compression crankshaft 07 and thus provides both crankshafts with synchronous rotation. Alternative embodiments of the present invention may include, for the crankshaft connecting rod 09, standard rotational energy connecting elements such as: timing belts, multi rod mechanisms gears, drive shafts combined with 90 degrees helical gear boxes and/or a combination of the above, for example.

FIGS. 21 through 33 illustrate perspective views of the crankshaft connecting rod 09 coupled to crankshafts 07 and 08, which are coupled to respective piston connecting rods 05 and 06. The crankshafts 07 and 08 may be relatively oriented so as to provide a predetermined phase difference between the otherwise synchronous motion of pistons 03 and 04. A predetermined phase difference between the TDC positions of the compression piston and power piston may introduce a relative piston phase delay or advance. FIGS. 21 through 37 illustrate that piston connecting rods 05 and 06 are out of phase, thereby providing a desired phase delay (also known as phase lag) or phase advance between the TDC positions of pistons 03 and 04. In exemplary embodiments, as illustrated in FIGS. 21 to 33, a phase delay is introduced such that the power piston 04 moves slightly in advance of compression piston 03, thereby permitting the compressed charge to be delivered under nearly the full compression stroke and permitting the power piston 04 to complete a full exhaust stroke. Such advantages of the phase delays where the power piston leads the compression piston are also described in U.S. Pat. No. 1,372,216 to Casaday and U.S. Pat. Application No. 2003/0015171 A1 to Scuderi, the entire contents of both of which are incorporated herein in their entireties.

Figure 26:
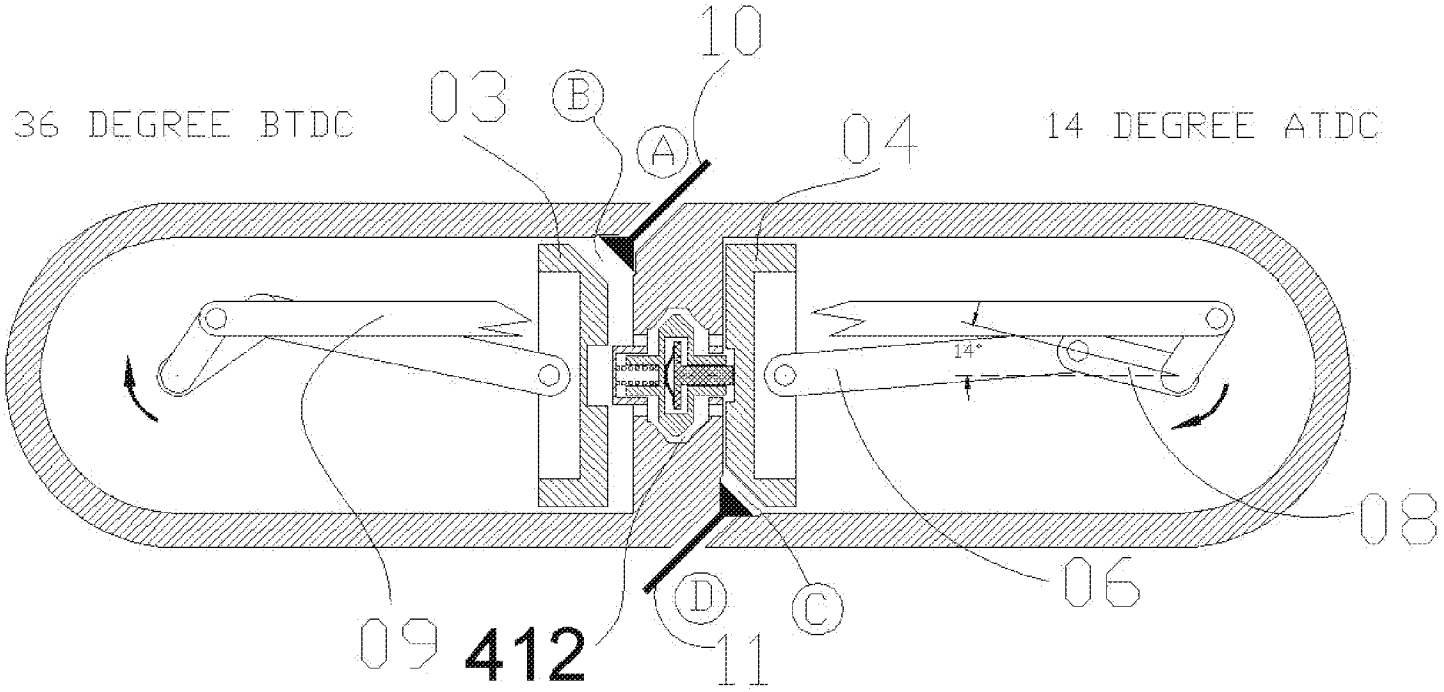
FIG. 26 is a simplified cross-sectional side view of the DPCE apparatus of FIG. 21, wherein the compression crankshaft angle is illustrated at 36 degrees before its TDC, and the power crankshaft angle is illustrated at 14 degrees after its TDC.
Figure 27:
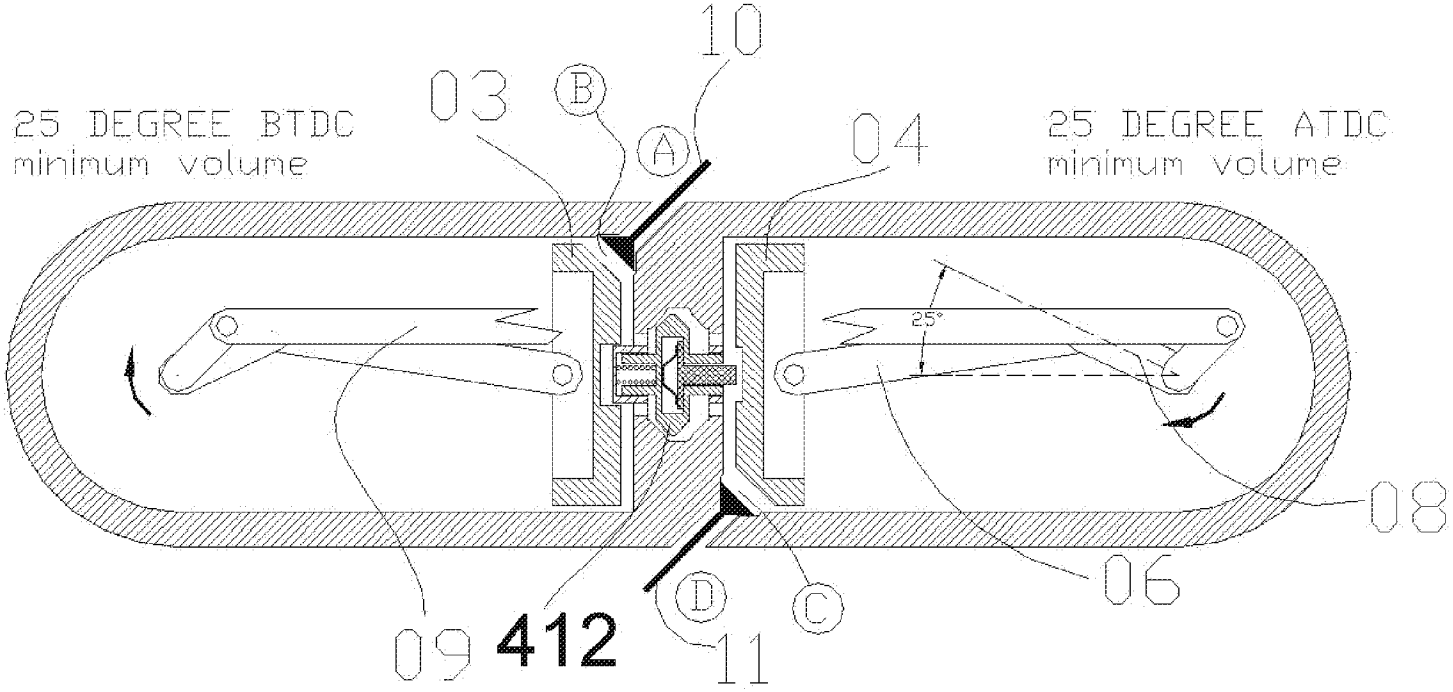
FIG. 27 is a simplified cross-sectional side view of the DPCE apparatus of FIG. 21, wherein the compression crankshaft angle is illustrated at 25 degrees before its TDC, and the power crankshaft angle is illustrated at 25 degrees after its TDC.
Figure 31:
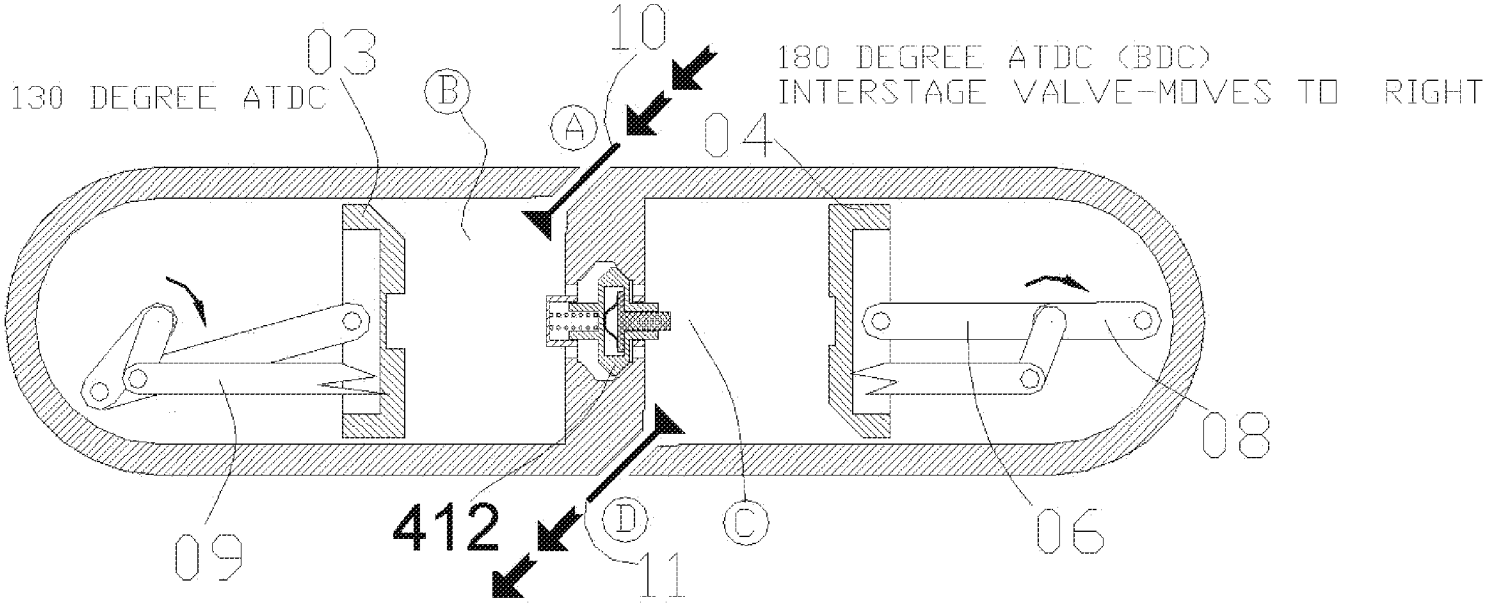
FIG. 31 is a simplified cross-sectional side view of the DPCE apparatus of FIG. 21, wherein the compression crankshaft angle is illustrated at 130 degrees and the power crankshaft angle is illustrated at Bottom Dead Center (BDC).
Figure 32:
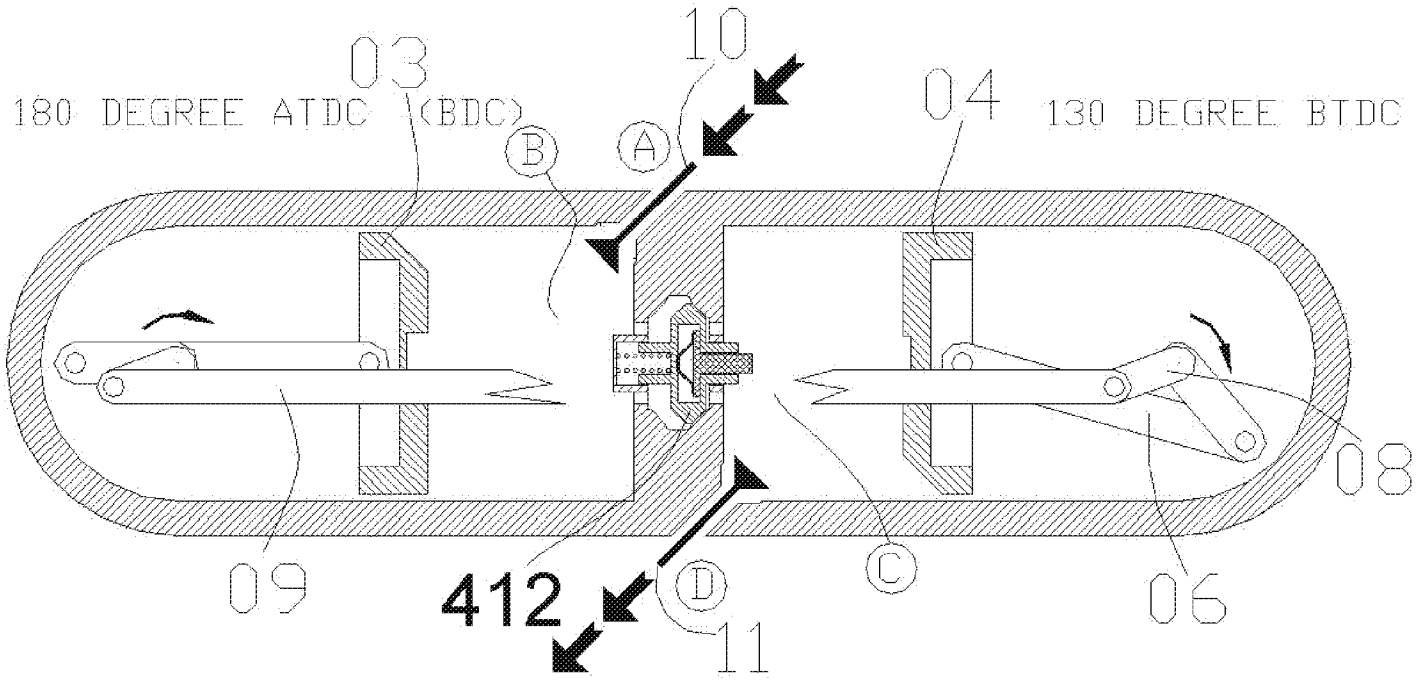
FIG. 32 is a simplified cross-sectional side view of the DPCE apparatus of FIG. 21, wherein the compression crankshaft angle is illustrated at 180 degrees after its TDC (BDC), and the power crankshaft angle is illustrated at 130 degrees before its TDC.
Figure 33:
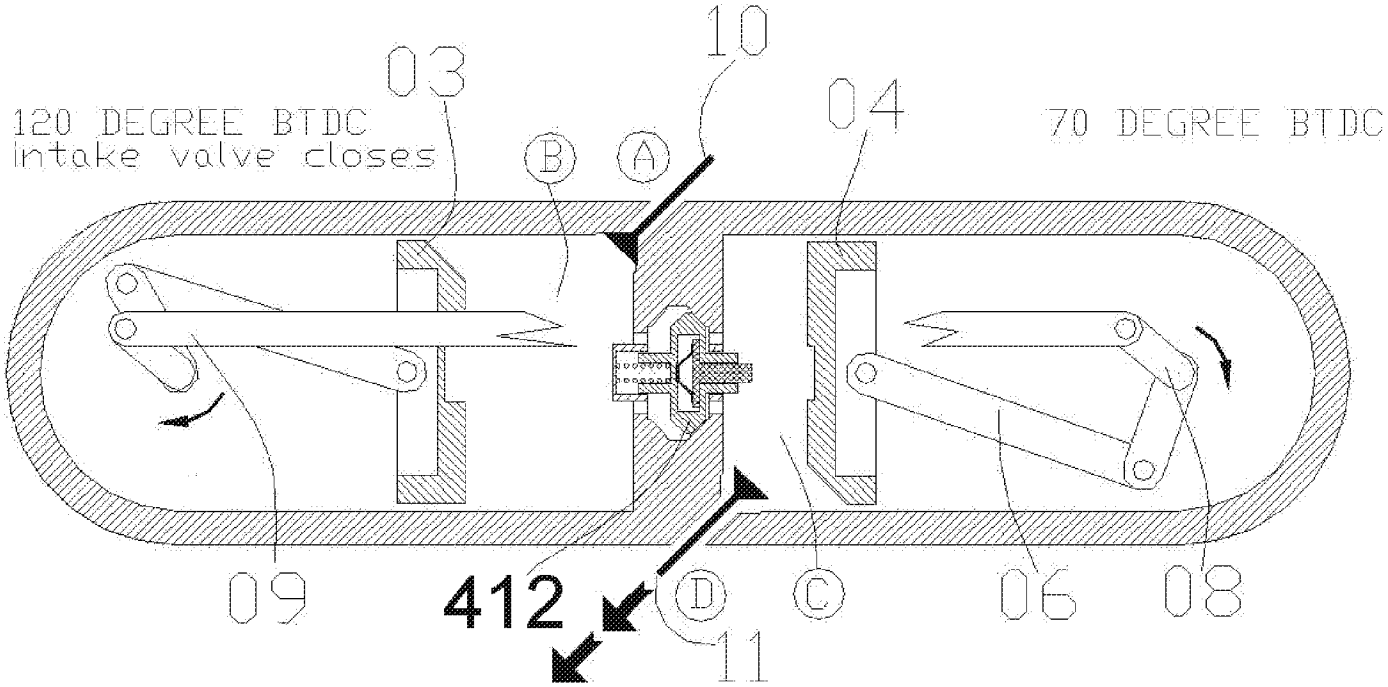
FIG. 33 is a simplified cross-sectional side view of the DPCE apparatus of FIG. 21, wherein the compression crankshaft angle is illustrated at 120 degrees before its TDC, and the power crankshaft angle is illustrated at 70 degrees before its TDC.

As illustrated in FIGS. 21 through 33, while an electrical starter (not shown) engages DPCE output shaft (not shown), both crankshafts 07 and 08 start their clockwise rotation and both pistons 03 and 04 begin their reciprocating motion. As illustrated in FIG. 29, the compression piston 03 and the power piston 04 move in the direction that increases chamber B and chamber C volume. Since intake valve 10 is in its open state and because chamber B volume constantly increases at this stage, carbureted fuel or fresh air charge (when using a fuel injection system) flows from point A (which represents a carburetor output port, for example) through intake valve 10 into chamber B. The location of the compression piston 03 when the intake valve opens may vary. In some embodiments of the present invention, the timing of the opening of the intake valve may vary. In one example, the intake valve may open a few crankshaft degrees before compression piston 03 reaches its TDC through approximately 50 crankshaft degrees after compression piston 03 reaches its TDC. As shown in FIGS. 30 through 32, respectively, chamber B volume increases while fuel-air charge flows in. As compression piston 03 passes beyond its BDC point (for example, somewhere between 10 to 70 degrees after BDC, as shown in FIG. 33), intake valve 10 closes, trapping chamber B air-fuel charge (working fluid) content. While the crankshafts' clockwise rotation continues (as shown in FIG. 33 and FIG. 21), chamber B volume decreases and the temperature and pressure of the air-fuel charge increases. As the power piston 04 passes through power piston TDC (FIG. 25 through 28), interstage valve 412 opens and the air-fuel charge in chamber B flows into chamber C. At a certain predetermined point (for example, while the compression piston moves toward its TDC, as illustrated in FIGS. 26 through 28, although, some exemplary embodiments may introduce delay or advance), combustion of the air-fuel charge is initiated via an ignition mechanism, such as spark plug firing or compression ignition. As the compression piston 03 passes through its TDC (FIG. 28), interstage valve 412 closes.

FIGS. 26 through 30 illustrate the power stroke, according to exemplary embodiments of the present invention. As combustion occurs (spark plug firing or compression ignition at a predetermined piston location shown within the dynamic range illustrated in FIGS. 25 through 28, although some deviation may be permitted in some embodiments), the pressures of chambers B and C increase, forcing power piston 04 and compression piston 03 away from each other. Although the torque produced by the compression piston opposes engine rotation, the torque produced by the power piston during most of the power stroke is greater and the net torque turns the power crankshaft clockwise (as well as the coupled compression crankshaft). Meanwhile, the interstage valve 412 closes because of increasing pressure in chamber C and decreasing pressure in chamber B (FIGS. 28 and 29).

Referring now to FIGS. 28 and 29, when compression piston 03 is pulled back from its TDC position, according to exemplary embodiments of the present invention, intake valve 10 reopens, thus allowing a new air-fuel charge A to enter chamber B.

Referring now to FIGS. 30 through 33, in exemplary embodiments of the present invention, the exhaust stroke may begin about 40 to 60 crankshaft degrees before power piston 04 reaches its Bottom Dead Center position (FIG. 31). The exhaust valve 11 opens and the burned exhaust gases are pushed out from chamber C through open exhaust valve 11 into the ambient environment D. Although the timing of the strokes of the engine is given in exemplary embodiments, it should be understood that the timing described herein may be adjusted in some embodiments.

Figure 34:
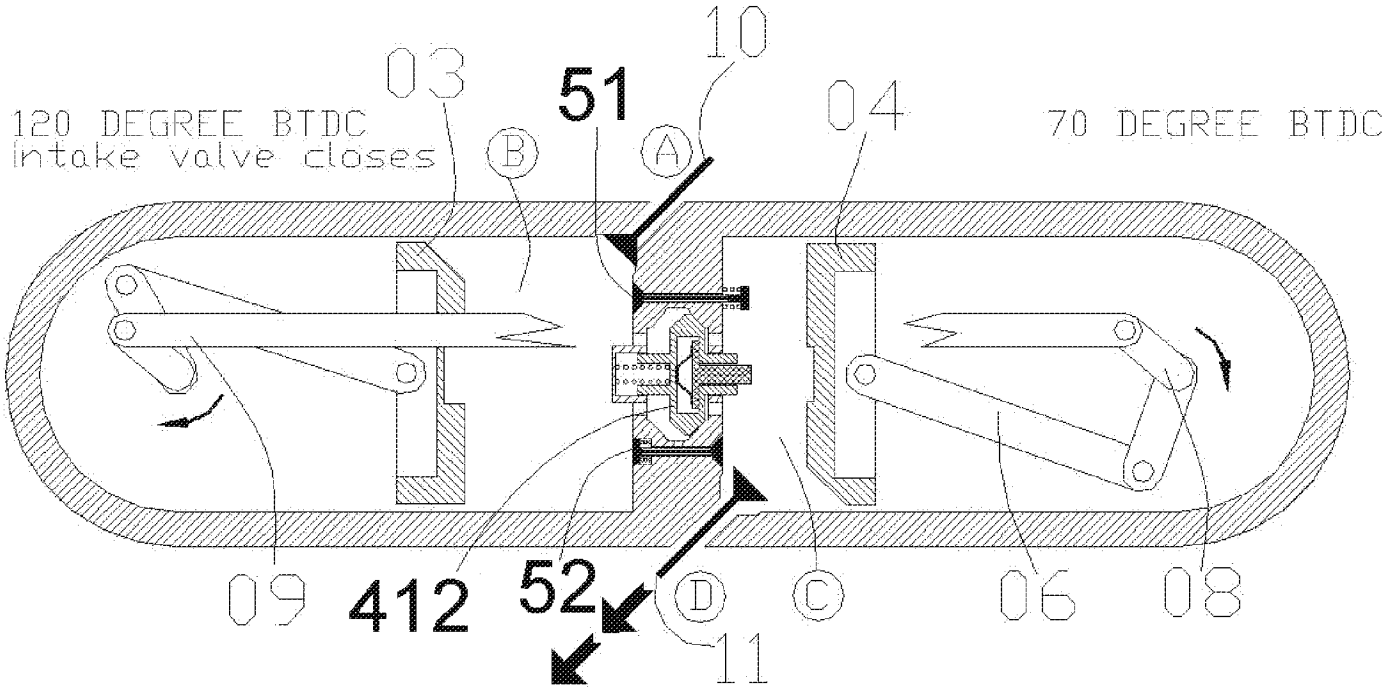
FIG. 34 is a simplified cross-sectional side view of a DPCE apparatus, with compression chamber pressure relief capability and an interstage valve differential pressure equalizer.

Referring now to FIG. 34, exemplary embodiments of the present invention that may be equipped with compression chamber pressure relief valve 52 (see also FIGS. 39 M-N). Relief valve 52 composed of a preloaded spring, which forcefully pulls a conic shape valve to its seat so as to keep it close and decouple a fluid passage between compression chamber B and power chamber C. If during engine operation compression chamber B pressure exceeds power chamber C pressure by more than a predetermined magnitude (for example, such event may be caused by failure of interstage valve 412 to adequately open that would cause the compression pressure to exceed the maximum engine desired pressure for the designed compression ratio) valve 52 cracks open reliving pressure from chamber B into chamber C.

Referring again to FIG. 34, exemplary embodiments of the present invention may be equipped with differential pressure equalizer valve 51. When scaling up the DPCE to have larger working fluid displacement, by increasing the pistons and cylinders size, the size of interstage valve 412 would be proportionally increased as well. In such cases the forces required to crack open interstage valve 412 (see also FIGS. 39 K-L) may become exceedingly high as this force is proportional to the square area of the DSAP valve surface, the surface which is exposed to the compressed working fluid in chamber B during the compression stroke (the left side surface of the DSAP valve; mark 520 in FIG. 39D). Differential pressure equalizer valve 51 has a substantially smaller surface area, compared to the above DSAP valve. Therefore, as power piston 04 approaches TDC, it more easily pushes differential pressure equalizer valve 51 allowing initial fluid communication between chambers B and C. Fluid communication between chamber B and chamber C reduces the deferential pressure between chamber B and chamber C. Lowering the said differential pressure reduces the force required to crack open interstage valve 412 and thus enables practical utilization of large DPCE.

Some embodiments may use one or both of compression chamber relief valve 52 and differential equalizer valve 51.

Thus, the DPCE engine divides the strokes performed by a single piston and cylinder of conventional internal combustion engines into two thermally differentiated cylinders in which each cylinder executes half of the four-stroke cycle. A relatively "cold" cylinder executes the intake and compression, but not the exhaust stroke, and a thermally isolated "hot" cylinder executes the combustion and exhaust, but not the intake stroke. Compared to conventional engines, this advantageous system and process enables the DPCE engine to work at higher combustion chamber temperatures and at lower intake and compression chamber temperatures. Utilizing higher combustion temperatures while maintaining lower intake and compression temperatures reduces engine cooling requirements, lowers compression energy requirements, and thus boosts engine efficiency. Additionally, thermally isolating the power cylinder from the external environment, according to exemplary embodiments of the present invention, limits external heat losses and thus enables a larger portion of the fuel heat energy to be converted into useful work, allows the reuse of heat energy in the next stroke, and therefore permits less fuel to be burned in each cycle.

Figure 35:
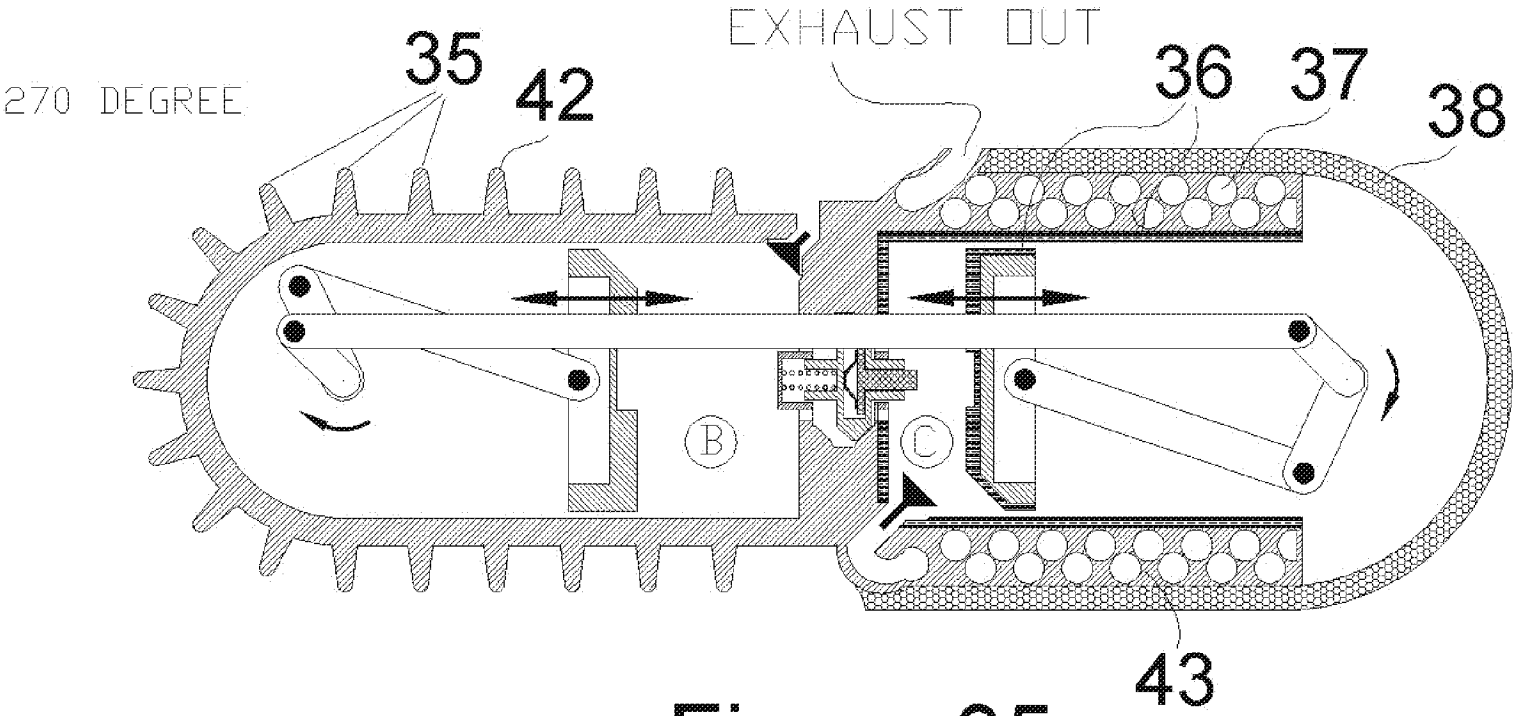
FIG. 35 is a simplified cross-sectional side view of a DPCE apparatus with an air-cooled compression cylinder and an exhaust-heated power cylinder composed of internal and external insulation materials, in accordance with exemplary embodiments of the present invention.

FIG. 35 illustrates exhaust heat capture and heat utilization during exhaust, in accordance with some embodiments of the present invention. The exhaust gas travels through passages 37, thereby conducting heat back into the power cylinder walls 43. Passages 37 may circumvent the chamber in a helical manner, travelling the length of the chamber and back again to the ambient exhaust (depicted as "Exhaust Out" in FIG. 35). In addition, the various surfaces of chamber C may be both mechanically reinforced and thermally insulated by utilizing ceramic coats 36. The power cylinder may also utilize an external isolation cover 38 (e.g., honey structure or equivalent), which prevents heat leakage. Meanwhile, compression cylinder 42 temperatures may be reduced by utilizing heat diffusers 35.

Figure 36:
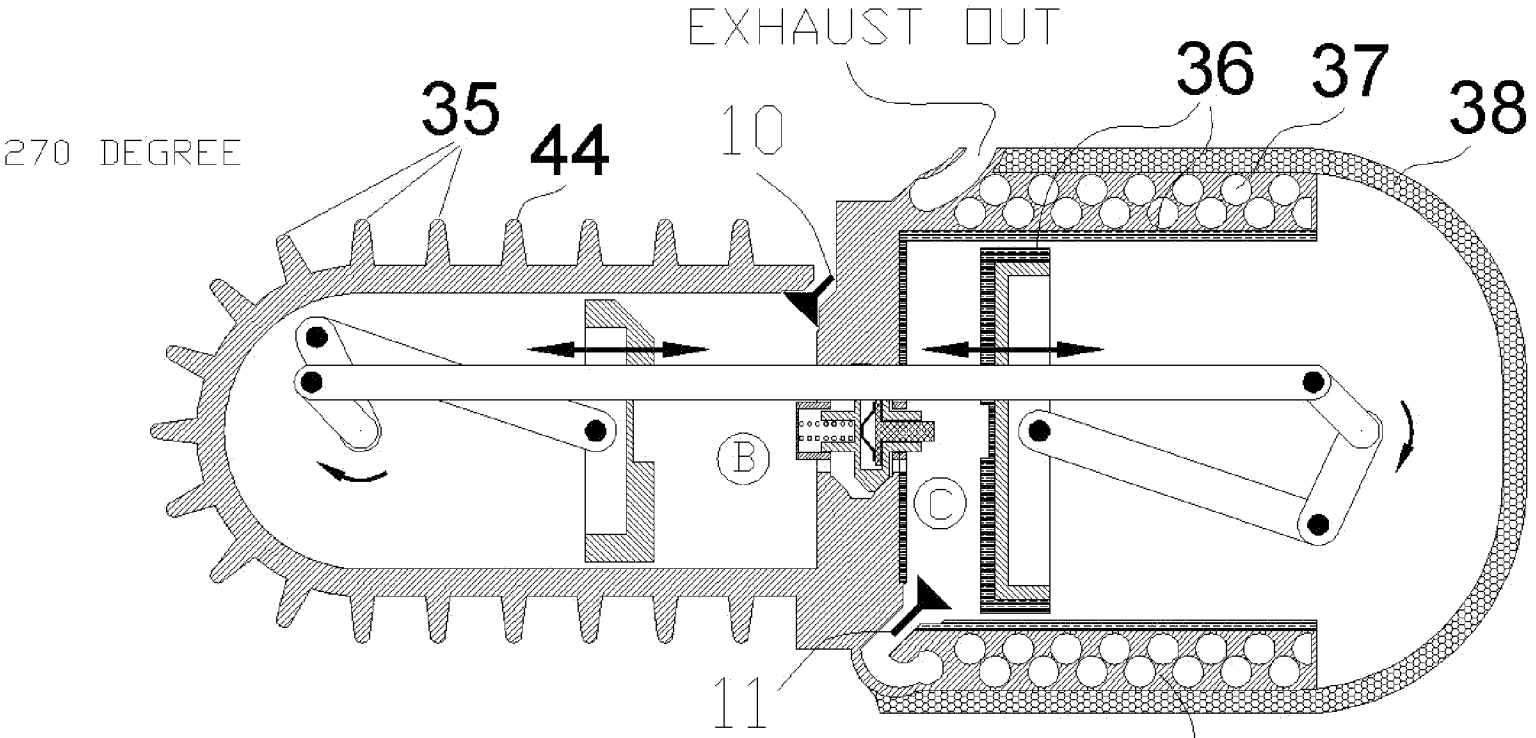
FIG. 36 is a simplified cross-sectional side view of the DPCE apparatus of FIG. 35 with a larger power cylinder expansion volume relative to engine compression volume, an air cooled compression chamber, and an exhaust-heated power chamber, in accordance with exemplary embodiments of the present invention.

FIG. 36 illustrates a method of providing a combustion engine with improved efficiency, in accordance with an exemplary embodiment. As illustrated, the intake and compression strokes, but not the exhaust stroke, are performed in a first cylinder 44 and the power and exhaust strokes, but not the intake stroke, are performed in a second cylinder 45, wherein the first cylinder internal volume B is smaller than the second cylinder internal volume C. Greater volume in the second cylinder internal volume C enables a larger expansion ratio in the second cylinder 45 than compression ratio in the first cylinder 44. The added expansion volume enables additional conversion of heat and pressure to mechanical work. The Double Piston Cycle Engine power cylinder may exercise higher temperatures relative to the cylinders of conventional engines and this extra expansion property carries significant gains in engine efficiency. In addition, in order to reduce compression temperatures, cylinder 42 FIG. 35 and cylinder 44 FIG. 36, may be equipped with heat diffuser elements 35.

Figure 37:
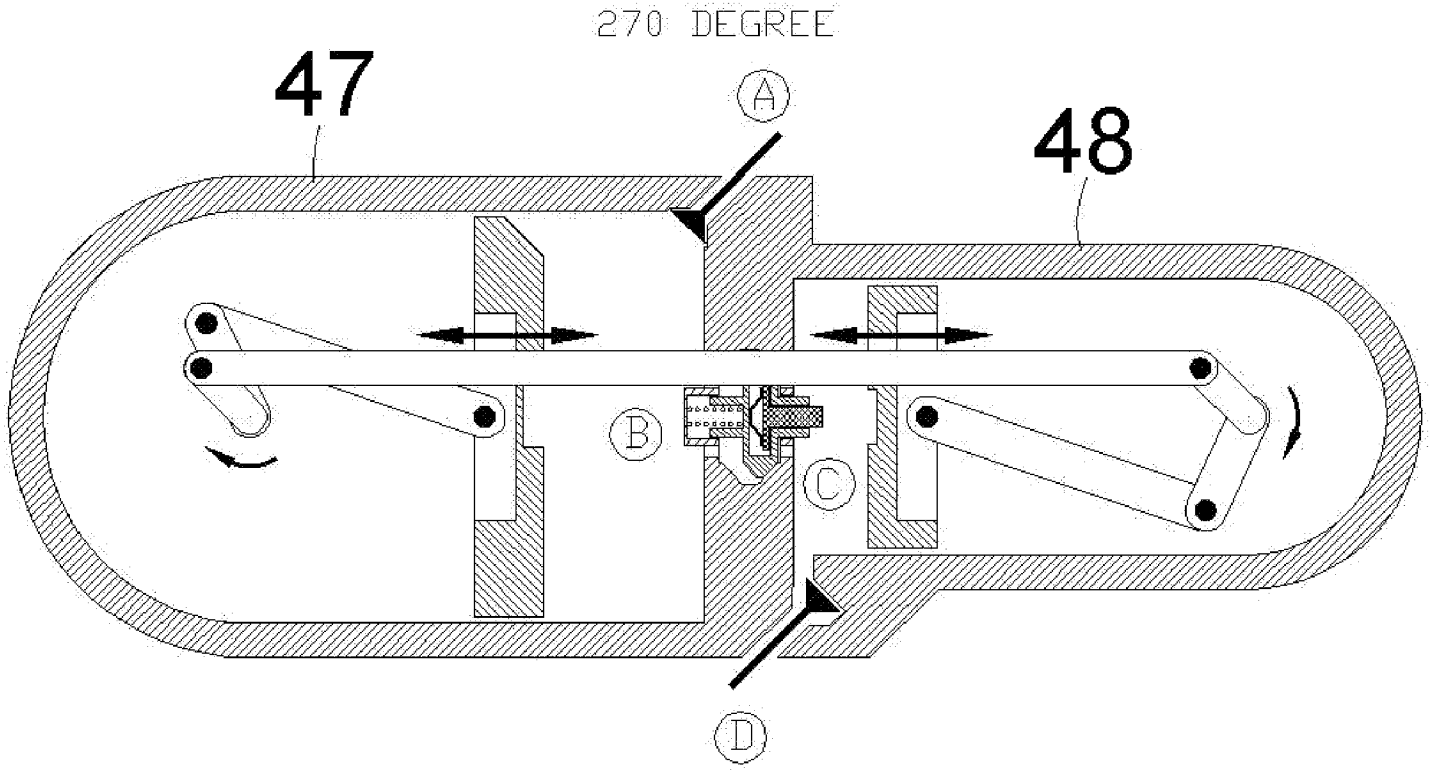
FIG. 37 is a simplified cross-section illustration of a DPCE apparatus with a larger compression cylinder volume relative to engine expansion/power volume, providing supercharged capabilities, in accordance with exemplary embodiment of the present invention.

Referring now to FIG. 37, illustrated therein is a DPCE dual cylinder configuration having supercharged capabilities, in accordance with exemplary embodiments of the present invention. As shown in FIG. 37, the volume of compression cylinder 47 is larger than the volume of power cylinder 48, thereby allowing a greater volume of air/fuel mixture to be received and compressed in the compression chamber B. During the compression stroke, the larger volume and increased pressure of compressed air/fuel mixture (i.e., "supercharged" fuel mixture) in the compression chamber B is transferred into the combustion chamber C via interstage valve 12 or 412. Therefore, a greater amount and/or higher pressure of fuel mixture can be injected into the combustion chamber C of power cylinder 48 to provide a bigger explosion and, hence, provide more energy and work (higher power density), during the power stroke.

Figure 38A:
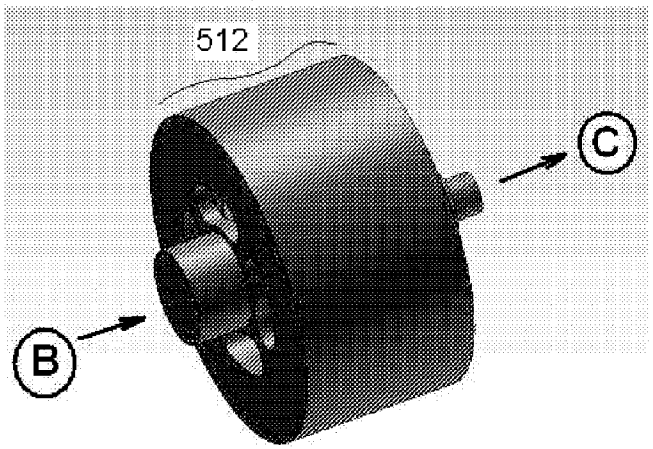
FIGS. 38A-38D.
Figure 38B:
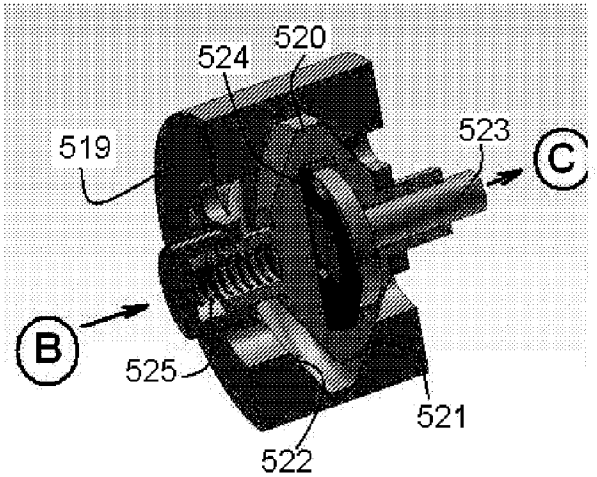
Figure 38C:
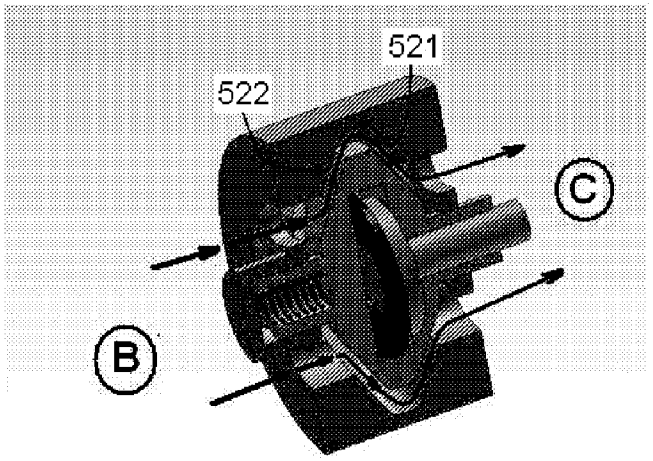
Figure 38D:
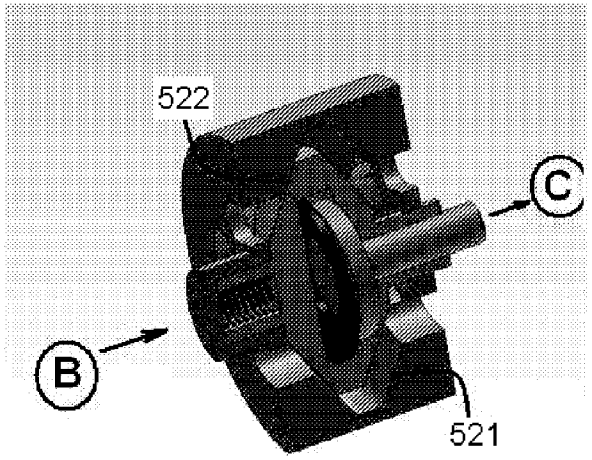

Referring now to mechanical interstage valve 512 as illustrated in three dimensional drawings (3D) and cut-away 3D drawings FIG. 38A-D. Note that the color (gray-scale) shown on FIG. 38 forms no part thereof (that is, the variation in gray does not indicate a structural variation). FIG. 38A illustrates interstage valve 512 in perspective view. FIG. 38B illustrates a cut-away of interstage valve 512 that depicts the various parts that may generally include main valve body 519, power side (chamber C) sealing surface 521 (valve seat 521), compression side (chamber B) sealing surface 522 (valve seat 522), DSAP valve head 520, plunger 523 and bias element 524 (disc spring, for example) that together constitute the Spring Plunger Component (SPC). It also contains the Bias Mechanism Component 525 (BMC, a coil spring, for example). As illustrated in FIG. 38B, DSAP valve 520 engages sealing surface 521 and thus decouples chamber B and chamber C. FIG. 38C illustrates DSAP valve 520 and valve body 519 in relative position such that neither sealing valve seat 521 nor sealing valve seat 522 seals thus enabling compression chamber B and power chamber C to reciprocate fluid exchange, for example, to transfer the compressed working fluid from chamber B to chamber C. Thus, DSAP 520 valve positioning causes interstage valve 512 to be in this open state, as illustrated by the black arrows (indicating fluid flow) in FIG. 38C. FIG. 38D illustrates DSAP valve 520 engage sealing surface 522 and thus decouple chamber C and chamber B. When used in the embodiments of FIGS. 21-44 mechanical interstage valve 512 may separate compression chamber B and power chamber C. In these way, the chambers may have different fluid pressure.

An exemplary embodiment of a mechanical interstage valve 512 will now be discussed with reference to FIGS. 39A-J. Mechanical interstage valve 512 may be used as interstage valve 512 in the embodiments described above with respect to FIGS. 21-44 and for illustrative purposes the following description of mechanical interstage valve 512 may refer to elements mentioned above in connection with FIGS. 21-33. It should be understood that use of mechanical interstage valve 512 is not limited to the embodiments described above with respect to FIGS. 21-38, but may be used in other applications, including other types of double piston cycle engines, other split-cycle engines, four-stroke engines, and compressors, for example.

Figure 39B:
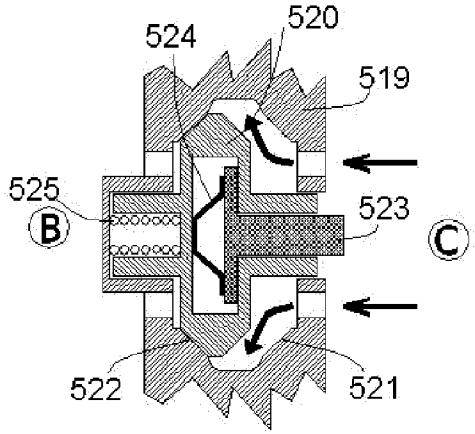
FIG. 39B is a simplified cross-sectional illustration of an interstage-valve in accordance with exemplary embodiments.
Figure 39D:
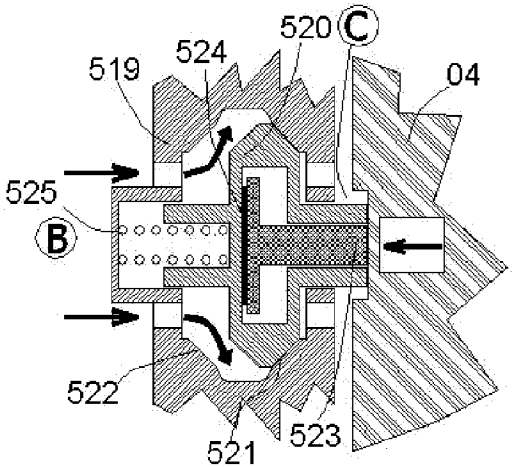
FIG. 39D is a simplified cross-sectional illustration of an interstage-valve in accordance with exemplary embodiments.
Figure 39A:
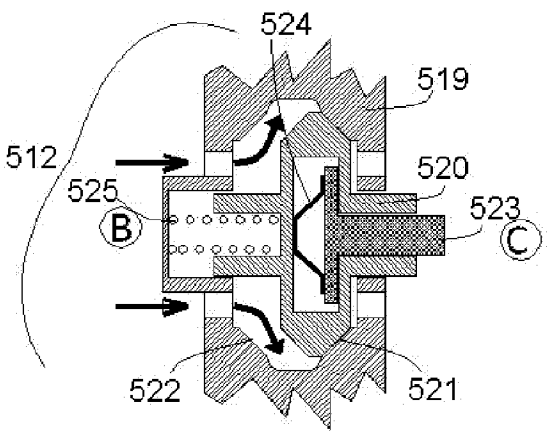
FIGS. 39A-39N.

Referring to FIG. 39A, mechanical interstage valve 512 may generally include main valve body 519, DSAP valve 520, plunger 523 and bias element 524 (disc spring, for example) that together constitute the Spring Plunger Component (SPC), and Bias Mechanism Component 525 (BMC, coil spring, for example). When used in the embodiments of FIGS. 21-33, mechanical interstage valve 512 may separate compression chamber B and combustion chamber C. In this way, the chambers may have different fluid pressure. Within mechanical interstage valve 512, the movement of DSAP valve 520 relative to the main valve body 519 may allow the coupling or decoupling of fluid communication between chamber B and chamber C. As illustrated in FIG. 39A, DSAP valve 520 seals against power cylinder side's sealing seat 521 of valve body 519, which may prevent high pressure fluid transfer from compression chamber B into power chamber C.

FIG. 39B is a cross-sectional view of mechanical interstage valve 512. When DSAP valve 520 seals against compression cylinder side's sealing seat 522 of valve body 519, high pressure working fluid is blocked from being transferred back from power chamber C into compression chamber B.

Figure 39C:
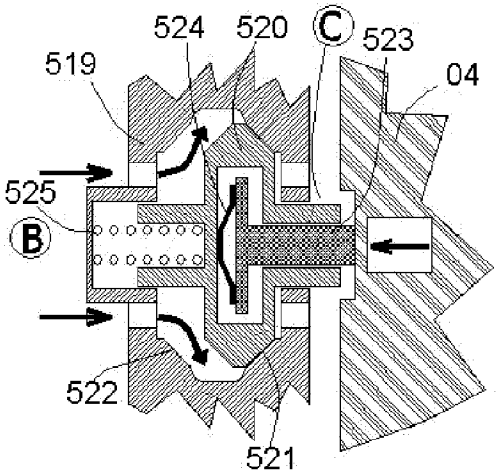
FIG. 39C is a simplified cross-sectional illustration of an interstage-valve in accordance with exemplary embodiments.

FIG. 39C is a cross-sectional view of mechanical interstage valve 512 depicting plunger 523 being pushed by power piston 04 towards bias element 524, and where plunger 523 partly compresses bias element 524. When power piston 04 approaches its TDC, piston 04 touches and partially pushes plunger 523 against bias element 524. In spite of axial forces now applied by plunger 523 and transferred through biasing element 524 on to DSAP valve 520, DSAP valve 520 is prevented of any axial displacement since it is forcefully contra-pushed by the compression pressure buildup in chamber B (as the compression piston 03 is at its compression stroke at this stage). Moreover, DSAP valve 520 is pushed toward sealing seat 521 not only by the force generated by compressed working fluid of chamber B, but also by bias element 525 preload force. These opposing forces on bias element 524 (The force generated on it by the plunger on one side and by the compressed fluid and bias element 525 on the other side) squeezes bias element 524 (compare element 524 displacement in FIGS. 39B and 39C), which accumulates potential energy. (to be released soon after—see description below).

FIG. 39D is a cross-sectional view of mechanical interstage valve 512 illustrating plunger 523 after squeezing farther bias element 524. When power piston 04 farther approaches its TDC, it pushes plunger 523 resulting in farther squeezing bias element 524 up to its maximal predetermined reaction force. As power piston approaches its TDC, exhaust valve (FIG. 24 item 11) closes. In some exemplary embodiments, a combination of exhaust valve closing timing i.e. slightly before power piston reaches its TDC and engine dynamic system inertia momentum may forcefully push power piston causing a sudden dramatic increase in chamber C fluid pressure. Such momentary increase in power chamber pressure may assist DSAP valve 520 opening.

Figure 39E:
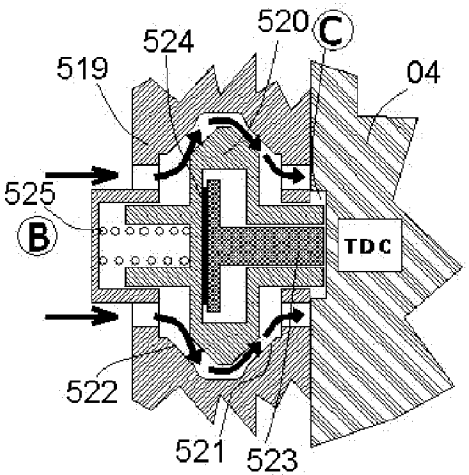
FIG. 39E is a simplified cross-sectional illustration of an interstage-valve in accordance with exemplary embodiments.

FIG. 39E is a cross-sectional view of mechanical interstage valve 512. As power piston 04 farther moves toward its TDC, it reaches DSAP valve 520 and pushes (nudges) the valve, forcefully causing the valve to leave its seat on sealing surface 521 of valve body 519 and to crack open. This leads to a working fluid flow from chamber B to chamber C (as illustrated by the black flow arrows in FIGS. 39 E-H) and to a sharp drop in pressure differential magnitude across the DSAP valve 520. It should be noted that on one hand, it may be beneficial for the touching point in which power piston 04 reaches DSAP valve 520 to be as close to power piston 04 TDC as practically possible as to have lower linear piston speed that enables a "soft" touch. On the other hand, the above described touching point may need to be far enough from power piston 04 TDC in order to ensure that the subsequent movement of DSAP valve 520 will open interstage valve 512 for sufficient duration and at the right timing in order to enable decrease in the differential pressure across DSAP valve 520. In some embodiments, timing for the power piston 04 to reach DSAP valve 520 may advantageously be at a point at which opening the valve will make sufficient differential pressure reduction between compression chamber B and power chamber C. It should be understood that since piston 04 touches DSAP valve 520 in a close proximity to power piston 04 TDC, the piston speed is relatively slow and therefore the magnitude of the force piston 04 is applying to DSAP valve 520 is moderate. In addition, during the DSAP valve 520 cracking event, power piston 04 close proximity to TDC ensures chamber C minimum volume which also acts in favor of a rapid decrease in the differential pressure across the said valve, since chamber C low volume will be rapidly filled with incoming working fluid from chamber B that will increase chamber C pressure level.

Figure 39F:
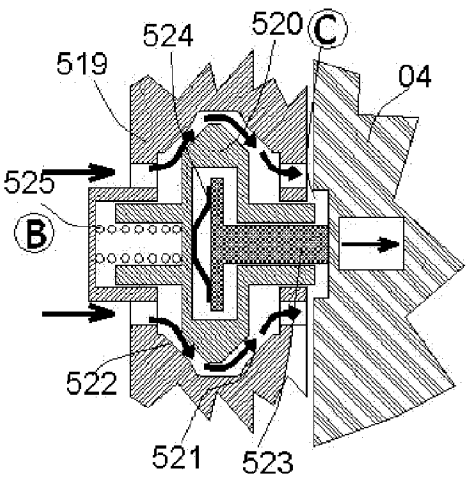
FIG. 39F is a simplified cross-sectional illustration of an interstage-valve in accordance with exemplary embodiments.

FIG. 39F is a cross-sectional view of mechanical interstage valve 512. As power piston 04 begins to move away from its TDC, bias element 524 expands, which enables plunger 523 edge to lean against retreating power piston 04 while farther pushing DSAP valve 520 toward wide open position thus allowing chamber B fluid content to continue to flow into chamber C.

Figure 39G:
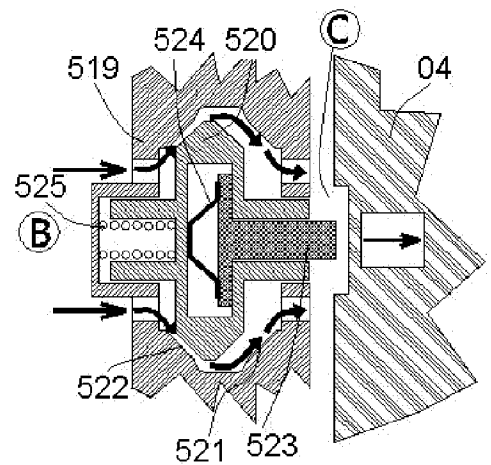
FIG. 39G is a simplified cross-sectional illustration of an interstage-valve in accordance with exemplary embodiments.

FIG. 39G is a cross-sectional view of mechanical valve 512. As power piston 04 continues its movements away from TDC, bias element 524 reaches its full expansion state keeping plunger 523 in its maximum projection relative to DSAP valve 520. Valve 512 remains open allowing the continuation of fluid transfer from compression chamber B into power chamber C. FIG. 39G also depicts an example of when combustion initiation might increase the pressure level at chamber C, contributing to the forces pushing DSAP valve 520 to the left and keeping interstage valve 512 open (see also the description of the combustion process below).

Figure 39H:
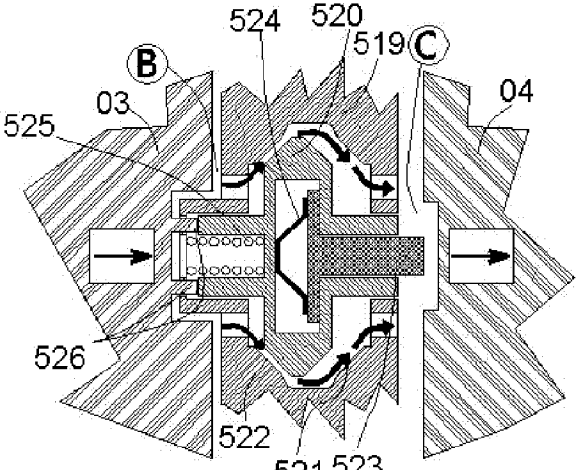
FIG. 39H is a simplified cross-sectional illustration of an interstage-valve in accordance with exemplary embodiments.

Referring now to FIG. 39H, in various exemplary embodiments of the present invention, at a few compression crankshaft 07 degrees before compression piston 03 reaches its TDC, the compression piston 03 projection element 526 may push back DSAP valve 520 away from sealing surfaces 522 so as to prevent premature chamber B and C decoupling. This decoupling might happen due to a dynamic increase in chamber C pressure as a result of combustion progression in chamber C. After passing its TDC and as compression piston 03 proceeds away from its TDC, projection element 526 retreats, enabling DSAP valve 520 to reclose on the sealing surfaces 522 (due to combustion forces at chamber C). Projection element 526 may prevent an undesired premature decoupling of chamber B and C that may cause incomplete fluid transfer from chamber B into chamber C.

Figure 39J:
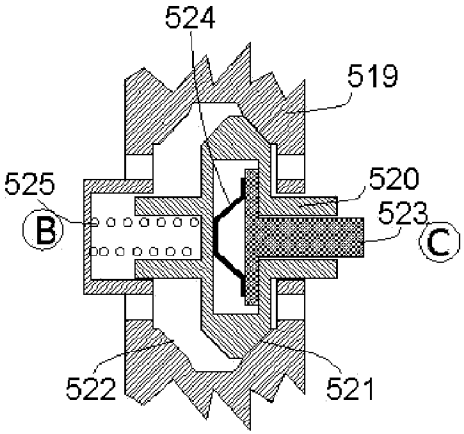
FIG. 39J is a simplified cross-sectional illustration of an interstage-valve in accordance with exemplary embodiments.
Figure 39L:
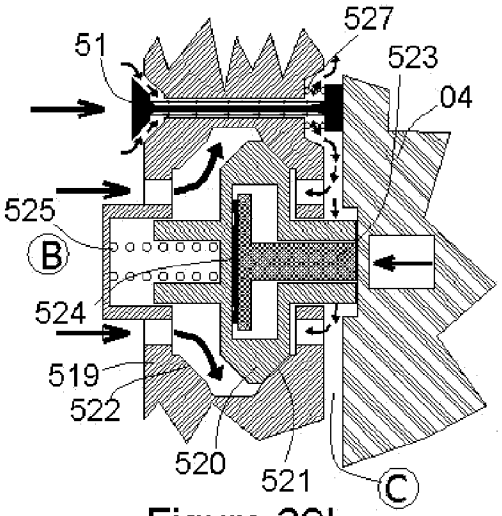
FIG. 39L is a simplified cross-sectional illustration of an interstage-valve in accordance with exemplary embodiments.
Figure 39I:
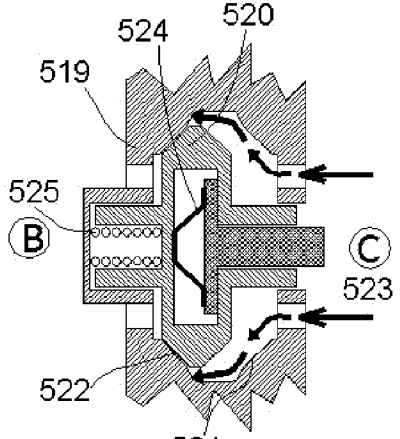
FIG. 39I is a simplified cross-sectional illustration of an interstage-valve in accordance with exemplary embodiments.

FIG. 39I is a cross-sectional view of mechanical interstage valve 512. When power piston 04 continues its movements away from TDC, combustion in the power cylinder causes a sharp increase in chamber C pressure. The DSAP valve 520 proceeds its inertial movement toward valve sealing seat 522 due to the following three events: (i) inertial forces developed during power piston 04 reaching and pushing DSAP valve 520, (ii) bias element 524 expansion energy release and, (iii) sudden chamber C pressure burst (combustion), which causes a high differential pressure between chamber C and chamber B. From this stage onward, engine power stroke carries on at chamber C while intake may start at chamber B by the opening of the intake valve 10.

FIG. 39J is a cross-sectional view of mechanical interstage valve 512. When power piston 04 approaches its BDC exhaust valve 11 opens and the burnt gaseous exhale, chamber C high pressure diminishes, which enables the Bias Mechanism Component 525 (BMC, coil spring, for example) to expand and push back DSAP valve 520 to seal against sealing seat 521. Once the said valve seals against sealing seat 521, interstage valve 512 decouples fluid passage between compression chamber B and power chamber C enabling the next compression stroke to occur.

Figure 39K:
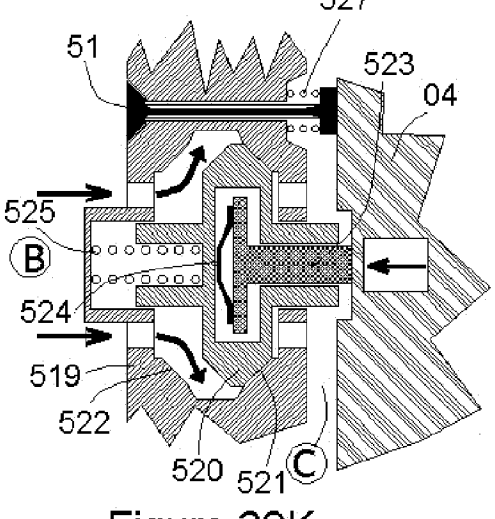
FIG. 39K is a simplified cross-sectional illustration of an interstage-valve in accordance with exemplary embodiments.

FIGS. 39K-L are cross-sectional views of mechanical interstage valve 512. When power piston 04 approaches its TDC it proceeds in pushing plunger 523 resulting in squeezing bias element 524. As power piston 04 farther moves toward its TDC, it reaches DSAP valve 520 and pushes (nudges) the said valve forcefully causing the valve to crack open. In various exemplary embodiments of the present invention before DSAP valve 520 direct contact with power piston 04 (and before, while, or after power piston 04 makes contact with plunger 523), the said piston pushes mechanical valve 51, which causes said valve 51 to open. This opening couples chambers B and C thus reducing pressure differential across DSAP valve 520 (FIG. 39K illustrates valve 51 in a closes state; FIG. 39L illustrates valve 51 in an opened state). When operating large DPCE engines, lowering of the differential pressure across DSAP valve 520 before power piston 04 touches the said valve, reduces potential impact damages and decreases the force needed to crack open DSAP valve 520 due to a smaller pressure differential. In various exemplary embodiments with valve 51 function capabilities, exhaust valve 11 exact closing point may be set such as to prevent compressed charge being transferred from chamber B through relief valve 51 and chamber C to be exhaled though exhaust valve 11 and ambient port D. Spring 527 may bias mechanical valve 51 to its closed state. In some embodiments, Spring 527's "spring constant" ("K value") may be high enough to prevent the opening of mechanical valve 51 due to combustion induced high pressure in chamber C, but low enough to enable mechanical valve 51 opening by piston 04.

Figure 39N:
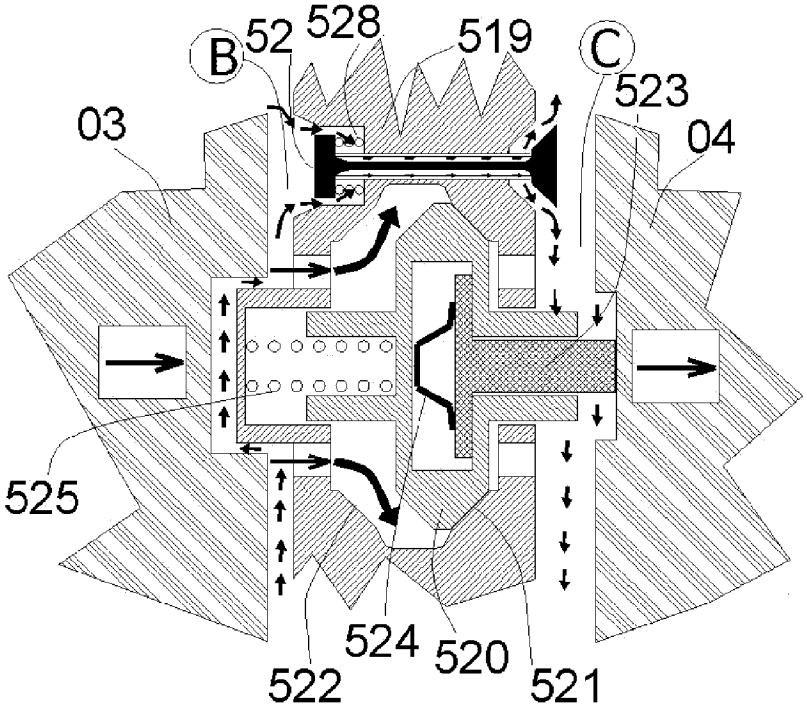
Figure 39M:
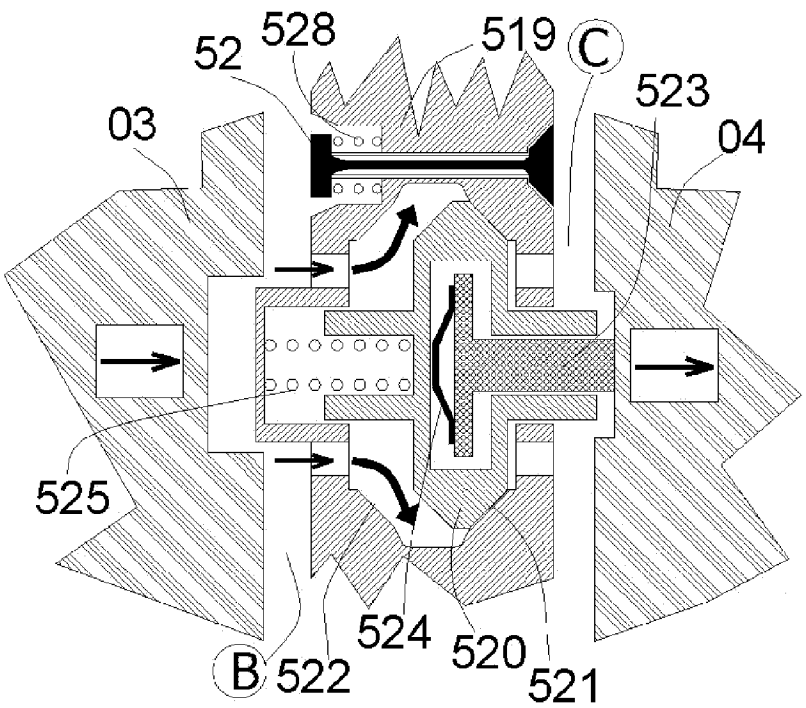
FIG. 39M is a simplified cross-sectional illustration of an interstage-valve in accordance with exemplary embodiments.

FIGS. 39M-N are cross-sectional views of mechanical interstage valve 512, as illustrated in FIGS. 27 and 28. When power piston 04 continues its movements away from TDC, combustion in the power cylinder cause sharp increase in chamber C pressure, which in turn pushes DSAP valve 520 against sealing seat 522. However in case of an occurrence of a misfire, in which combustion does not evolve, chamber C pressure will not increase, therefore chamber B compression pressure might push back DSAP valve 520 against sealing seat 521 and thus completely block fluid transfer from chambers B to chamber C, and at the same time the pressure in chamber B will increase to undesired levels. Relief valve 52's function is to prevent this scenario. If during DPCE operation, chamber B pressure exceeds chamber C pressure by more than a predefined threshold (which may be determined by spring 528's K value, for example), relief valve 52 overrides its internal preloaded spring 528 and couples chamber B and C (which rapidly equalizes chamber B pressure and chamber C pressure). FIG. 39M illustrate relief valve 52 in a closed state, while FIG. 39N illustrate relief valve 52 in an opened state. The function of relief valve 52 is to prevent compression chamber B overpressure (especially during engine misfires and during DSAP valve premature shutoffs), while still enabling some engine power generation.

It should be noted that during the DPCE operation, as illustrated and discussed using FIGS. 24 through 27 and FIGS. 39D through 39I the DSAP valve 520 moves in one direction while alternating between sealed, opened and sealed again, position: Mechanical interstage valve 512 is advantageous since it has a first closed position with a the DSAP valve 520 sealing on the surface 521 valve seat of power cylinder head, an open position in which the valve is not seated on any cylinder wall or cylinder head (and working fluid can pass from the compression cylinder to the power cylinder through the opening around the valve), and a second closed position with the valve sealing on the surface 522 of the compression cylinder head. Hence the valve state changes from close to open and again to close while moving in only one direction. The one directional movement of DSAP valve 120 has significant advantages over reciprocal open-to-close valve because it does not have to overcome inertial forces, as discussed above with respect to crossover valve 12.

Figure 40:
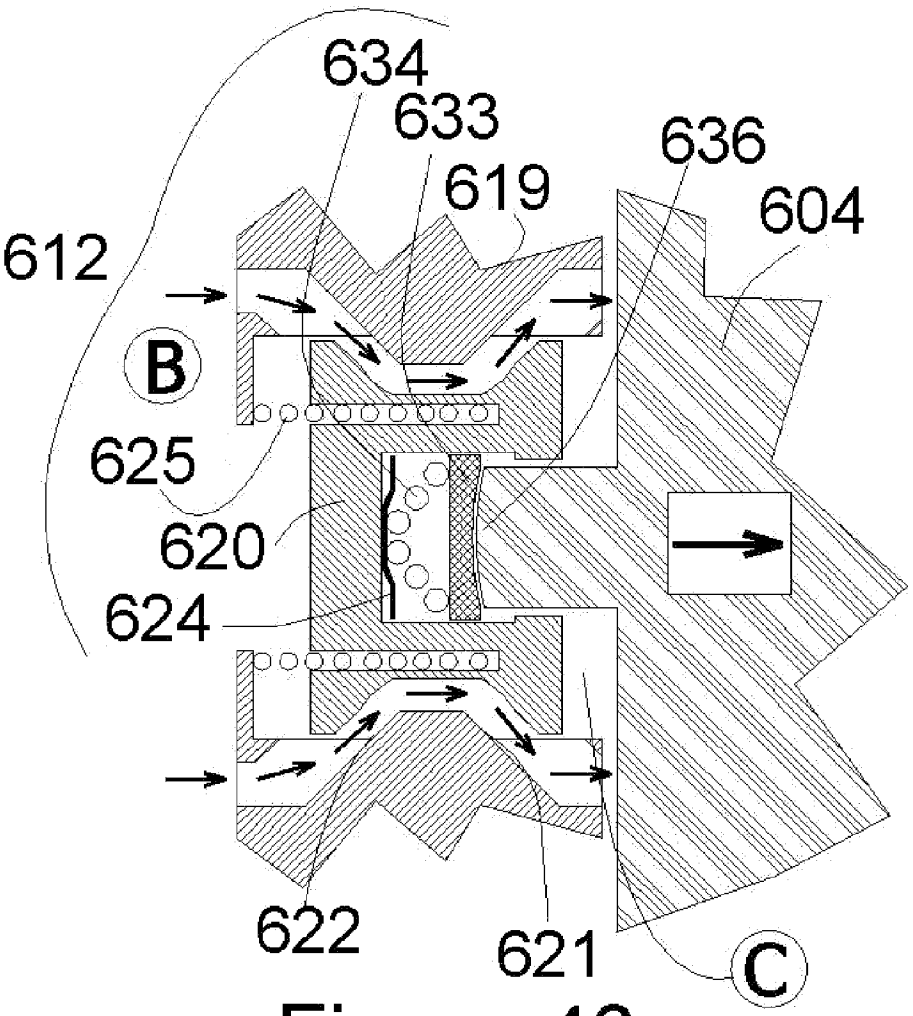
FIG. 40 is a simplified cross-sectional illustrations of a convex spool shape interstage valve.

In another exemplary embodiment of the present invention, mechanical interstage valve 612, as illustrated in FIG. 40, may separate compression chamber B and combustion chamber C. As a result, the chambers may have different fluid pressure. Mechanical interstage valve 612 may be used as interstage valve 412 in the embodiments described above with respect to FIGS. 21-39. In addition, for illustrative purposes, the following description of mechanical interstage valve 612 refers to elements mentioned above in connection with FIGS. 21-39.

Mechanical interstage valve 612 includes Axial Convex shape Spool valve 620 (ACS valve) separable from main valve body 619 to couple and decouple chambers B and C and thereby allow or prevent fluid communication between the chambers. As illustrated in FIG. 40 ACS valve 620 can seal against surface 621, which may prevent high pressure fluid being transferred back from combustion chamber C into compression chamber B. As ACS valve 620 moves and seals against surface 622, interstage valve 612 is in a closed state, which prevents high pressure fluid from being transferred from compression chamber B into power chamber C. In farther exemplary embodiments of the present invention as illustrated in FIG. 40, power piston 604 projection 636, disk 633, bias element 634 and return bias element (for example, a spring) 635 function are identical to the correspondence referenced plunger 523, bias element 524 and return bias element 525 as previously illustrated in FIGS. 39A-J.

Note that while the above paragraph discusses valve 620 sealing against surface 621 to prevent high pressure fluid transfer from chamber C to chamber B and valve 620 sealing against surface 622 to prevent high pressure fluid transfer from chamber B to chamber C, the surfaces could prevent fluid flow in either direction. The discussion in the previous paragraph relates to exemplary pressure differentials during a cycle of a DPCE engine.

In another exemplary embodiments of the present invention as illustrated in FIG. 40, bias element 634's function (a disk spring, for example) is to absorb the kinetic energy generated as momentum (impulse) when power piston 604 reaches and pushes axial convex shape spool valve 620 (while pushing disk 633 and fully squeezing bias element 634). It should be understood that the kinetic energy dumping mechanism (i.e. adequate bias element as illustrated by bias element 634) is not limited to the embodiments described above with respect to FIG. 40, but may be used in other applications, including other types of double piston cycle engines, split-cycle engines, four-stroke engines, and compressors.

In some embodiments, engine performance data may be collected and processed to further optimize performance of the mechanical interstage valves as described in FIGS. 21-44. More specifically, additional mechanical elements or electromagnetic elements may be used to fine-tune all (or part) of interstage valves 412, 512, 612, and 712—see next paragraph) actuation timings and transitions between open and closed states. These elements could be subjected to engine control systems (not shown in the figures), as is commonly known in the art.

Figure 41:
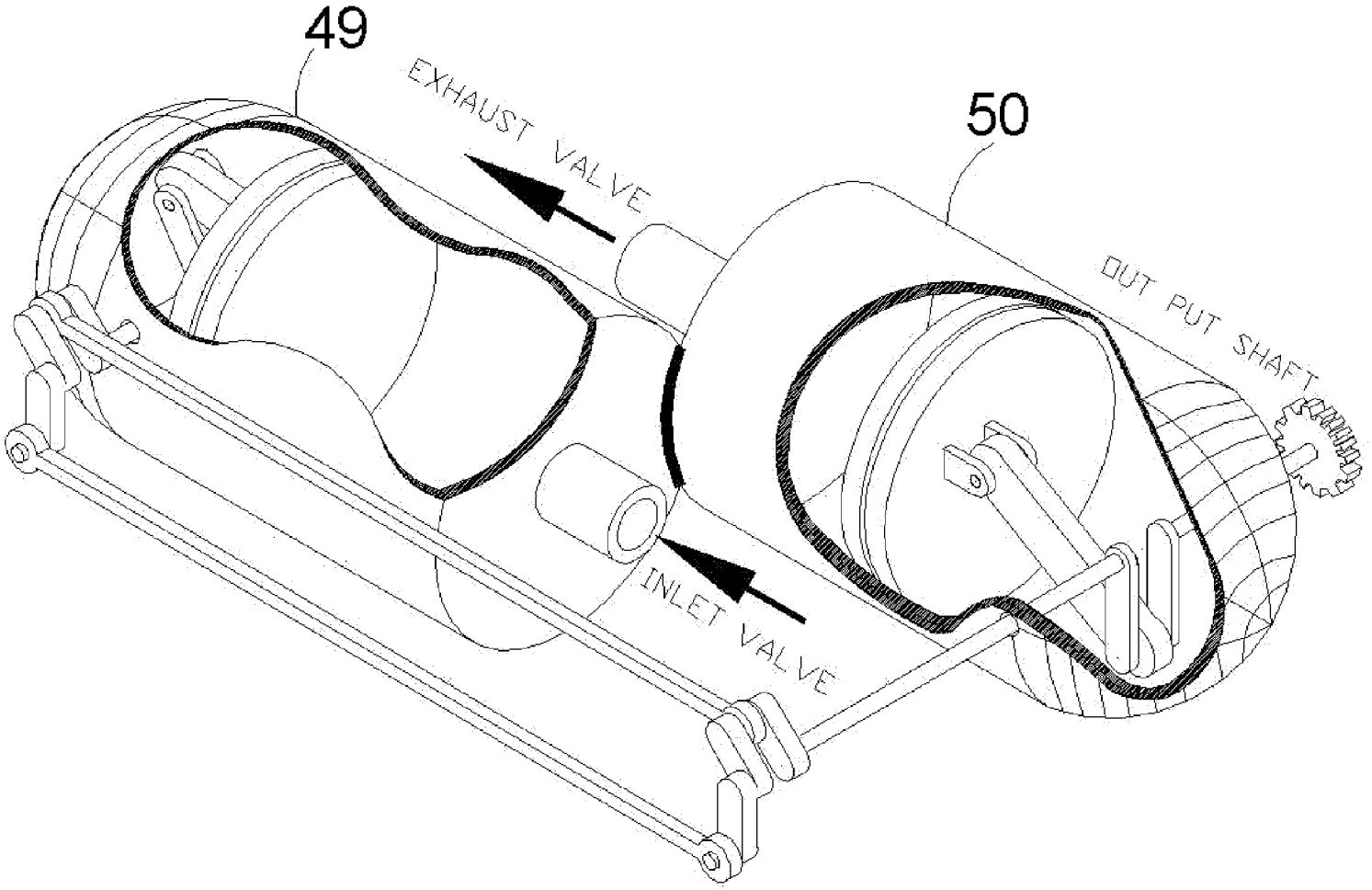
FIG. 41 is a simplified 3D illustration of a DPCE apparatus with the compression cylinder and the power cylinder on different planes, in accordance with exemplary embodiments of the present invention.

FIG. 41 illustrates an alternative DPCE dual cylinder configuration, in accordance with exemplary embodiments of the invention, wherein the compression cylinder 49 is offset from the power cylinder 50, to provide minimal thermal conductivity between the two cylinders. In this embodiment, an interstage valve may be located in a small area of overlap between the two cylinders (not shown).

An exemplary embodiment of interstage valve 712 will now be discussed with reference to FIGS. 42A-H. It should be understood that use of interstage valve 712 is not limited to the DPCE configuration described herein, but may be used in other applications, including other types of split-cycle engines, double piston cycle engines, four-stroke engines, and compressors, for example.

Figure 42A:
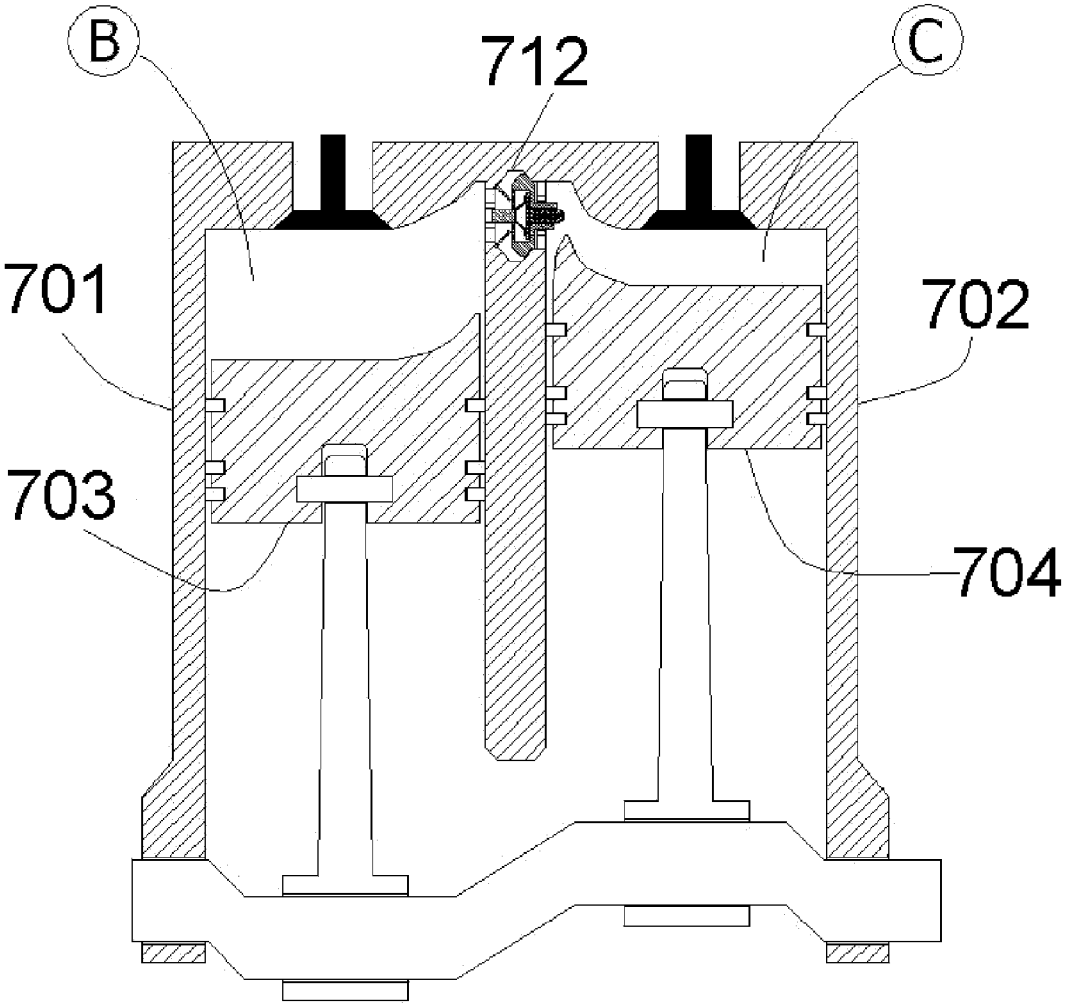
FIGS. 42A-42H.

FIG. 42A illustrates a DPCE dual cylinder configuration in which both cylinders are constructed parallel to each other, in an in-line configuration, compression cylinder 701 hosts compression piston 703, power cylinder 702 hosts power piston 704. Both pistons are moving in a tandem manner, in accordance with exemplary embodiments of the present invention. In this embodiment, the intake, exhaust and pistons relative phase angle setting may operate in a similar manner as described above. As shown in FIGS. 42A-42H, interstage valve 712 is located in a lateral passage that couples compression cylinder 701 and power cylinder 702. Unlike the description above regarding interstage valves 512 and 612 operation that involve power piston axial (horizontal) direct touch of power piston 04, interstage valve 712 operations involves power piston 704 perpendicular direct touch. Interstage valve 712 that is depicted in FIG. 44A may be used as interstage valve 412 in the embodiments described above with respect to FIGS. 21-39.

Figures 42B, 42C, 42D, 42E:
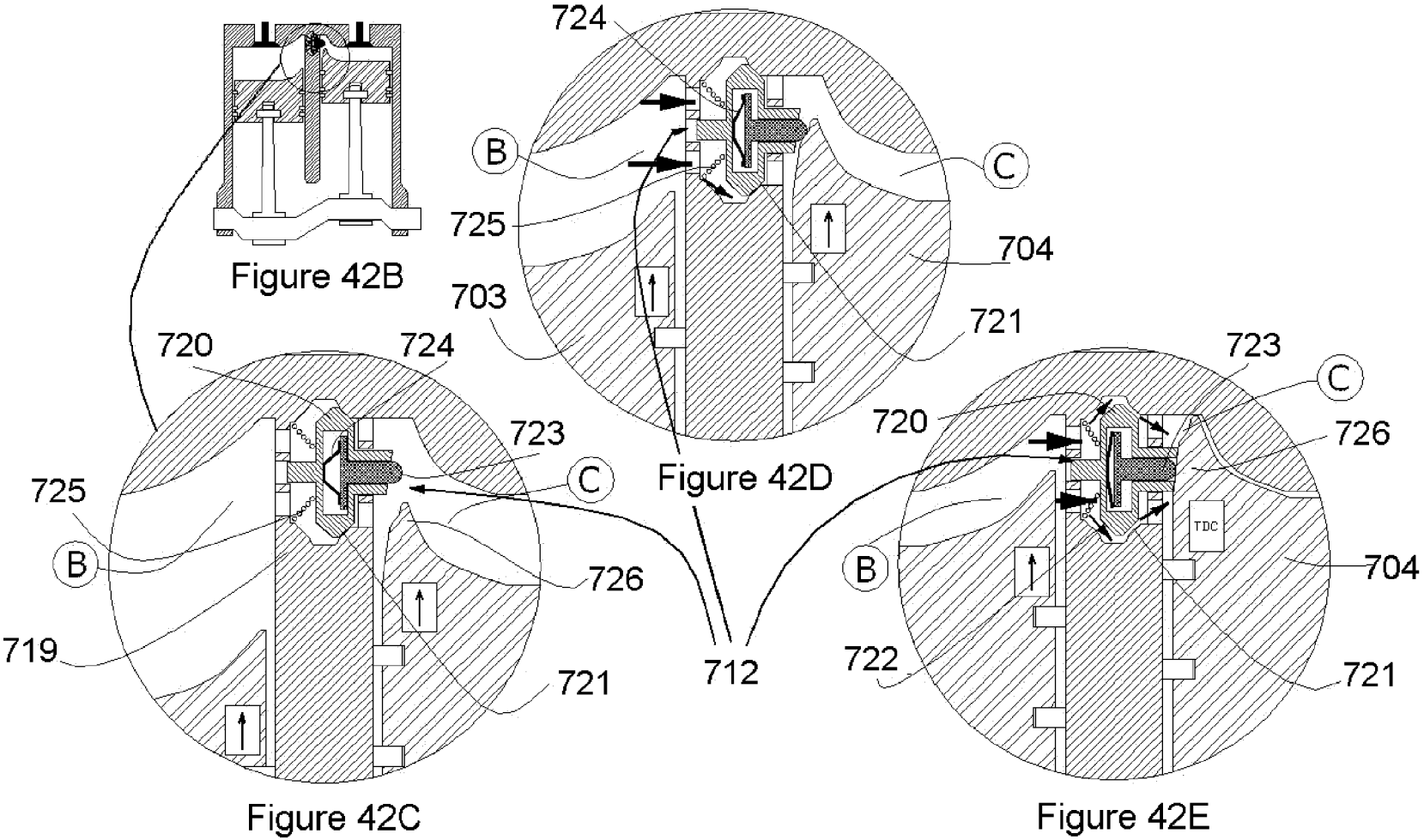
Figures 42F, 42G, 42H:
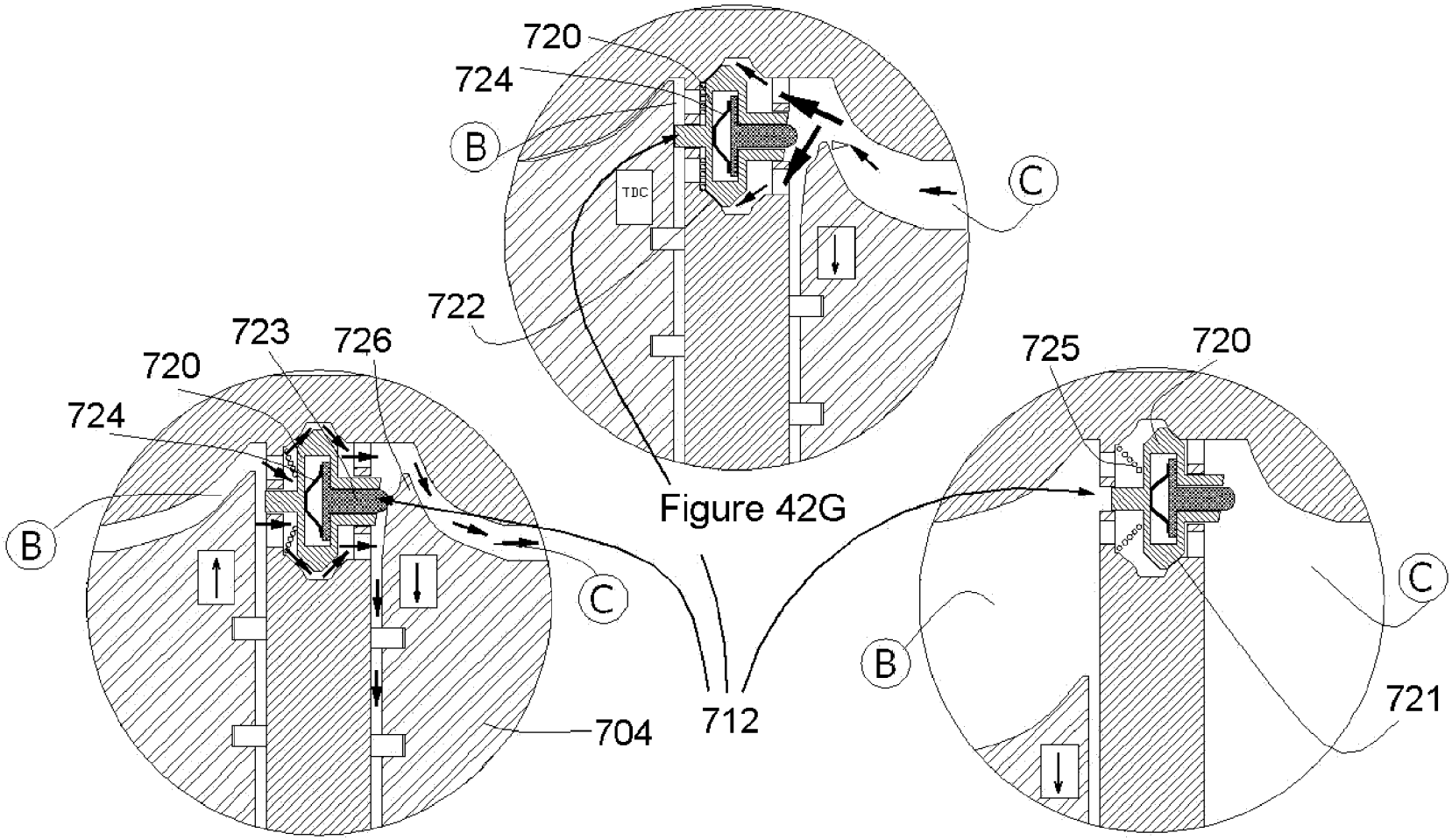

Referring to FIG. 42B and FIG. 42C, the compression cylinder 701 and the compression piston 703 define compression chamber B and the power cylinder 702 and the power piston 704 define power chamber C. Mechanical interstage valve 712 may generally include main valve body 719, DSAP valve 720, plunger 723 and bias element 724 (for example, disc spring) that together constitute the Spring Plunger Component (SPC). It also contains the Bias element Mechanism Component 725 (BMC, for example, coil spring) and power piston protrusion 726. When used in the embodiments of FIGS. 42A-H, mechanical interstage valve 712 may separate compression chamber B and combustion chamber C. In this way, the chambers may have working fluid of different pressures. Mechanical interstage valve 712 also includes DSAP valve 720 that act together with main engine body 719 to allow to couple or decouple working fluid communication between compression chamber B and combustion chamber C. As illustrated in FIG. 42C, DSAP valve 720 seals against power cylinder side's sealing surface 721, which prevents high pressure fluid transfer from compression chamber B into power chamber C. As illustrated in FIG. 42G, when DSAP valve 720 seals against compression cylinder side's sealing surface 722, high pressure working fluid is blocked from being transferred back from power chamber C into compression chamber B.

FIG. 42D is a cross-sectional view of mechanical interstage valve 712 when plunger 723 is pushed by power piston protrusion 726 towards bias element 724. As illustrated in FIG. 42D when power piston 704 approaches its TDC, piston protrusion 726 touches and partially pushes plunger 723 against bias element 724. In spite of axial forces now applied by plunger 723 and transferred through biasing element 724 on to DSAP valve 720, DSAP valve 720 is prevented of any axial displacement since it is forcefully contra-pushed by the pressure buildup in chamber B (as at this time the compression piston 703 is performing its compression stroke). Moreover, DSAP valve 720 is pushed toward sealing surface 721 not only by the force generated by compressed fluid now residing in chamber B but also by Bias element Mechanism Component 725 preload force. These opposing forces on bias element 724 (The force generated by the plunger on one side and by the compressed fluid and BMC 725 on the other side) squeezes bias element 724 (compare bias element 724 displacement in FIGS. 42C and 42D), which accumulates potential energy (to be released soon after—see below).

FIG. 42E is a cross-sectional view of mechanical interstage valve 712. As illustrated in FIG. 42E power piston 704 farther moves toward its TDC, power piston 704 protrusion 726 touches and farther pushes plunger 723 while also pushing DSAP valve 720, which forcefully causes the said valve to crack open (illustrated by black arrows passing through the gap between sealing surfaces 722 and 721 and DSAP valve 720). This leads to a sharp drop in pressure differential magnitude across the DSAP valve 720. It should be noted that on one hand, it may be beneficial for the touching point in which power piston 704 reaches DSAP valve 720 may be as close to power piston 704 TDC as practically possible as to have lower linear piston speed that enables a "soft" touch. On the other hand, the above described touching point may need to be far enough from power piston 704 TDC in order to ensure that the subsequent movement of DSAP valve 720 will open interstage valve 712 for sufficient duration and at the right timing in order to enable decrease in the differential pressure across DSAP valve 720. In some embodiments, the timing for the power piston 704 to reach DSAP valve 720 may advantageously be a point at which opening the valve will make sufficient differential pressure reduction between compression chamber B and power chamber C. It should be understood that since power piston 704 relay forces to DSAP valve 720 in a close proximity to its TDC, power piston 704 linear speed is relatively slow and therefore the established contact is moderate. In addition, during the DSAP valve 720 cracking event, power piston 704 close proximity to TDC ensures chamber C minimum volume, which also act in favor of timely differential pressure drop across the said valve i.e., a rapid increase in chamber C pressure level.

FIG. 42F is a cross-sectional view of mechanical interstage valve 712. As illustrated, when power piston 704 begins to move away from its TDC, bias element 724 expands, which enables plunger 723 edge to lean against retreating power piston 704 protrusion 726 while farther pushing DSAP valve 720 toward a wide open position; thus allowing chamber B working fluid content to flow into chamber C. As power piston 704 protrusions 726 continues its movements away from TDC, bias element 724 reaches its full expansion state keeping plunger 723 in its maximum projection relative to DSAP valve 720. As shown in FIG. 42F, mechanical interstage valve 712 remains open allowing the continuation of working fluid transfer from compression chamber B into power chamber C.

FIG. 42G is a cross-sectional view of mechanical interstage valve 712. As power piston 704 protrusion 726 continues its movements away from TDC, combustion in the power cylinder chamber C causes sharp increase in chamber C pressure. DSAP valve 720 proceed its inertial movement toward valve sealing seat 722 due to the following three events: (i) inertial forces developed during power piston 704 reaching and pushing DSAP valve 720, (ii) bias element 724 expansion energy releases, (iii) sudden chamber C pressure burst (combustion), which sets high differential pressure between chamber C and chamber B. In this stage engine power stroke carries on. DSAP valve 720 sealing against surface 722 decouples chamber C and chamber B.

FIG. 42H is a cross-sectional view of mechanical interstage valve 712. When power piston 704 approaches its BDC, the exhaust valve opens (not shown) and the burnt gaseous exhale, chamber C high pressure diminishes, which enables the Bias Mechanism Component (BMC, coil spring, for example) 725 to expand and push back DSAP valve 720 to seal against surface 721. Once the said valve seals against surface 721, interstage valve 712 decouples the fluid passage between compression chamber B and power chamber C enabling the next compression stroke to occur.

An exemplary embodiment of mechanical interstage valves 812A and 812B will now be discussed with reference to FIG. 43. It should be understood that use of mechanical interstage valves, as described in FIG. 43 and the related text, is not limited to the DPCE described herein, but may be used in other applications, including other types of split-cycle engines, double piston cycle engines, four-stroke engines, and compressors, for example.

Figure 43:
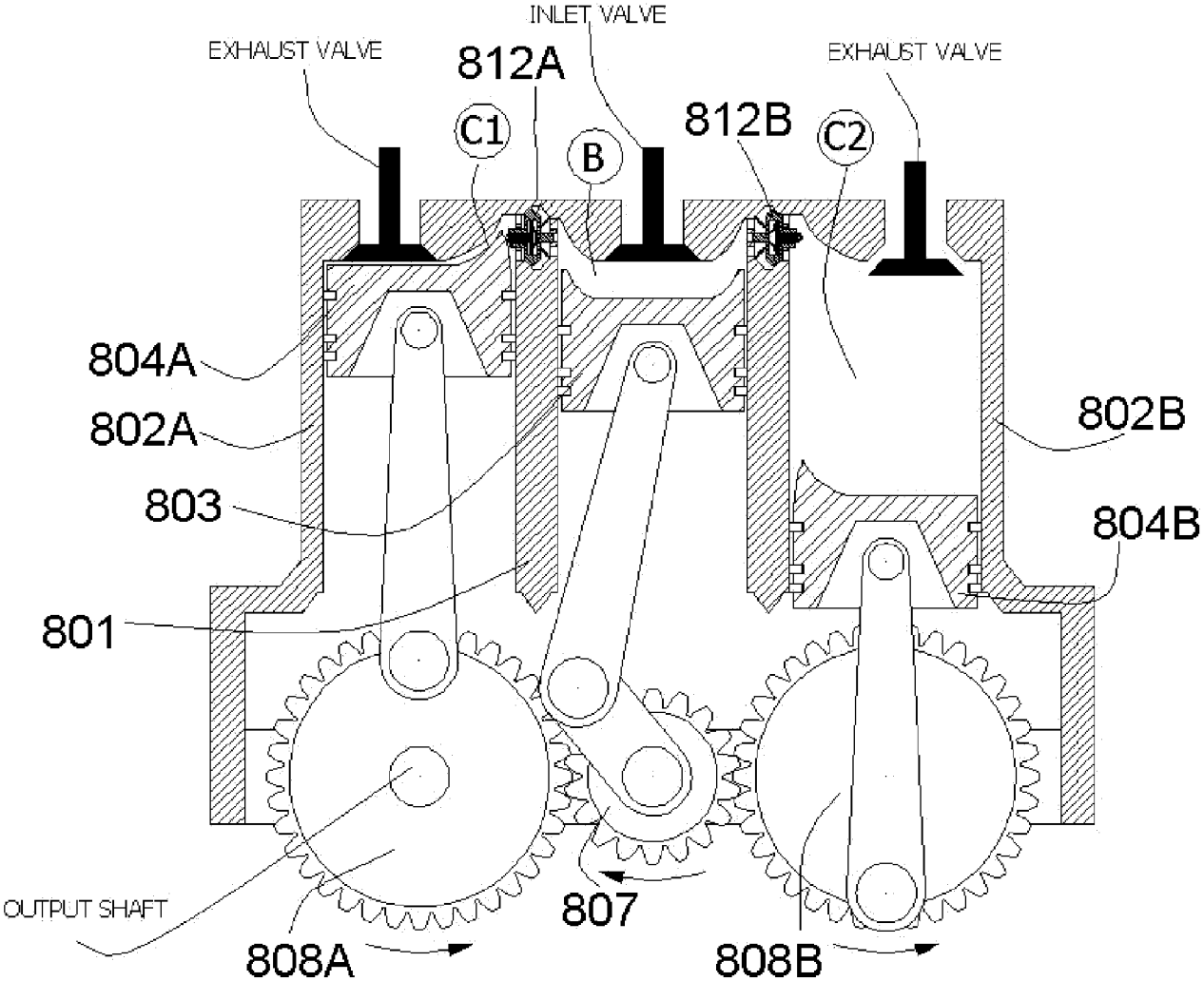
FIG. 43 is a cross-sectional illustration of a DPCE apparatus with a single compression cylinder (middle) that is used to charge two power cylinders (the two side cylinders), in a consecutive manner, while the compression piston crankshaft rate of rotation is double the rate of the power piston crankshafts and the two power cylinders are phased by 180 degrees crankshaft. Each of the power cylinders is coupled to the compression cylinder by its own interstage valve.

FIG. 43 illustrates a DPCE triple cylinder configuration in which all three cylinders are constructed parallel to each other (in-line), compression cylinder 801 hosts compression piston 803, power cylinder 802A hosts power piston 804A and power cylinder 802B hosts power piston 804B. Pistons 803, 804A, 804B are moving in a tandem manner, respectively connected through connecting roads to crankshafts and gears 807, 808A, and 808B (the gears direction of rotation is marked by black arrows). In an exemplary embodiment, the single intake valve 810, both exhaust valves (811A and 811B), each of both power pistons 804A and 804B and compression piston 803 setting and relative phase angle may operate in similar manner as described above (FIGS. 21-41). However, as shown in FIG. 43, two independent interstage valves 812A and 812B are located in lateral passages, opposed to each other (for example). Interstage valve 812A couples the compression cylinder 801 and power cylinder 802A and mechanical interstage valve 812B couples the compression cylinder 801 and power cylinder 802B. Interstage valves 812A and 812B method of operation are same as described and illustrated above with respect to FIGS. 42A-H. Specifically, when actuated by its referenced power piston, both mechanical interstage valves 812A and 812B are capable of coupling or decoupling compression chamber B and power chamber C1 or power chamber C2, respectively, in an alternate manner. Crankshaft gear 807 is by design smaller than crankshaft gears 808A and 808B to enable that for each one full turn of crankshaft gears 808A and 808B crankshaft gear 807 turns two full revolutions. Also, power piston 804A setting relative to power piston 804B is phased by 180 degrees (crankshaft rotation). Hence, because phased compression piston 803 moves twice as fast as both power pistons 804A and 404B independently, this engine configuration fires twice during each engine output shaft full turn (see output shaft location in FIG. 43). FIG. 43 describes a split-cycle engine that uses a single compression piston within a single compression cylinder to charge two power cylinders, in a consecutive manner, while the compression piston crankshaft rate of rotation is double than the power piston crankshaft rotation. As can be understood by those skilled in the art, the principle described in FIG. 43 can be implemented for an engine with more than 2 power pistons: Specifically, a split-cycle engine that uses a single compression piston within a single compression cylinder to charge (n) power cylinders, in a consecutive manner, while the compression piston crankshaft rate of rotation (Rounds Per Minute, RPM) is higher than the power piston crankshaft rotation according to the equation: [Compressor RPM]=[combustor RPM]×(n). In such arrangement the (n) power cylinders may be phased from each other by 360/n degrees (crankshaft rotation).

Although the embodiment above is described with respect to gears, other variable rotational energy connecting elements, such as belts and chains, for example, could be used to provide a different speed in the compression piston and the combustion piston.

When considering engine power to weight ratio and compact packaging of the engine, utilizing an engine in which a single compression cylinder feeds more than one power piston is beneficial as understood by those skilled in the art.

Figure 44:
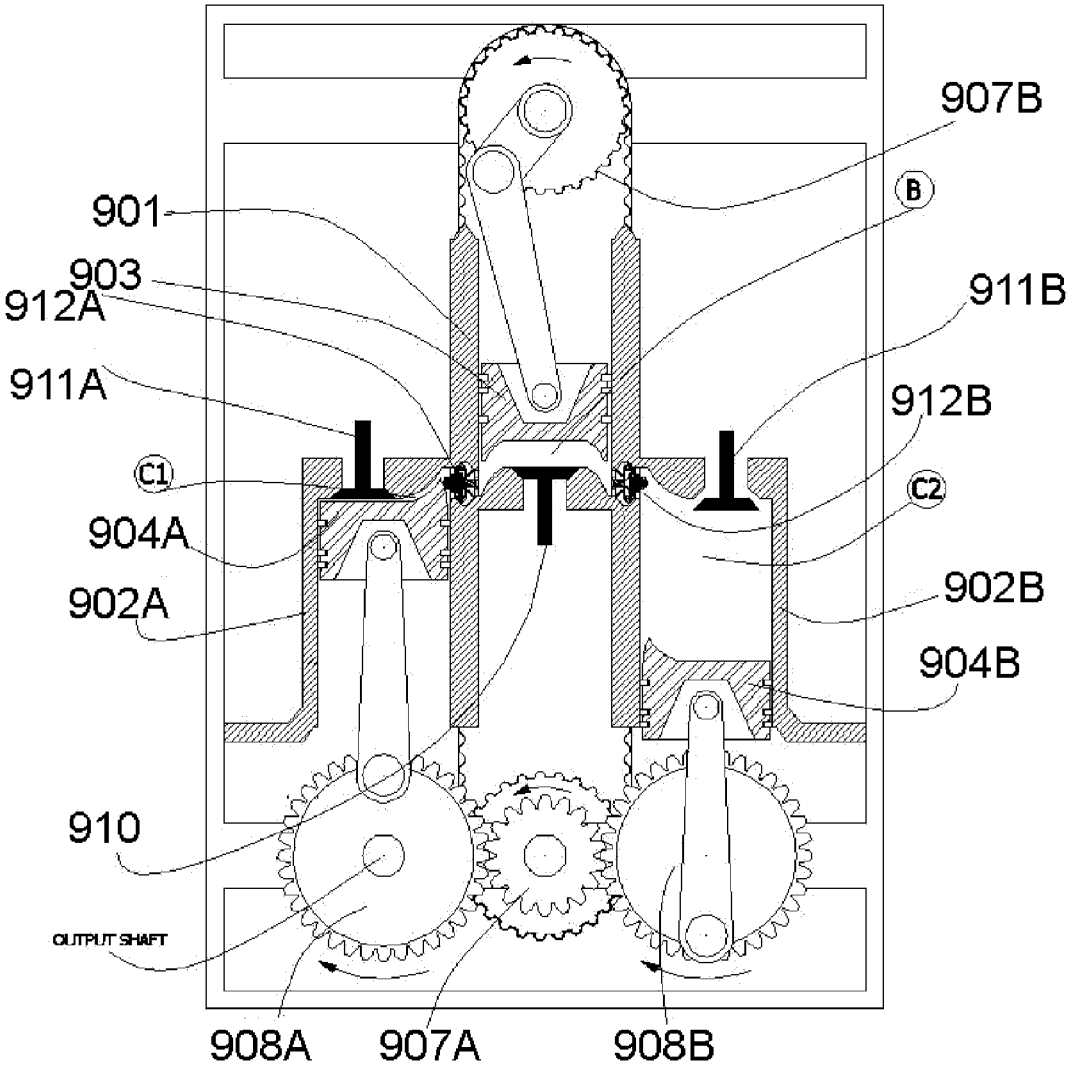
FIG. 44 is a simplified cross-sectional side view of the DPCE apparatus of FIG. 43, in which the 3 cylinder/piston pairs have their own crankshaft and the 3 pairs are coupled be gearwheels. In addition, the compression cylinder is opposing the two power cylinders. The compression gearwheel is half the size of the power gearwheels to enable crankshaft rate of rotation, which is double the rate of rotation of the power piston crankshaft.

FIG. 44 illustrates a DPCE triple cylinder configuration in which two power cylinders 902A and 902B are constructed parallel to each other (in-line) and an opposed single compression cylinder 901 is facing both said power cylinders. Compression cylinder 901 hosts compression piston 903, power cylinder 902A hosts power piston 904A and power cylinder 902B hosts power piston 904B. Pistons 904A, 904B are moving in a tandem manner, respectively connected through connecting roads to crankshafts and gears 908A and 908B (the gears direction of rotation is marked by black arrows), while piston 903 is connected through connecting road to crankshaft and gear 907B, which in turn is driven by rotating gear 907A utilizing time belt and pulleys mechanism (for example). In an exemplary embodiment, the single intake valve 910, both exhaust valves (911A and 911B), each of both power pistons 904A and 904B and compression piston 903 setting and relative phase angle may operate in similar manner as described above (FIGS. 21-41). However, as shown in FIG. 44, two independent and identical, interstage valves 912A and 912B are located in lateral passages, opposed to each other (for example). Interstage valve 912A couples the compression cylinder 901 and power cylinder 902A and mechanical interstage valve 912B couples the compression cylinder 901 and power cylinder 902B. Interstage valves 912A and 912B method of operation are the same as described and illustrated above with respect to FIGS. 40A-H. Specifically, when actuated by its referenced power piston, both mechanical interstage valves 912A and 912B are capable of coupling or decoupling compression chamber B and power chamber C1 or power chamber C2, respectively, in an alternate manner. Crankshaft gear 907A is by design smaller than crankshaft gears 908A and 908B such as to enable that for each one full turn of crankshaft gears 908A and 908B crankshaft gear 907A turns two full revolutions, which through timing belt and pulleys mechanism (or any other kinetic energy delivery mechanisms known in the art, i.e. gears, driveshaft's, crankshafts via connecting road, etc). Power piston 904A setting relative to power piston 904B is phased by 180 degrees (crankshaft rotation). Hence, because phased compression piston 903 moves twice as fast as both power pistons 904A and 904B independently, this engine configuration fires twice during each engine output shaft full turn (see output shaft location in FIG. 44). FIG. 44 describes a split-cycle engine that uses a single compression piston within a single compression cylinder to charge two power cylinders, in a consecutive manner, while the compression piston crankshaft rate of rotation is double than the power piston crankshaft rotation. As can be understood by those skilled in the art, the principle described in FIG. 44 can be implemented for an engine with more than 2 power pistons: Specifically, a split-cycle engine that uses a single compression piston within a single compression cylinder to charge (n) power cylinders, in a consecutive manner, while the compression piston crankshaft rate of rotation (Rounds Per Minute, RPM) is higher than the power piston crankshaft rotation according to the equation: [Compressor RPM]=[combustor RPM]×(n). In such arrangement the (n) power cylinders should be passed from each other by 360/n degrees (crankshaft rotation).

When considering engine power to weight ratio and compact packaging of the engine, utilizing an engine in which a single compression cylinder feeds more than one power piston is beneficiary as understood by those skilled in the art.

In accordance with one embodiment, the crossover valves discussed herein may be employed in a steam-enhanced DPCE ("SE-DPCE"). A SE-DPCE may include an inner cylinder and an outer cylinder within the power cylinder. The power piston in the SE-DPCE may also comprise a dual-head piston further comprising a disc-shaped inner piston and a ring-shaped outer piston. The power cylinder may also includes a compressed air valve located within the outer power cylinder and extending to the compression cylinder, a steam/air exhaust valve located within the outer power cylinder, an outer exhaust shell comprising a wrapped exhaust pipe, and a heat isolation layer. In one embodiment, the power cylinder is manufactured using highly conductive materials for further heat energy utilization. The additional cylinders of the power cylinder may be utilized to perform additional power strokes. Further details on SE-DPCEs are described within U.S. Pat. No. 7,273,023, the disclosure of which is incorporated herein in its entirety.

In some embodiments, engine performance data may be collected and processed to further optimize performance of the mechanical crossover valve described herein. More specifically, additional mechanical elements or electromagnetic elements (for example, such electromagnetic elements that are also described in U.S. patent application No.: US 2010/0186689 A1, Pub. Date Jul. 29, 2010, to Tour, the entire contents of which are incorporated by reference herein in their entireties) may be use to fine-tune all (or part) of the crossover valves' actuation timings and transitions between open and closed states, including variable valve timing of all engine valves. These elements could be subjected to engine control systems (not shown in the figures), as is commonly known in the art. In addition, it needs to be understood that the geometry and relative positioning of the various elements as shown in the Figure is just one embodiment and that, for example, the angle by which push rods connect to DSAP valves could be different, the two cylinders relative orientation could be different (for example in a V shape with both cylinder heads sharing a crossover valve, and for example, other sealing and lubrication elements could be added as known in the art.

In some embodiments the crossover valve may be actuated by two camshafts acting from both sides of the crossover valve. At a point at the cycle where the first camshaft pulls the crossover valve, the second camshaft pushes crossover valve. In some embodiments, having two such camshafts reduces the requirements or eliminates all together the need for a crossover valve return spring. In some embodiments, having two such camshafts reduces balances the forces acting on crossover valve.

In some embodiments, crossover valve may be cracked open by power piston direct contact, which helps crossover valve camshaft in moving crossover valve from close 1 position to the open position. Such advantages of a split cycle internal combustion engine wherein a crossover valve is biased by piston push are also described in U.S. provisional application No. 61/565,286, filling date Nov. 30, 2011, to Tour, the entire contents of which are incorporated by reference herein in their entireties.

Further, In some embodiments, the crossover valve may part of a split-cycle engine (DPCE) in which the compression cylinder and the power cylinder are arranged in line with each other (parallel) where a single crankshaft would be connected to the compression pistons. The single crankshaft converts rotational motion into reciprocating motion of both pistons. In one such embodiment, an insulating layer of low heat conducting material could be installed, for example to separate the relatively cold compression cylinder from the relatively hot power cylinder, as is commonly known in the art. Such advantages of a split-cycle internal combustion engine (DPCE) in which the compression cylinder and the power cylinder are arranged in line with each other (parallel) where a single crankshaft would be connected to the compression piston and power piston. are also described in U.S. provisional application No. 61/565,286, filling date Nov. 30, 2011, to Tour, the entire contents of which are incorporated by reference herein in their entireties.

Further, In some embodiments, crossover valve (or several (n) crossover valves), may be incorporated as part of a split-cycle engine (DPCE) that uses a single compression piston within a single compression cylinder to charge two or more (n) power pistons, within two or more (n) power cylinders, in a consecutive manner, while the compression piston crankshaft rate of rotation (Rounds Per Minute, RPM) is higher than the power piston crankshaft rotation according to the equation: [Compressor RPM]=[combustor RPM]×(n), and the power pistons are phased relative to each other by 360/n. Such advantages of a split cycle internal combustion engine wherein a single compression piston/cylinder charge two or more (n) power pistons/cylinders are also described in U.S. provisional application No. 61/565,286, filling date Nov. 30, 2011, to Tour, the entire contents of which are incorporated by reference herein in their entireties.

In any of the embodiments described herein, a spark plug is located on the engine compression cylinder head, on expansion cylinder head, on both compression and expansion heads (two spark plug units), or in the chamber within the valve (chamber E). Having the spark plug located in the compression cylinder head enable to farther retreat ignition timing, which may be beneficial during high speed engine rotation. Having the spark plug located in the expansion cylinder head may reduce compression cylinder temperatures. Having the spark plug located within the chamber within the valve may reduce compression temperatures. Having two plugs may provide any of the above advantages and gives the operator more options.

In some embodiments, combustion initiation occurs (initiated/tuned) to be shortly (for example, 1-20 crankshaft degrees, and in some embodiments, 1-5 crankshaft degrees) after total compression cylinder volume plus expansion cylinder volume plus crossover valve volume (chambers B, C and E) reaches its combined-minimum-volume. This minimum volume may be reached while crossover valve is in open position .i.e. fluid may flow from the compression cylinder into the combustion cylinder. For a spark ignited (SI) engine, combustion may occur 10-40 crankshaft degrees after the opening of the crossover valve and, in some embodiments, 20-30 crankshaft degrees after the opening of the crossover valve. For compression ignited (CI) engine, combustion may occur 5-25 crankshaft degrees after the opening of the crossover valve and, in some embodiments, 5-15 crankshaft degrees after the opening of the crossover valve.

In some embodiments, an engine may reach Minimum Best Timing [MBT] (maximum expansion cylinder pressure) at 14 to 28 power crankshaft degrees after total compression cylinder volume plus expansion cylinder volume reaches its combined-minimum-volume.

As used herein, the term "dead space" (or "dead volume" or "crevices volume") can be understood to refer to an area between a compression chamber and a combustion chamber in a split cycle engine, wherein the space holds compressed working fluid after transfer and thereby prevents the fluid from being transferred to the combustion chamber to participate in combustion. Such dead space can be a transfer valve or a connecting tube, or other structure that prevents fluid from being transfer. Other terms could be also used to describe such structures. Specific instances of dead space are discussed throughout this disclosure, but may not necessary be limited to such instances.

As used herein, the terms "crossover valve" and "interstage valve" can be understood to be interchangeable, unless otherwise stated.

As used herein, the term "fluid" can be understood to include both liquid and gaseous states.

As used herein, "crankshaft degrees" can be understood to refer to a portion of a crankshaft rotation, where a full rotation equals 360-degrees.

Any variations in font in the diagrams or figures is accidental is not intended to signify a distinction or emphasis.

Although the present invention has been fully described in connection with embodiments thereof with reference to the accompanying drawings, it is to be noted that various changes and modifications will become apparent to those skilled in the art. Such changes and modifications are to be understood as being included within the scope of the present invention as defined by the appended claims. The various embodiments of the invention should be understood that they have been presented by way of example only, and not by way of limitation. Likewise, the various diagrams may depict an example architectural or other configuration for the invention, which is done to aid in understanding the features and functionality that can be included in the invention. The invention is not restricted to the illustrated example architectures or configurations, but can be implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described. They instead can, be applied, alone or in some combination, to one or more of the other embodiments of the invention, whether or not such embodiments are described, and whether or not such features are presented as being a part of a described embodiment. Thus the breadth and scope of the invention should not be limited by any of the above-described exemplary embodiments.

It will be appreciated that, for clarity purposes, the above description has described embodiments of the invention with reference to different functional units and processors. However, it will be apparent that any suitable distribution of functionality between different functional units, processors or domains may be used without detracting from the invention. For example, functionality illustrated to be performed by separate processors or controllers may be performed by the same processor or controller. Hence, references to specific functional units are only to be seen as references to suitable means for providing the described functionality, rather than indicative of a strict logical or physical structure or organization.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known", and terms of similar meaning, should not be construed as limiting the item described to a given time period, or to an item available as of a given time. But instead these terms should be read to encompass conventional, traditional, normal, or standard technologies that may be available, known now, or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated. The presence of broadening words and phrases such as "one or more," "at least," "but not limited to", or other like phrases in some instances shall not be read to mean that the narrower case is intended or required in instances where such broadening phrases may be absent.

We claim:

1. An internal combustion engine, comprising:
- a combustion chamber with a first aperture;
- a compression chamber with a second aperture; and
- a crossover valve comprising an internal chamber, first and second valve seats, first and second valve heads, a first valve face on the first valve head, and a second valve face on the second valve head, wherein
  - the first aperture allows fluid communication between the combustion chamber and the internal chamber,
  - the second aperture allows fluid communication between the compression chamber and the internal chamber,
  - the first valve face couples to the first valve seat to occlude the first aperture, and
  - the second valve face couples to the second valve seat to occlude the second aperture;
- a compression piston in the compression chamber;
- a combustion piston in the combustion chamber, wherein the combustion piston is configured, for a cycle of the engine, to reach top dead center before or at the same time that the compression piston reaches top dead center, wherein a cycle of the engine begins when the compression piston reaches bottom dead center; and
- a combustion initiator configured to initiate combustion so that working fluid is combusted in the internal chamber.

2. The engine of claim 1, wherein the combustion initiator is configured to initiate combustion when the first valve is not coupled to the first valve seat.

3. The engine of claim 2, wherein the combustion initiator is positioned at least partially in the combustion chamber.

4. The engine of claim 1, wherein the combustion initiator is configured to initiate combustion when the second valve is not coupled to the second valve seat and the first valve is not coupled to the first valve seat.

5. The engine of claim 1, wherein the combustion initiator is configured to initiate combustion after the combustion piston reaches top dead center and before the compression piston reaches top dead center.

6. The engine of claim 1, wherein the engine is configured so that
- the first valve face is coupled to the first valve seat and the second valve face is not coupled to the second valve seat, then
- the first valve face is not coupled to the first valve seat and the second valve face is not coupled to the second valve seat, then
- the first valve face is not coupled to the first valve seat and the second valve face is coupled to the second valve seat, then
- the first valve face is coupled to the first valve seat and the second valve face is coupled to the second valve seat, and then
- the first valve face is coupled to the first valve seat and the second valve face is not coupled to the second valve seat.

7. The engine of claim 1, wherein the engine is configured so that the second valve transitions to being coupled to the second valve seat when the compression piston is at a maximal proximity to a compression cylinder head.

8. The engine of claim 1, wherein the engine is configured so that the first valve is coupled to the first valve seat when the combustion piston is at a maximal proximity to a combustion cylinder head.

9. The engine of claim 1, wherein the engine is configured so that the second valve is coupled to the second valve seat when an intake valve is open.

10. The engine of claim 1, wherein the compression chamber and combustion chamber are thermally isolated from one another.

11. The engine of claim 1, wherein the combustion chamber is thermally isolated from the surrounding environment such that the combustion chamber is maintained at a hotter temperature than the surrounding environment during operation.

12. The engine of claim 1, wherein the compression chamber comprises a plurality of air cooling ribs located on an external surface of the compression chamber.

13. The engine of claim 1, wherein the compression chamber comprises a plurality of liquid cooling passages within its housing.

14. The engine of claim 1 wherein the combustion chamber comprises a plurality of exhaust heating passages for utilizing heat provided by exhaust gases expelled by the combustion chamber to further heat the combustion chamber.

15. A method of operating an internal combustion engine with a first valve and a second valve, comprising:
- compressing working fluid in a compression chamber while the second valve occludes a passage between the compression chamber and a crossover valve;
- opening the second valve;
- opening the first valve, wherein the first valve selectively occludes a passage between the crossover valve and a combustion chamber; and combusting the working fluid in the crossover valve, wherein for a cycle of the engine, a combustion piston in the combustion chamber reaches top dead center before or at the same time a compression piston in the compression chamber reaches top dead center, wherein a cycle of the engine begins when the compression piston reaches bottom dead center.

16. The method of claim 15, wherein combusting the working fluid in the crossover valve comprises combusting the working fluid in the crossover valve while the first valve is open.

17. The method of claim 16, wherein combusting the working fluid in the crossover valve comprises initiating combustion in the combustion chamber.

18. The method of claim 15, wherein combusting the working fluid in the crossover valve comprises combusting the working fluid in the crossover valve while the second valve is open.

19. The method of claim 15, wherein combusting the working fluid in the crossover valve comprises initiating combustion in the engine after the combustion piston reaches top dead center and before the compression piston reaches top dead center.

20. The method of claim 15, further comprising opening the second valve, then opening the first valve, then closing the second valve, then closing the first valve, then opening the second valve.

21. The method of claim 15, further comprising closing the second valve when the compression piston is at a maximal proximity to a compression cylinder head.

22. The method of claim 15, closing the first valve when the combustion piston is at a maximal proximity to a combustion cylinder head.

23. The method of claim 15, further comprising opening an intake valve when the second valve is closed.

* * * * *